US009757947B2

(12) United States Patent
Kuno

(10) Patent No.: US 9,757,947 B2
(45) Date of Patent: Sep. 12, 2017

(54) LIQUID EJECTION APPARATUS HAVING WIPER FOR WIPING EJECTION SURFACE

(71) Applicant: Brother Kogyo Kabushiki Kaisha, Nagoya-shi, Aichi-ken (JP)

(72) Inventor: Daisuke Kuno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,025

(22) Filed: Mar. 31, 2016

(65) Prior Publication Data

US 2016/0288508 A1 Oct. 6, 2016

(30) Foreign Application Priority Data

Mar. 31, 2015 (JP) ..... 2015-070794
Mar. 31, 2015 (JP) ..... 2015-070944
Mar. 31, 2015 (JP) ..... 2015-074427

(51) Int. Cl.
*B41J 2/165* (2006.01)

(52) U.S. Cl.
CPC ..... *B41J 2/16541* (2013.01); *B41J 2/16508* (2013.01); *B41J 2/16511* (2013.01); *B41J 2/16538* (2013.01); *B41J 2/16544* (2013.01)

(58) Field of Classification Search
CPC ..... B41J 2/16541; B41J 2/16508; B41J 2/16544; B41J 2/16547; B41J 2/16538; B41J 2/16511
See application file for complete search history.

(56) References Cited

U.S. PATENT DOCUMENTS 6,340,219 B1 1/2002 Kumagai et al.
6,637,857 B2 10/2003 Shimizu et al.
2002/0105560 A1 8/2002 Shimizu et al.
2003/0007031 A1* 1/2003 Sugiyama ..... B41J 2/16532 347/33
2005/0195246 A1 9/2005 Ogawa

FOREIGN PATENT DOCUMENTS

JP 2000-103069 A 4/2000
JP 2000-343718 A 12/2000
JP 2001-063074 A 3/2001
(Continued)

*Primary Examiner* — Henok Legesse
(74) *Attorney, Agent, or Firm* — Banner & Witcoff, Ltd.

(57) ABSTRACT

A wiper moving mechanism moves a wiper member a predetermined distance in an intersecting direction intersecting with an ejection surface, between a wiping position where a wiper of the wiper member is in contact with the ejection surface and a separation position. The cam is rotatable about a rotation shaft and includes a contact part which causes the wiper to make contact with a cleaning member when the contact part makes contacts with a wiper holder. The contact part is configured to be distant from the wiper holder in the intersecting direction when the wiper member is positioned at the wiping position and to be overlapped with a moving range of the wiper holder in the intersecting direction by moving the wiper member by the predetermined distance in the intersecting direction. The contact part has a length which is shorter than the moving range in the intersecting direction.

20 Claims, 41 Drawing Sheets

(56) References Cited

FOREIGN PATENT DOCUMENTS

| | | | |
|---|---|---|---|
| JP | 2002-321376 | A | 11/2002 |
| JP | 2003-019807 | A | 1/2003 |
| JP | 2003-103789 | A | 4/2003 |
| JP | 3603305 | B2 | 12/2004 |
| JP | 2005-246928 | A | 9/2005 |
| JP | 4277156 | B2 | 6/2009 |
| JP | 4923341 | B2 | 4/2012 |

* cited by examiner 41
41b
K1
K2
62
63
65
67
71
72
73
75
76a1
76a2
76b3
81
82
82c
83
L1

82
82a
82a1
82b
82c
82d
82d1
82d4
A5
R1
R2
62
76b3
θ1
θ2

41
41b
K1
K2
62
63
63d
71
72
72c
73
75
76a1
76a2
76b3
76c
65
81
76
82
82c
83
67

41
41b
71
72
72c
73
63
63c
63d
62
75
76a2
76a1
65
81
76
76c
76b3
82
82d
83
67

45a~45d
41
41b
K1
K2
K3
62
63
71
72
73
75
76a1
76a2
76b1
76b3
76c
77
81
82
82c
83
65
67

FIG.39A
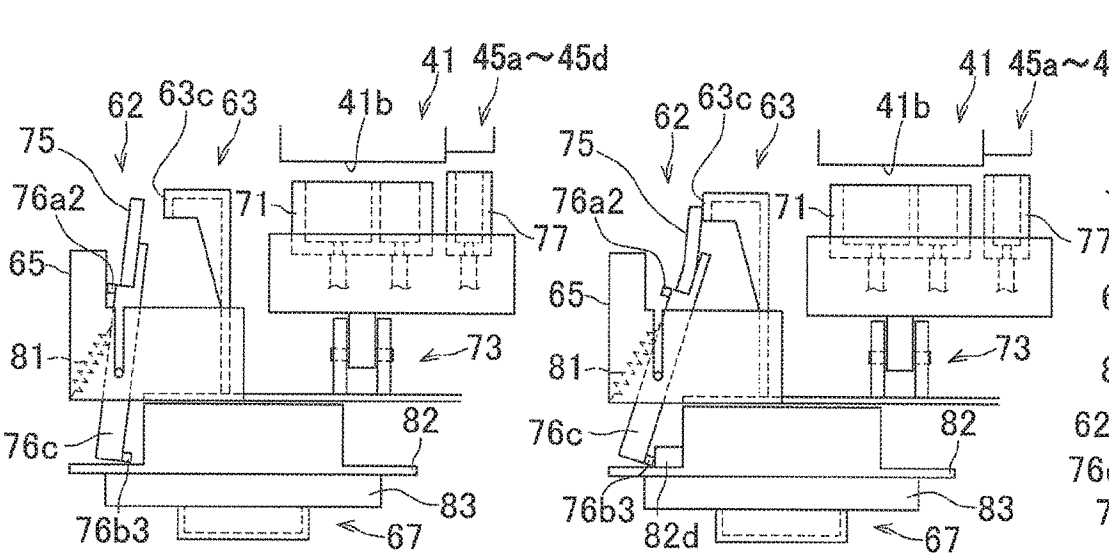
FIG.39B
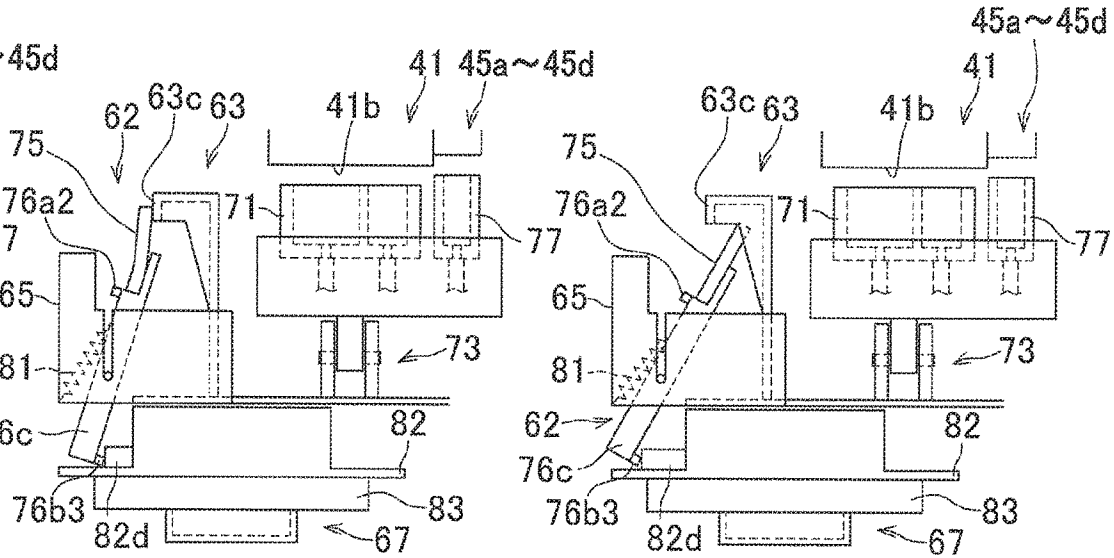
FIG.39C

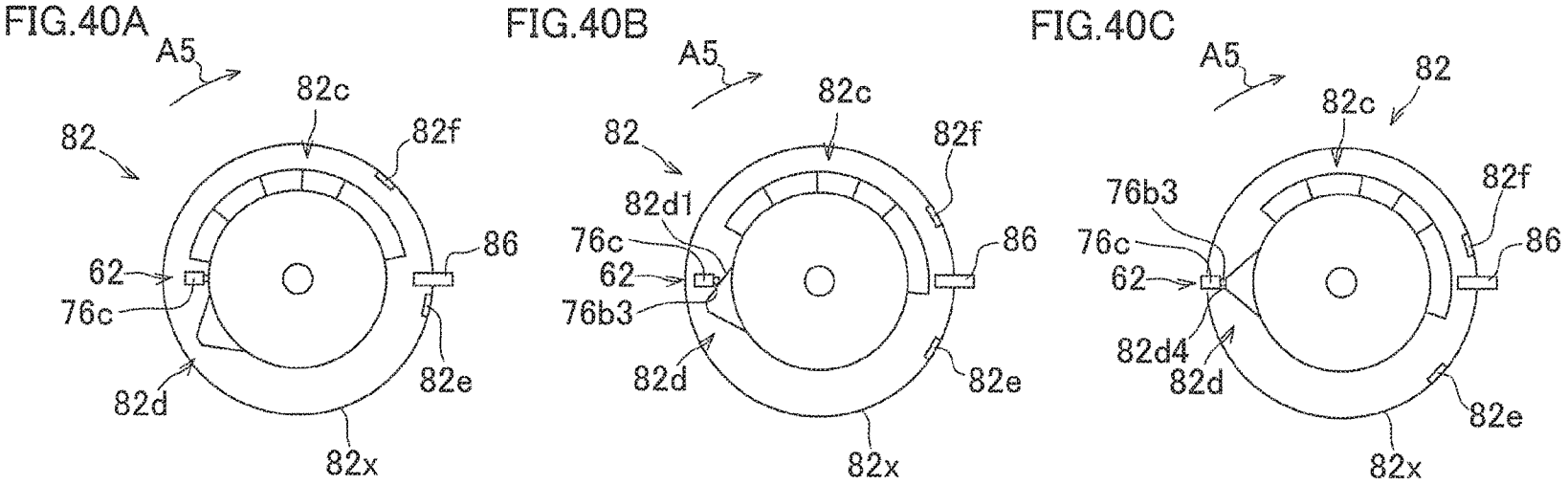
FIG.40A
FIG.40B
FIG.40C
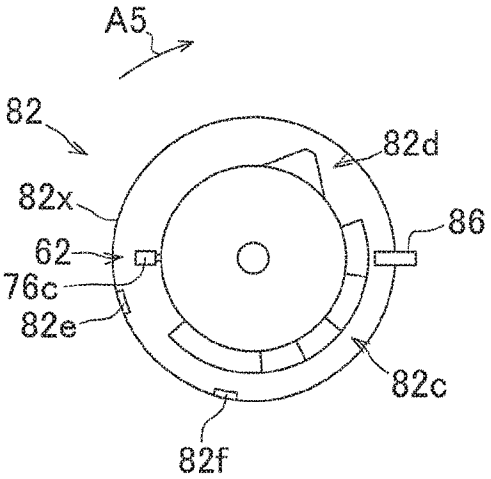
FIG.40F
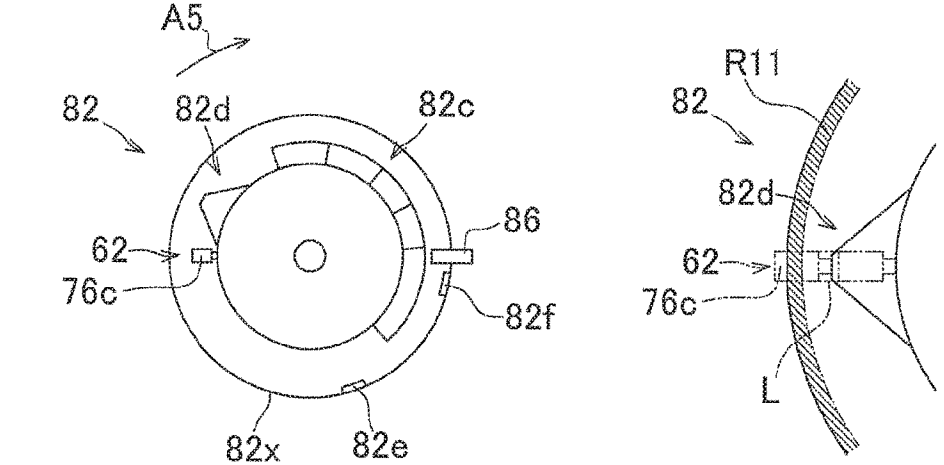
FIG.40D
FIG.40E

LIQUID EJECTION APPARATUS HAVING WIPER FOR WIPING EJECTION SURFACE

CROSS REFERENCE TO RELATED APPLICATION

This application claims priority from Japanese Patent Applications No. 2015-070794, No. 2015-070944 and No. 2015-074427 which ware filed on Mar. 31, 2015, the disclosure of which is herein incorporated by reference in its entirety.

BACKGROUND OF THE INVENTION

1. Field of the Invention

The present invention relates to a liquid ejection apparatus.

2. Description of Related Art

A known liquid ejection apparatus includes a wiper member which includes a wiper configured to wipe an ejection surface of a liquid ejection head and a wiper holder supporting the wiper, a cam gear in which a cam groove is formed, a link mechanism configured to swing the wiper member in accordance with the rotation of the cam groove, and a cleaning member configured to remove liquid adhered to the wiper member in a state that the cleaning member is in contact with the wiper. This apparatus rotates the cam gear and swings the wiper member from a separation position (forward passage start position) after setting the liquid ejection head at the wiping position to a forward passage end position, to wipe the ejection surface by the wiper. Thereafter, the apparatus rotates the cam gear and swings the wiper member from a return passage start position (forward passage end position) to a return passage end position (forward passage start position) which is identical with the separation position, after moving the liquid ejection head away from the wiping position. In the process of returning the wiper member to the separation position, the wiper member starting from the return passage start position temporarily passes the separation position, and then reaches a position where the wiper is in contact with the cleaning member. Then the wiper member is returned to the separation position. In this way, the liquid adhered to the wiper having wiped the ejection surface is removed by the cleaning member.

SUMMARY OF THE INVENTION

In the apparatus above, however, when it is necessary to rotate the cam gear in only one rotational direction, the cam gear must be rotated once in the one rotational direction to return the cam gear to the separation position, after the cam gear starts to rotate and the wiper member starts to move away from the separation position. To be more specific, when the apparatus above includes another driven member (e.g., a valve mechanism and a capping mechanism) which is not the wiper member and is driven by the rotation of the cam gear in the one rotational direction, the wiper member is unavoidably moved when the driven member is driven. On this account, each time the cam gear is rotated to drive the driven member, the wiper contacts with the cleaning member. The wiper is therefore easily deteriorated. In particular, when the cam gear is rotated while the wiper has not wiped the ejection surface, the frictional force between the wiper and the cleaning member is large because an amount of liquid adhered to the wiper is small, with the result that the deterioration of the wiper is facilitated.

In the meanwhile, a known wiper holder includes a contact part which is provided to oppose an opposing surface of the wiper. The opposing surface is a downstream surface in a wiping direction of a supporting part of the wiper, the supporting part being close to the wiper holder. In this arrangement, after the cleaning of the wiper, when the wiper is moved in the direction opposite to the direction in the cleaning to return to the original position, the wiper is in contact with the cleaning member. In this state, the leading end of the wiper is warped and the opposing surface is supported by the contact plate. This is disadvantageous in that the wiper becomes less easily warped and the wiper is less easily returned to the original position.

In addition to the above, in a known arrangement, a plurality of detection targets are provided along the peripheral edge of a cam, and a contact part which contacts with the contact target of the wiper member is provided at a position closer to a rotation shaft of the cam than the detection targets. When the diameter of the cam is relatively short, the space where the detection targets are provided is small, and hence the interval between neighboring two of the detection targets is short. When the circumferential length of the cam at a lower part of the wiper member is longer than the interval of the neighboring two detection targets, the contact part contacts with a detection target on the cam, with the result that the wiper cannot be cleaned. Such contact between the wiper member and a detection target is avoided by increasing the diameter of the cam in order to provide the detection targets at positions further outside the outermost position of the lower part of the wiper. This, however, is disadvantageous in that the cam is increased in size.

The first object of the present invention is to provide a liquid ejection apparatus which is able to restrain the deterioration of a wiper.

The second object of the present invention is to provide a liquid ejection apparatus in which the return of a wiper after removal of liquid adhered to the wiper is facilitated.

The third object of the present invention is to provide a liquid ejection apparatus in which a wiper is cleaned while increase in the size of a cam in a radial direction is restrained.

A liquid ejection apparatus according to a first aspect of the present invention comprises: a liquid ejection head including an ejection surface in which a plurality of nozzles are formed; a wiper member including a wiper configured to wipe the ejection surface and a wiper holder supporting the wiper; a wiper moving mechanism configured to move the wiper member by a predetermined distance in an intersecting direction intersecting with the ejection surface, between a wiping position where the wiper is in contact with the ejection surface and a separation position where the wiper is positioned to be separated from the ejection surface; a cleaning member configured to remove liquid adhered to the wiper in a state that the cleaning member is in contact with the wiper; a cam configured to be rotatable about a rotation shaft, the cam including a contact part, the contact part configured to cause the wiper to contact with the cleaning member when contacting with the wiper holder; a driven member configured to be driven in accordance with the rotation of the cam; and a rotation mechanism configured to rotate the cam about the rotation shaft in one rotational direction. The contact part is configured to be distant from the wiper holder in the intersecting direction when the wiper member is positioned at the wiping position and to be overlapped with a moving range of the wiper holder in the intersecting direction by moving the wiper member by the predetermined distance in the intersecting direction. The contact part has a length which is shorter than the moving range in the intersecting direction.

A liquid ejection apparatus according to a second aspect of the present invention comprises: a liquid ejection head including an ejection surface in which a plurality of nozzles are formed; a wiper including a leading end part where a wiping surface which is in contact with the ejection surface to wipe the ejection surface and a supporting part which supports the leading end part, the supporting part includes an opposing surface, the wiping surface and the opposing surface being provided on a downstream side in a wiping direction in parallel to the ejection surface; a wiper holder supporting the wiper, the wiper holder including a contact part provided to oppose the opposing surface of the wiper; a cleaning member configured to remove liquid adhered to the wiper; a first moving mechanism configured to relatively move the wiper holder and the liquid ejection head between a wiping position where the leading end part of the wiper is in contact with the ejection surface and a separation position where the wiper is separated from the ejection surface; a second moving mechanism configured to reciprocate, between a first position and a second position different from the first position, the wiper holder in a first moving direction intersecting with the wiping surface; a third moving mechanism configured to move the wiper relative to the liquid ejection head in the wiping direction; a fourth moving mechanism configured to move at least one of the wiper holder and the cleaning member in a second moving direction intersecting with the first moving direction; and a controller configured to control the first moving mechanism, the second moving mechanism, the third moving mechanism, and the fourth moving mechanism. The controller is configured to execute: a wiping process of controlling the first moving mechanism and the third moving mechanism to cause the wiping surface of the wiper to wipe the ejection surface; a cleaning process of controlling the second moving mechanism to move the wiper holder from the first position to the second position along to the first moving direction to perform a cleaning operation for causing the wiping surface of the wiper to be in contact with the cleaning member to remove the liquid adhere to the wiper surface; after the cleaning process, a returning process of controlling the second moving mechanism to move the wiper holder from the second position to the first position along the first moving direction; and after the cleaning process and before the returning process, an avoiding process of controlling the fourth moving mechanism to move at least one of the wiper holder and the cleaning member in the second moving direction such that a contact area between the wiper and the cleaning member is reduced as compared to the contact area in the cleaning process.

A liquid ejection apparatus according to a third aspect of the present invention comprises: a liquid ejection head including an ejection surface in which a plurality of nozzles are formed; a wiper member including a wiping section configured to wipe the ejection surface, the wiper member including a contact target; a cleaning member configured to be in contact with the wiping section of the wiper member to remove liquid adhered to the wiping section of the wiper member; a cam configured to be rotatable about a rotation shaft, the cam including: a contact part provided around the rotation shaft along a circumferential direction to be in contact with the contact target of the wiper member in accordance with rotation about the rotation shaft; and a plurality of detection targets which are provided at parts farther in a radial direction from the rotation shaft than the contact part is from the rotation shaft to be separated from one another along the circumferential direction; and a plurality of intermediate regions, which are formed in an interval along the circumferential direction between two neighboring ones of the detection targets, the plurality of intermediate regions including a specific intermediate region which is longer in the circumferential direction than the width in the circumferential direction of the contact target of the wiper member; a cam sensor configured to detect the detection targets; and a rotation mechanism configured to rotate the cam about the rotation shaft. When the contact part is in contact with the contact target of the wiper member, the contact part causes the contact target of the wiper member to move from a first position to a second position in accordance with the rotation of the cam, the first position being a position between the detection targets and the rotation shaft in the radial direction, the second position being farther in the radial direction from the rotation shaft than the first position and the detection targets are from the rotation shaft. The wiping section of the wiper member is in contact with the cleaning member while the contact target is moving from the first position to the second position. At least a part of the contact part is provided at a position corresponding to the specific intermediate region in the circumferential direction.

BRIEF DESCRIPTION OF THE DRAWINGS

Other and further objects, features and advantages of the invention will appear more fully from the following description taken in connection with the accompanying drawings in which:

FIG. 5A shows a state in which a suction cap of First Embodiment is at a separated position, whereas

Each of FIG. 6A

Each of FIG. 7A and FIG. 7B shows a perspective of a rotational cam of First Embodiment, whereas

FIG. 8A shows a perspective of a cleaning member of First Embodiment, whereas

Each of FIGS. 11A and 11B shows a schematic profile of a power transmission mechanism of First Embodiment. FIG. 11A shows a power transmission state of each gear when a record head is in an image recording region, whereas

FIG. 12A shows a power transmission state of each gear when an ASF motor is rotated backward while the record head is at the maintenance position in First Embodiment, whereas

Figure 16A:
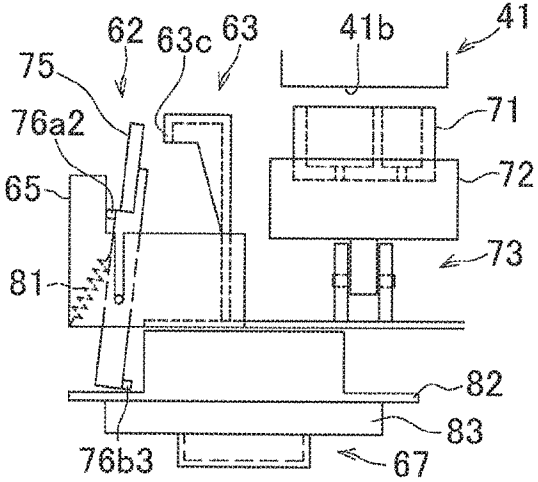
Figure 16B:
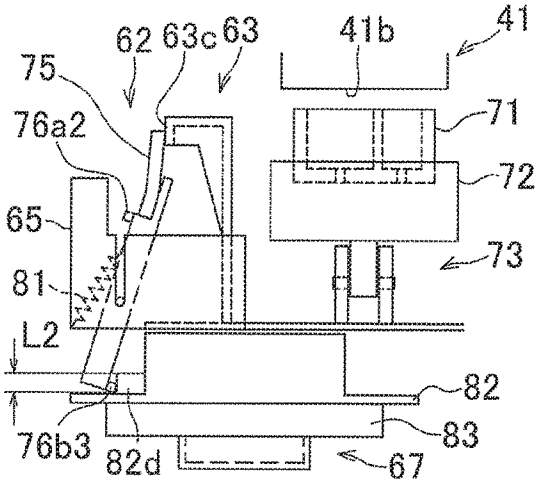
Figure 16C:
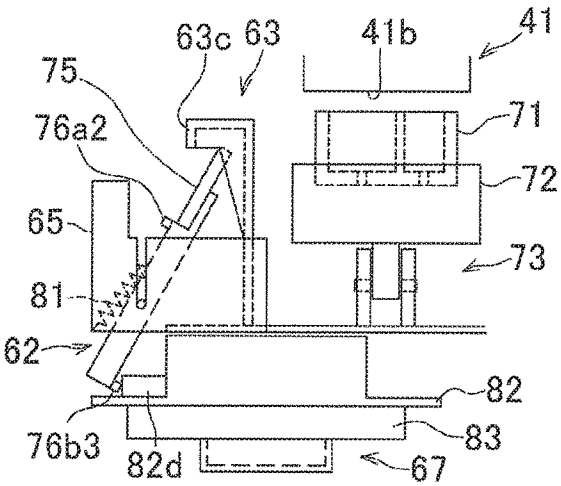

Each of FIGS. 16A to 16C shows an operation state of the wiper member in a cleaning process of First Embodiment.

Each of FIGS. 17A to 17F shows an operation state of a rotational cam in a maintenance operation of First Embodiment.

Figure 18:
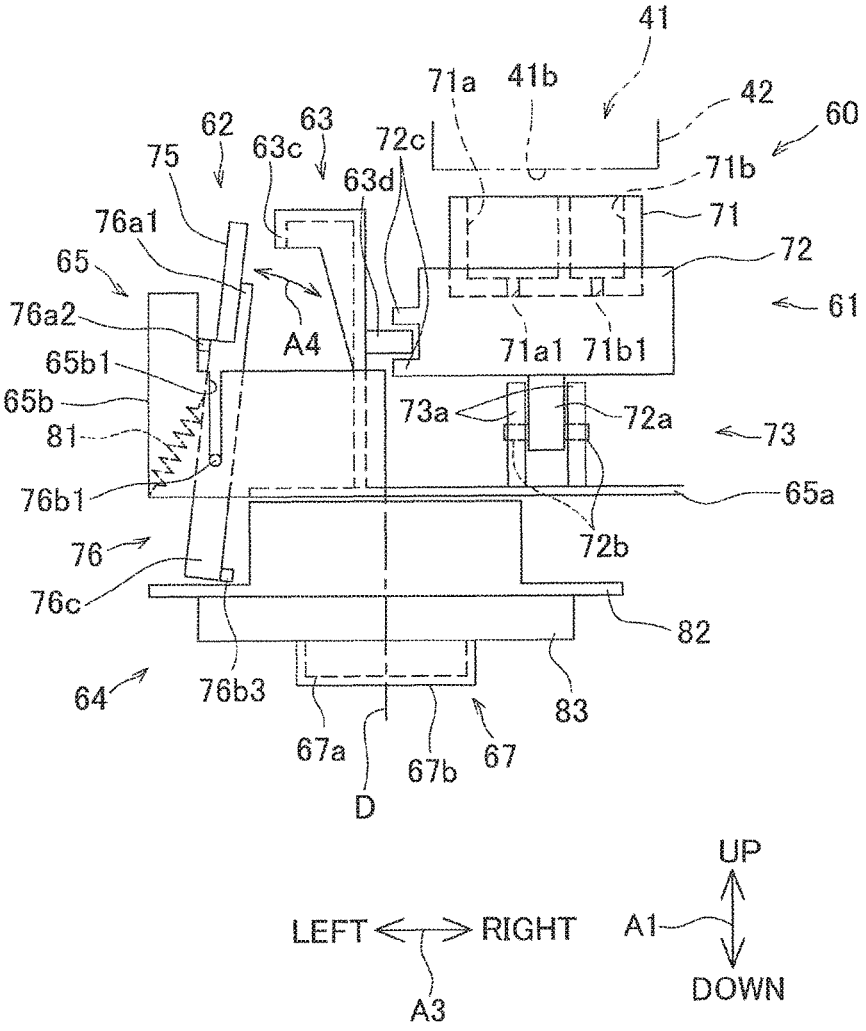

FIG. 18 is a schematic profile of a maintenance unit in a printer of Second Embodiment of the present invention.

Figure 19A:
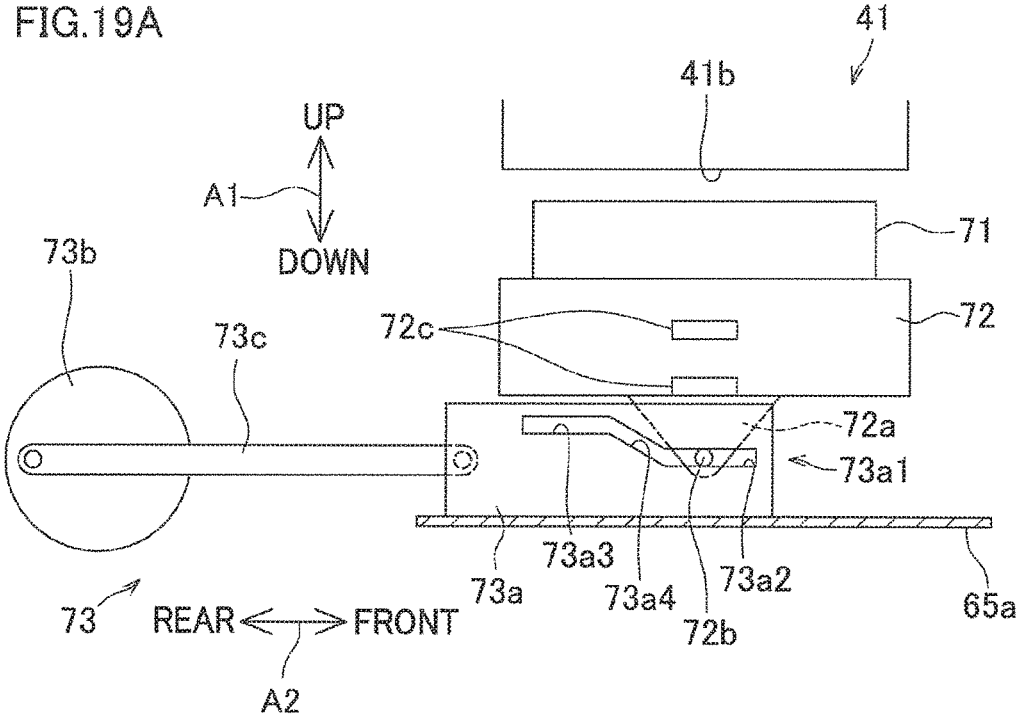
Figure 19B:
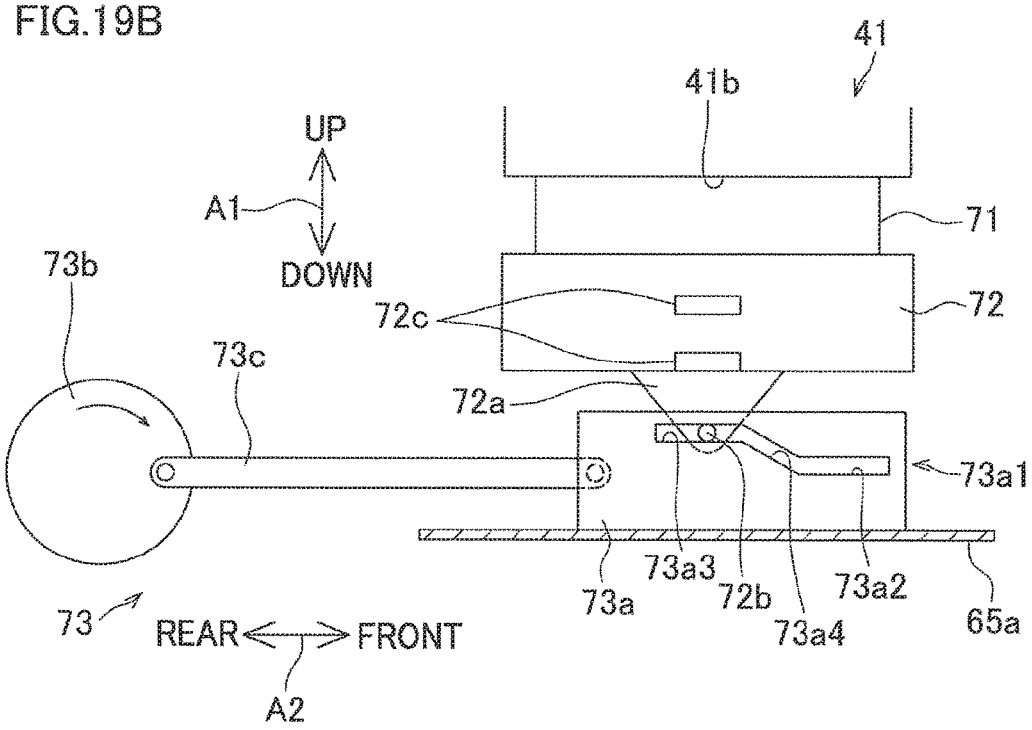

FIG. 19A shows a state in which a suction cap of Second Embodiment is at a separated position, whereas FIG. 19B shows a state in which the suction cap is at an abutting position.

Figure 20:
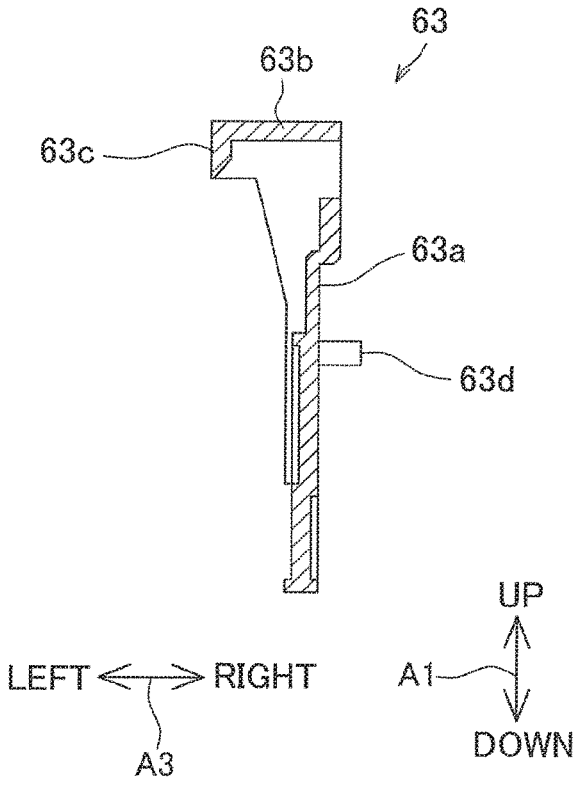

FIG. 20 is a cross section of a cleaning member of Second Embodiment.

Figure 21:
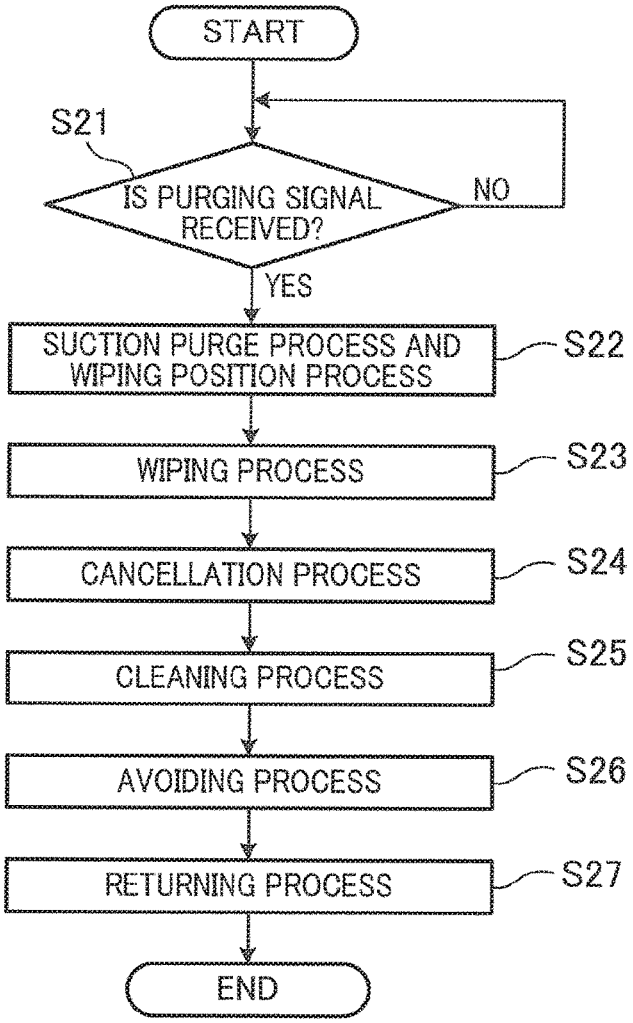

FIG. 21 is a flowchart showing the steps of a maintenance operation of Second Embodiment.

FIGS. 22A to 22E show operations from the switching of a wiper member of Second Embodiment from a separation position to a wiping position to the return of the wiper member from the wiping position to the separation position after an ejection surface is wiped by a wiper.

Each of FIGS. 23A to 23E show operation states of the wiper member in a cleaning process, an avoiding process, and a returning process of Second Embodiment.

Each of FIG. 24A to 24E shows an operation state of a rotational cam in a maintenance operation of Second Embodiment.

Figure 25A:
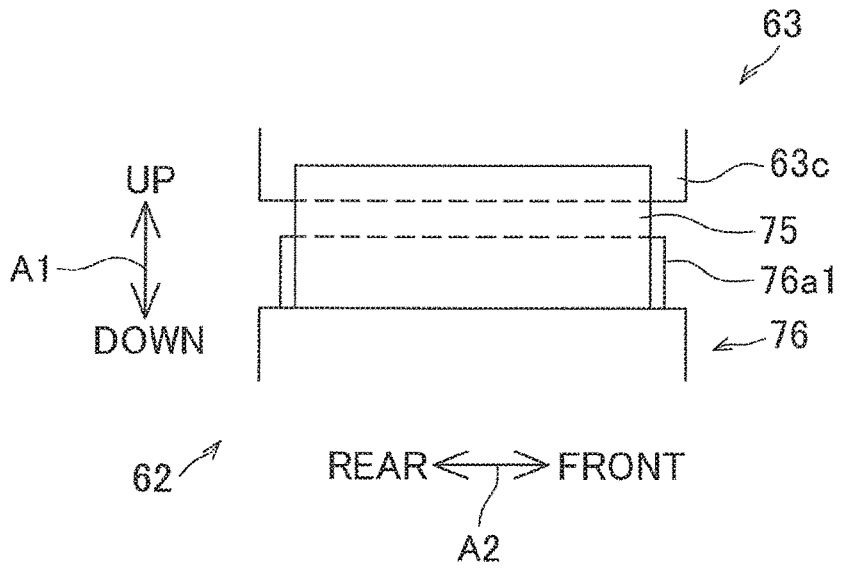
Figure 25B:
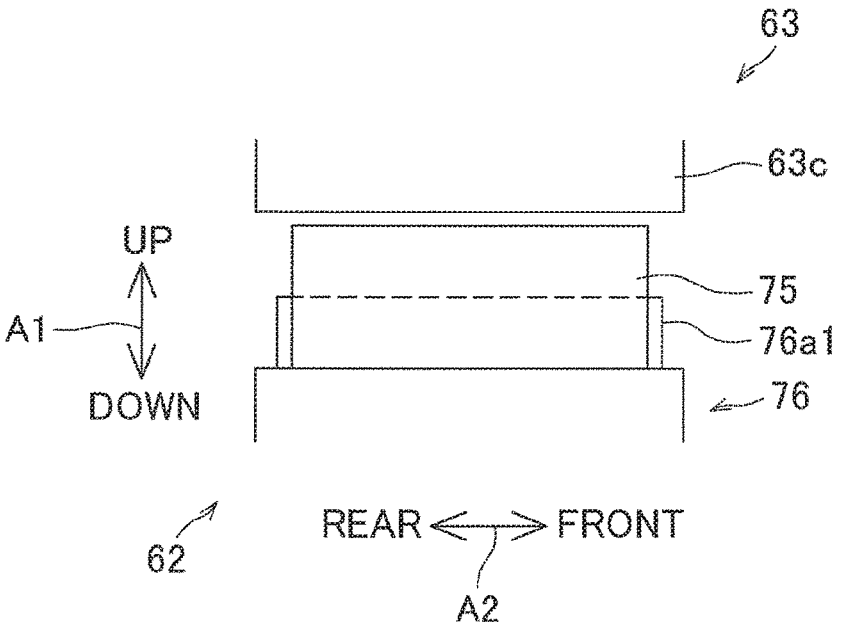

FIG. 25A shows a state in which a wiper contacts with a cleaning member in the cleaning process of Second Embodiment, whereas FIG. 25B shows a positional relationship between the cleaning member at a non-cleaning position and the wiper in the avoiding process of Second Embodiment.

Figure 26:
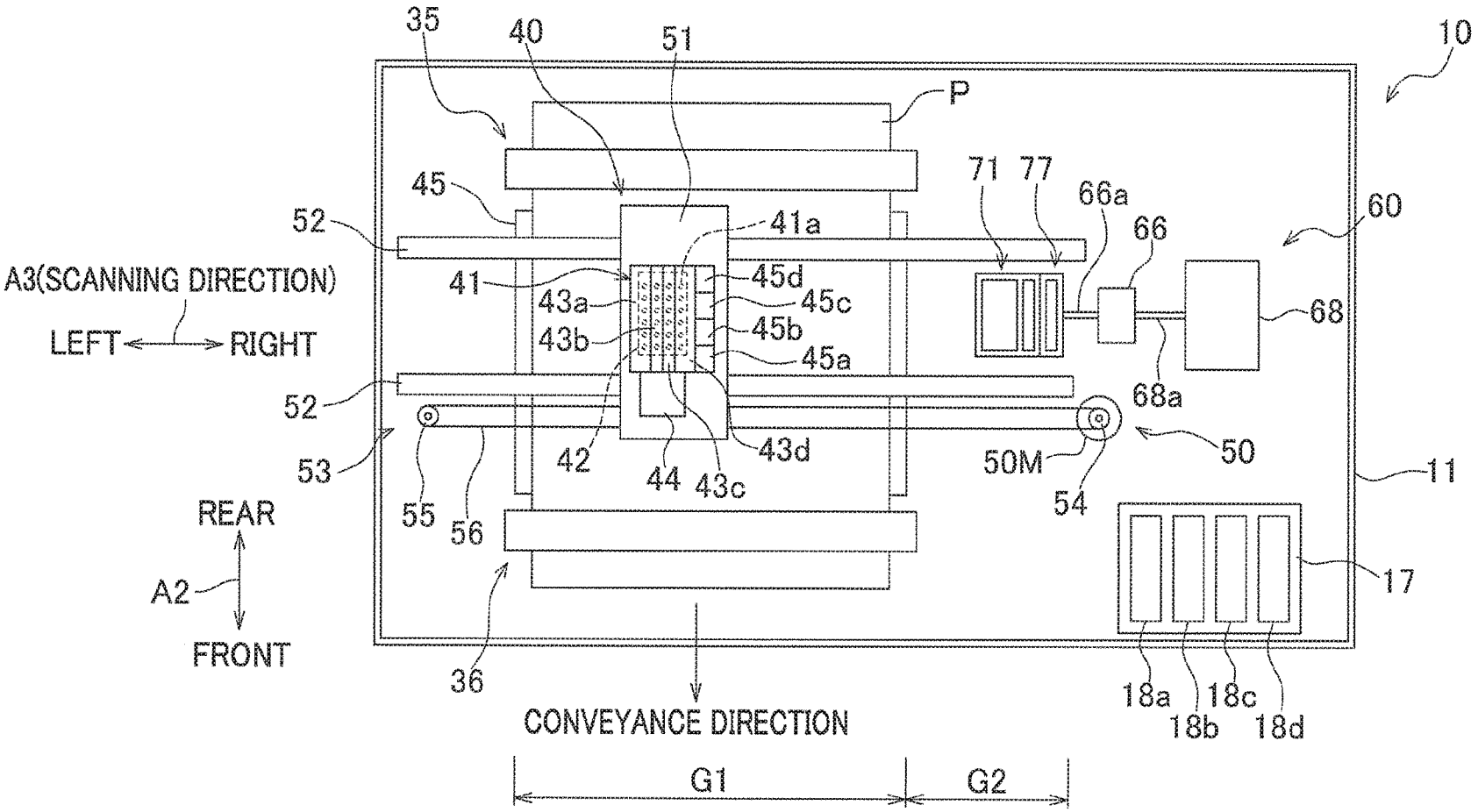

FIG. 26 is a schematic plan view of a printer of Third Embodiment of the present invention.

Figure 27:
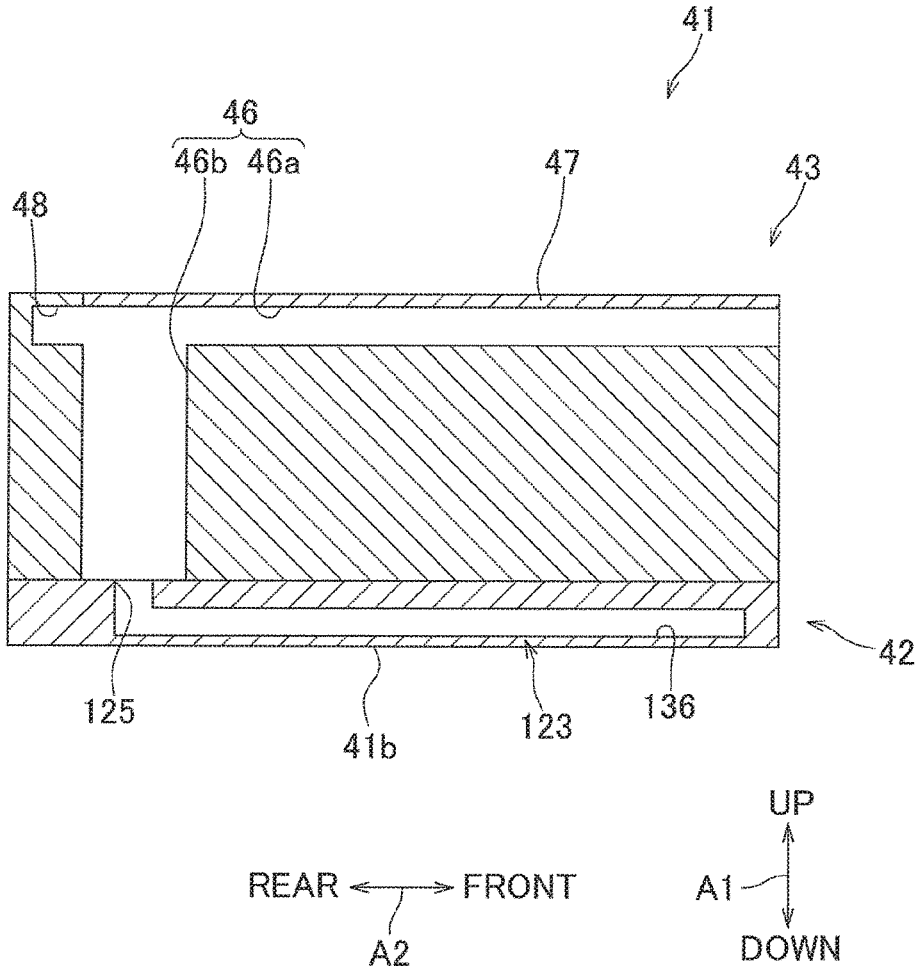

FIG. 27 is a schematic cross section of a record head of Third Embodiment, which is taken at a vertical face orthogonal to a left-right direction.

Figure 28:
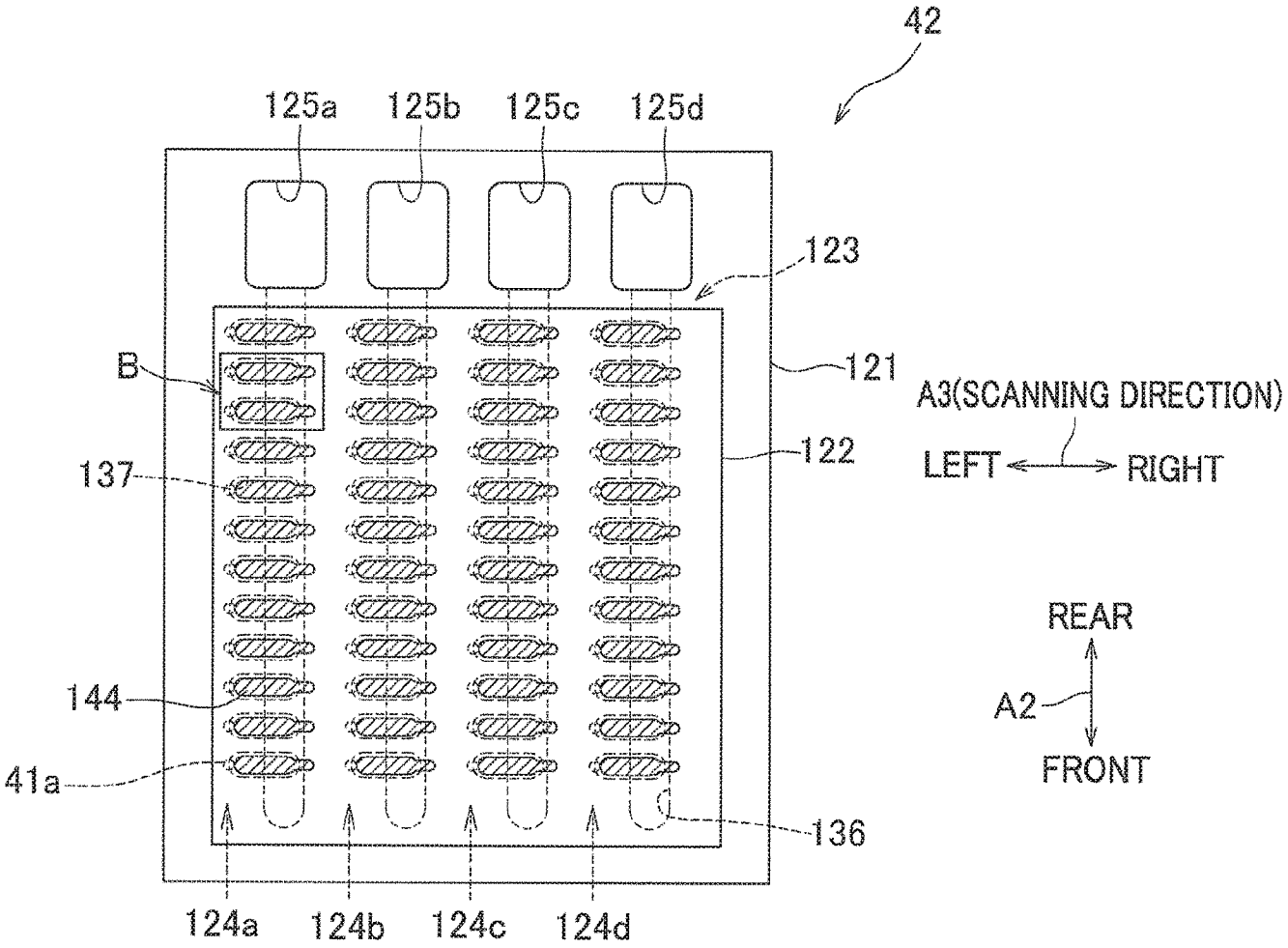

FIG. 28 is a plan view of a head main body of Third Embodiment.

Figure 29A:
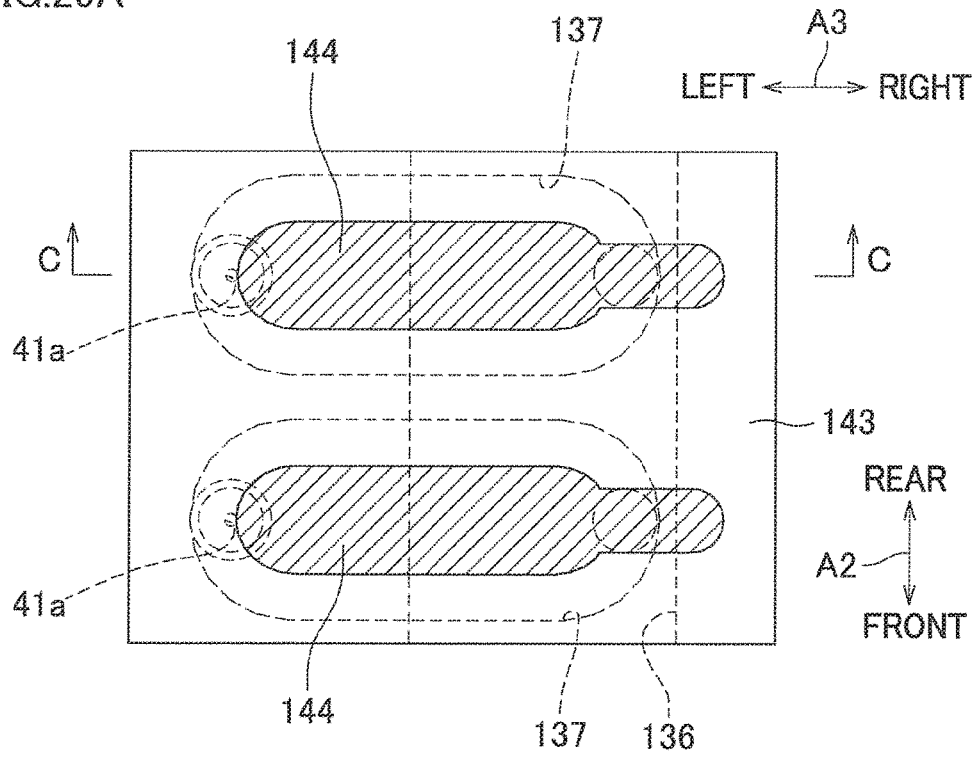
Figure 29B:
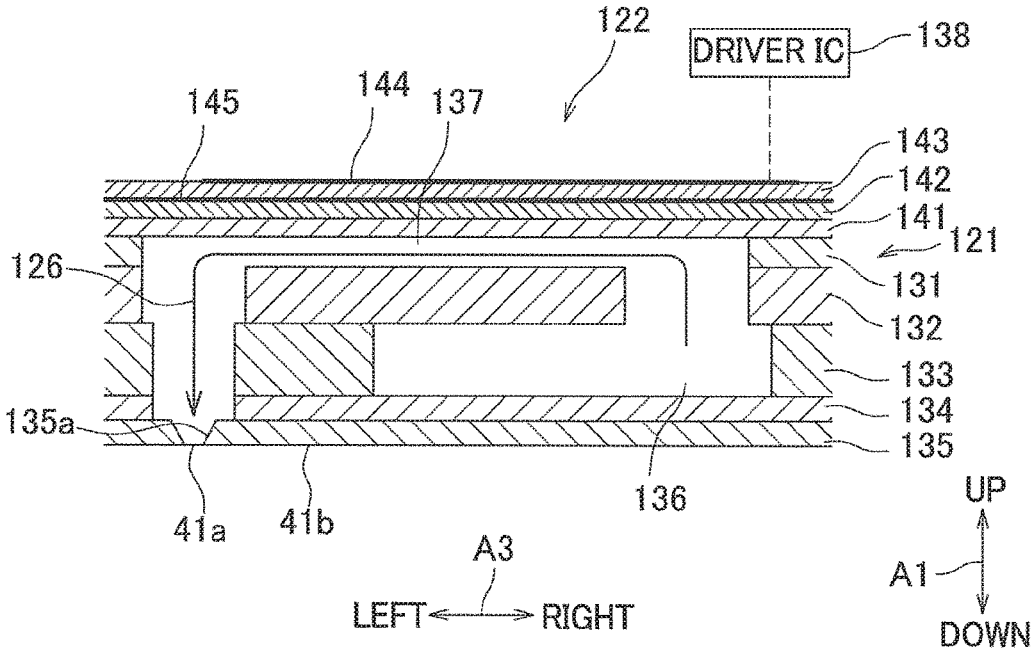

FIG. 29A is an enlarged view of a part B in FIG. 28, whereas FIG. 29B is a cross section taken along the C-C line in FIG. 29A.

Figure 30A:
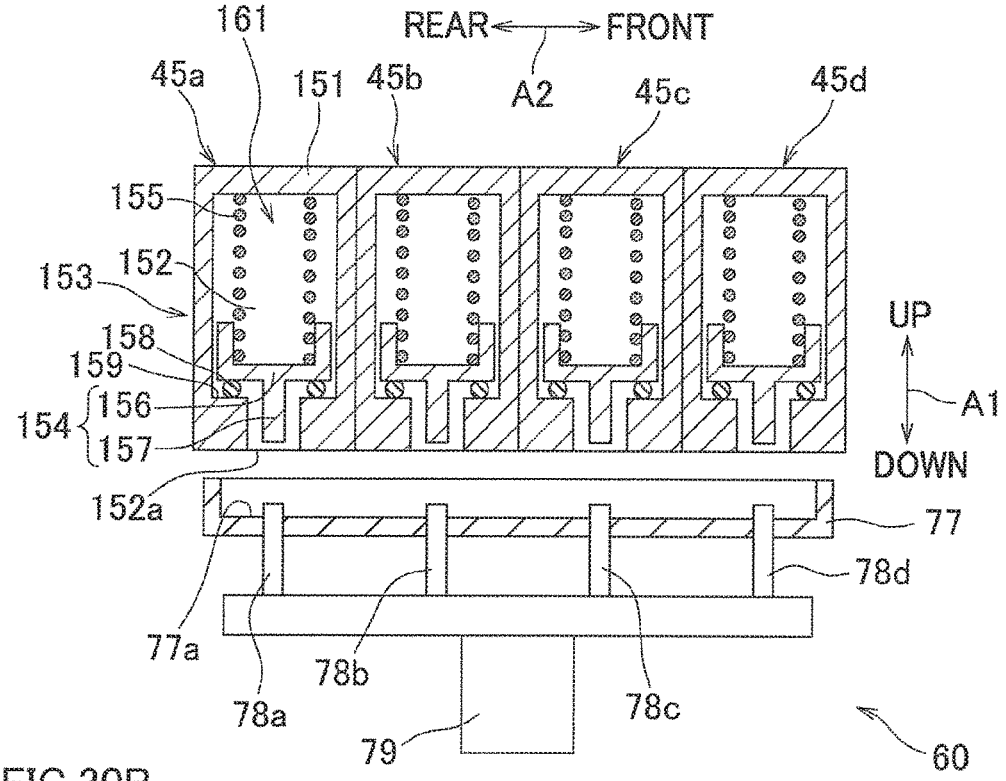
Figure 30B:
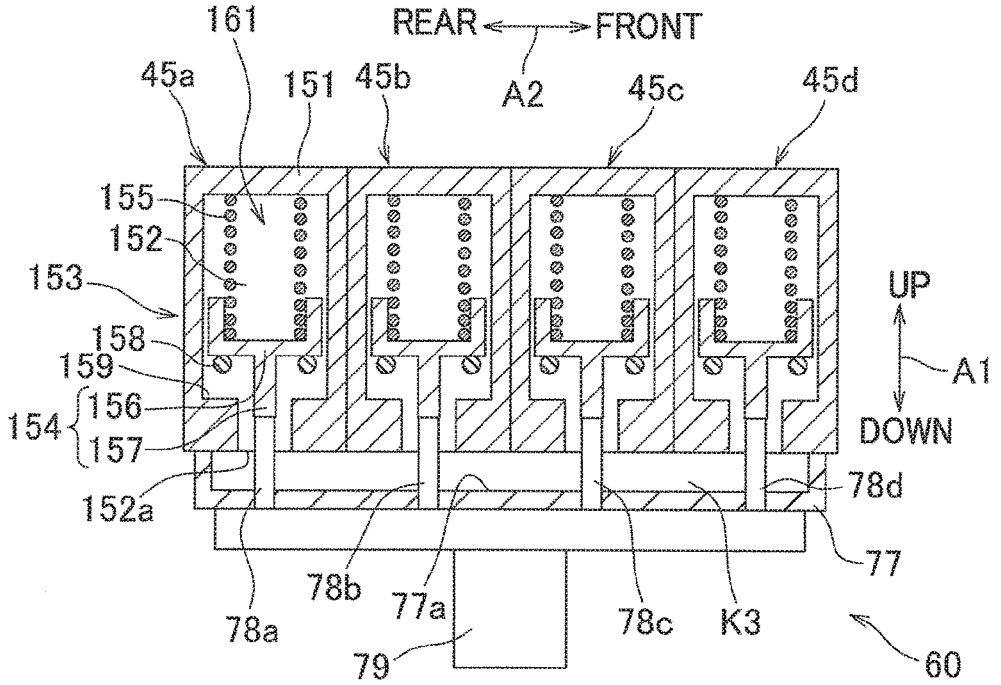

FIG. 30A and FIG. 30B are schematic cross sections of an exhaust unit when a record head of Third Embodiment is at a maintenance position, an exhaust cap of a maintenance unit, an open/close member, and a solenoid, taken along a vertical surface which is orthogonal to the left-right direction.

Figure 31:
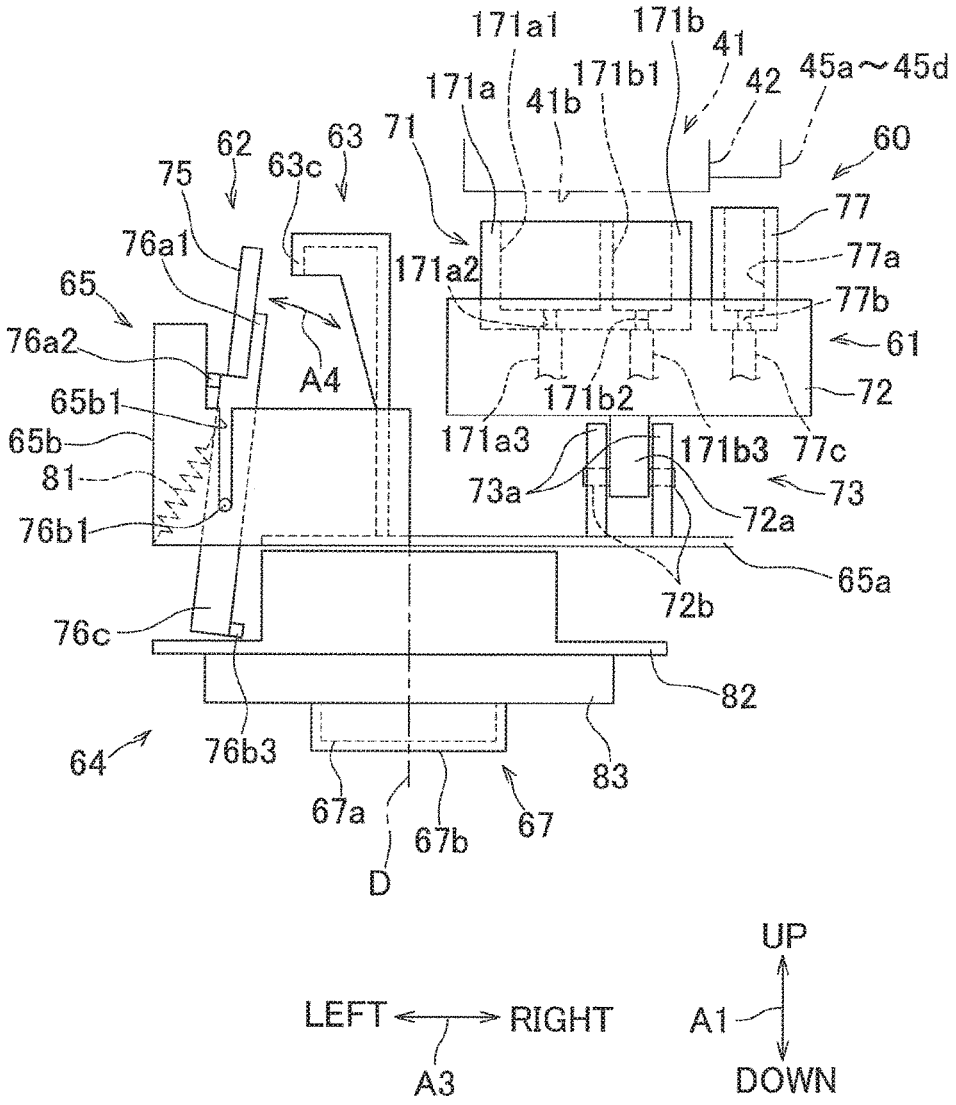

FIG. 31 is a schematic profile of a maintenance unit in the printer of Third Embodiment.

Figure 32A:
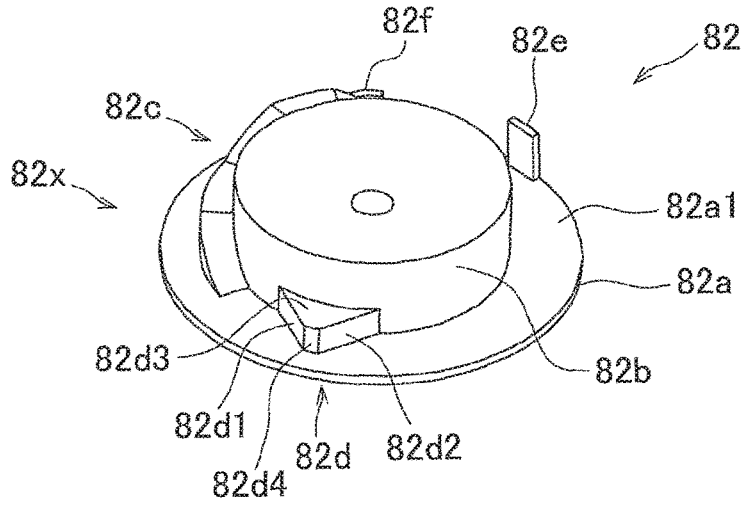
Figure 32B:
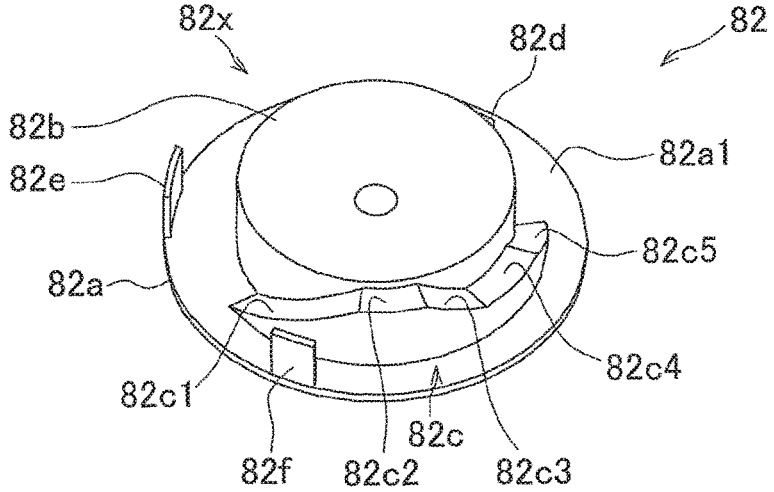
Figure 32C:
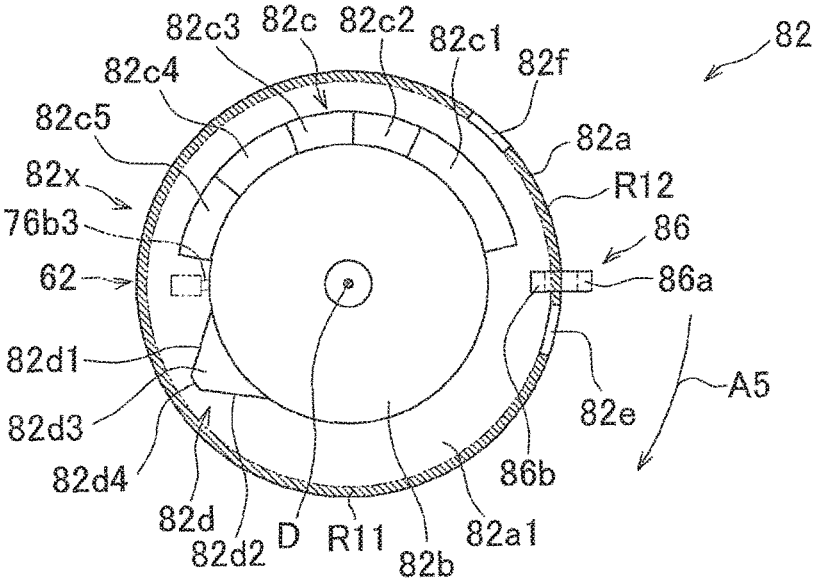

Each of FIG. 32A and FIG. 32B shows a perspective of a rotational cam of Third Embodiment, whereas FIG. 32C shows a plan view of the rotational cam.

Figure 33:
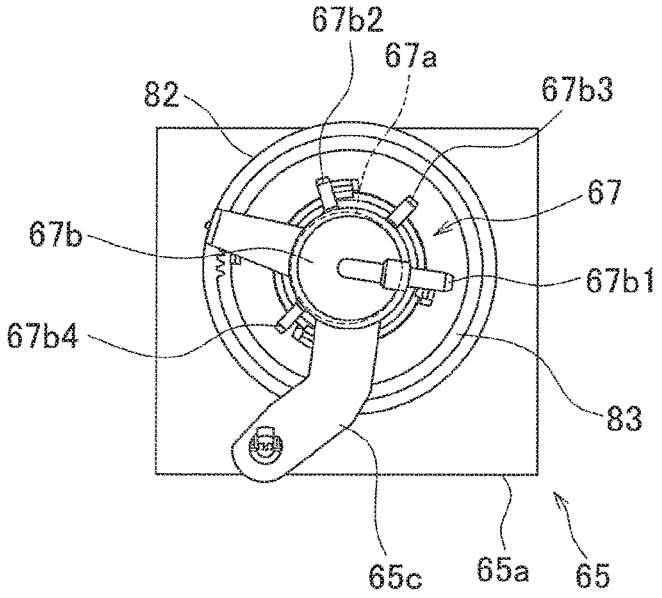

FIG. 33 shows a maintenance unit of Third Embodiment from below.

Figure 34A:
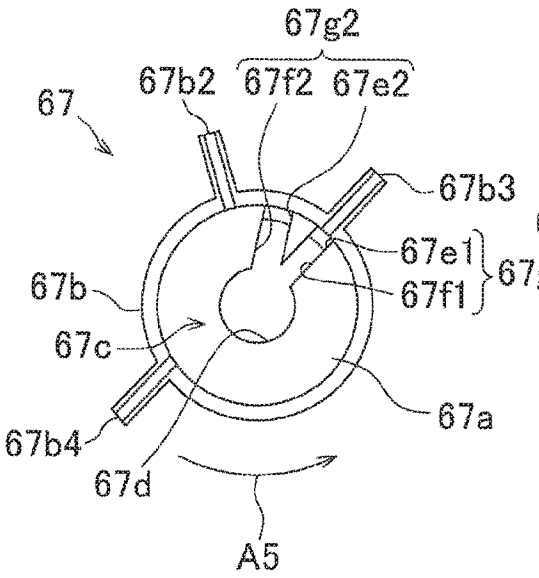
Figure 34B:
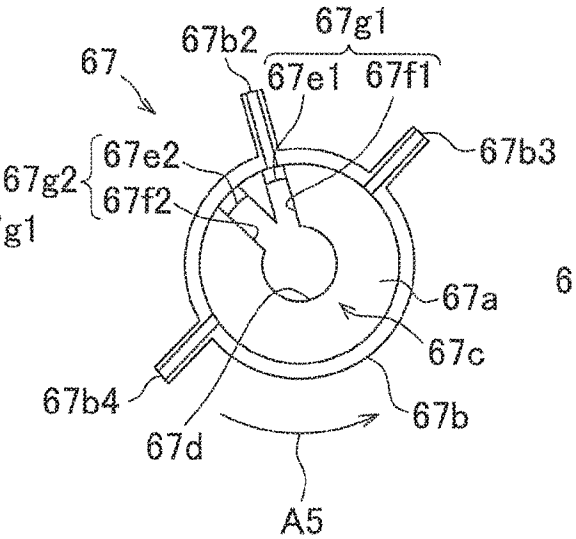
Figure 34C:
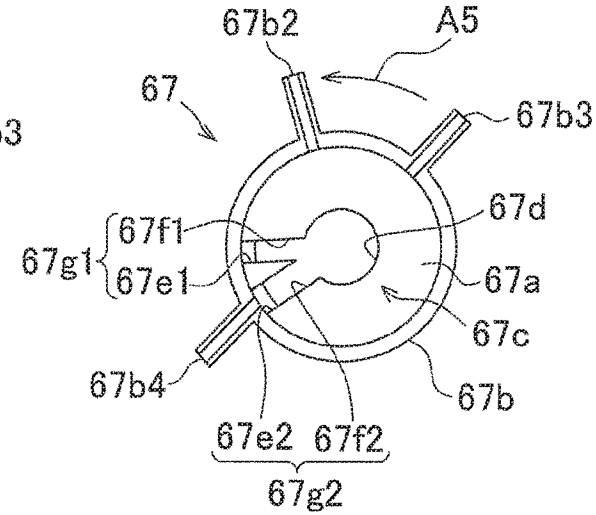

FIG. 34A shows a state in which a switching member of Third Embodiment is positioned to be in a first state, FIG. 34B shows a state in which the switching member is positioned to be in a second state, and FIG. 34C shows a state in which the switching member is positioned to be in a third state.

Figure 35A:
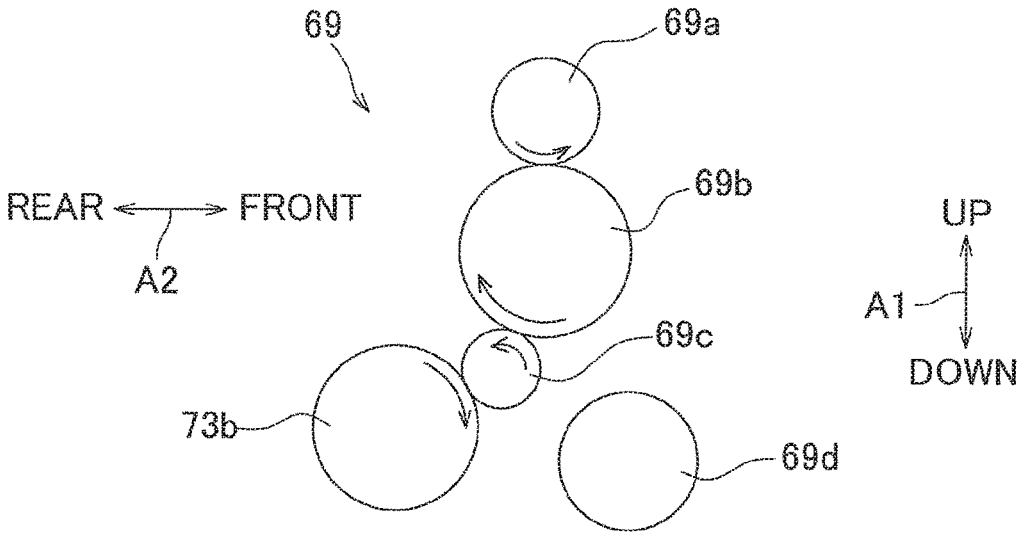
Figure 35B:
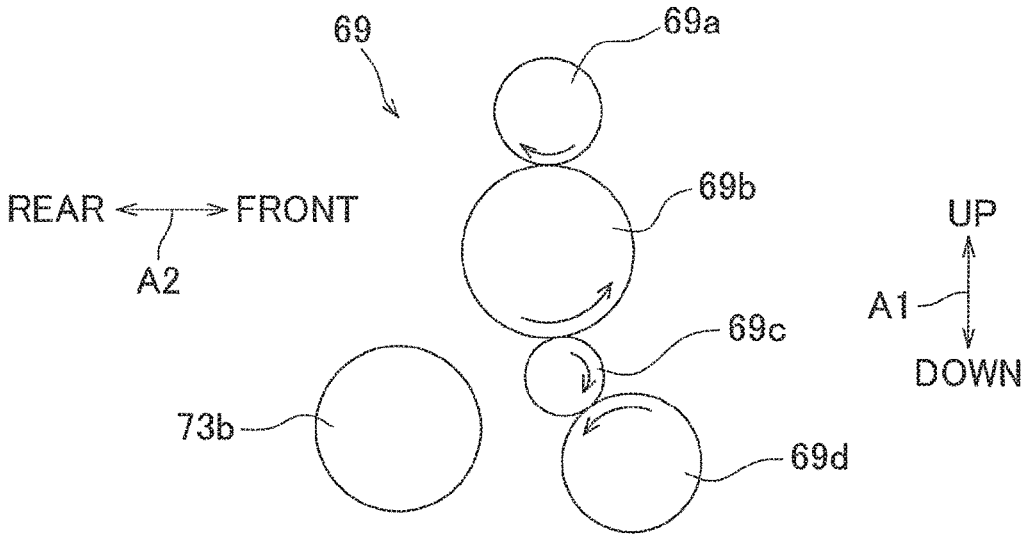

FIG. 35A shows a power transmission state of each gear when a drive motor is driven backward in Third Embodiment, whereas FIG. 35B shows a power transmission state of each gear when the drive motor is driven forward.

Figure 36:
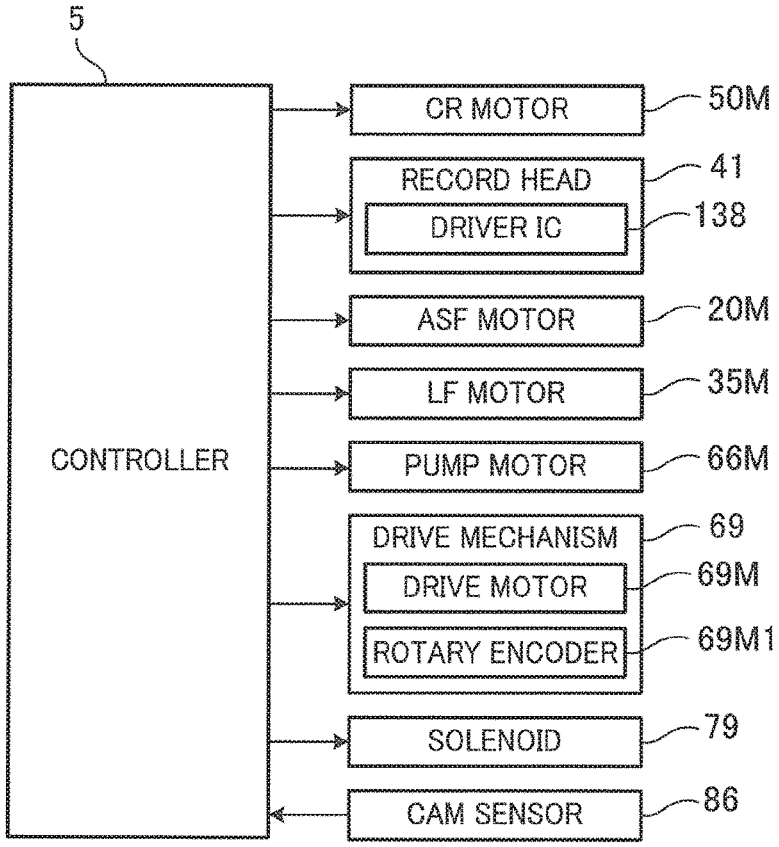

FIG. 36 is a block diagram of a control system of the printer of Third Embodiment.

Figure 37:
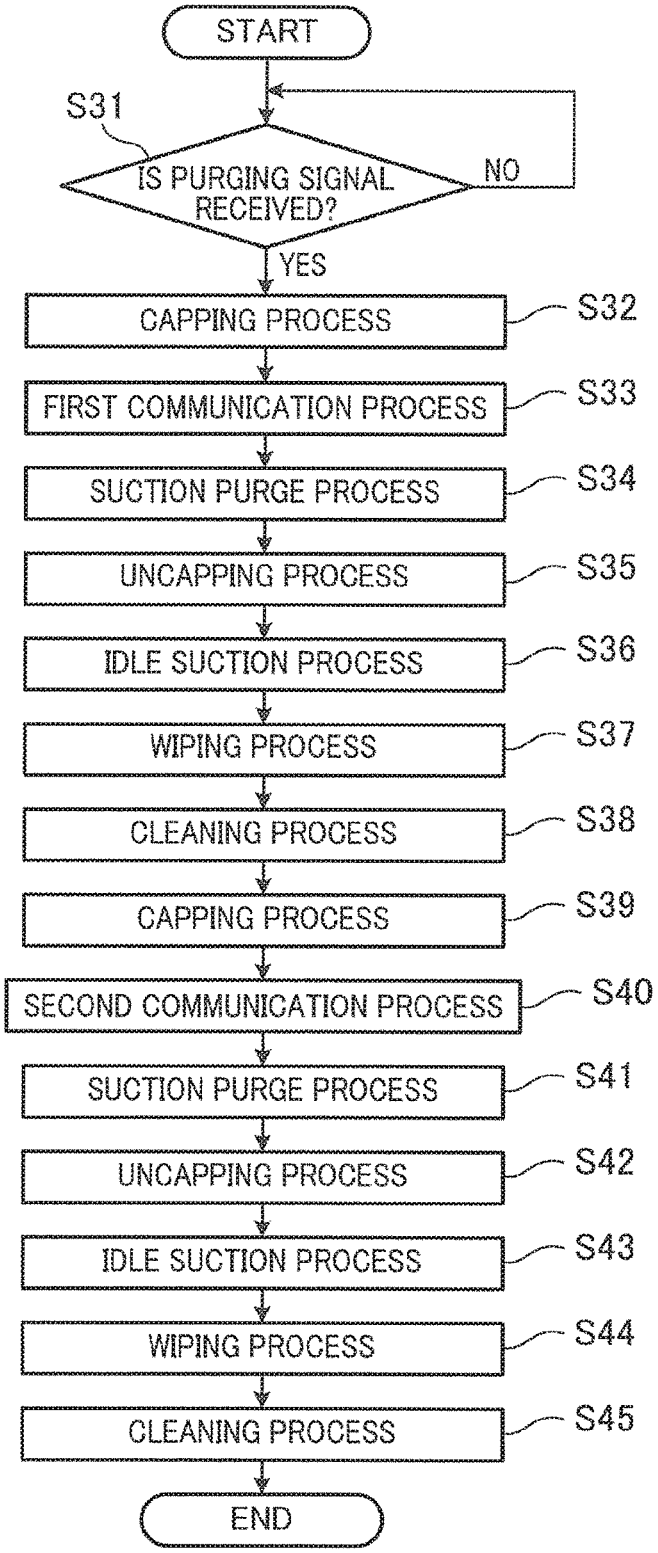

FIG. 37 is a flowchart showing the steps of a purging operation in Third Embodiment.

FIGS. 38A to 38E show operations from the switching of a wiper member of Third Embodiment from a separation position to a wiping position to the return of the wiper member from the wiping position to the separation position after an ejection surface is wiped by a wiper.

Each of FIGS. 39A to 39C shows an operation state of the wiper member in the cleaning process of Third Embodiment.

Each of FIGS. 40A to 40F shows an operation state of the rotational cam in a maintenance operation of Third Embodiment.

Figure 41:
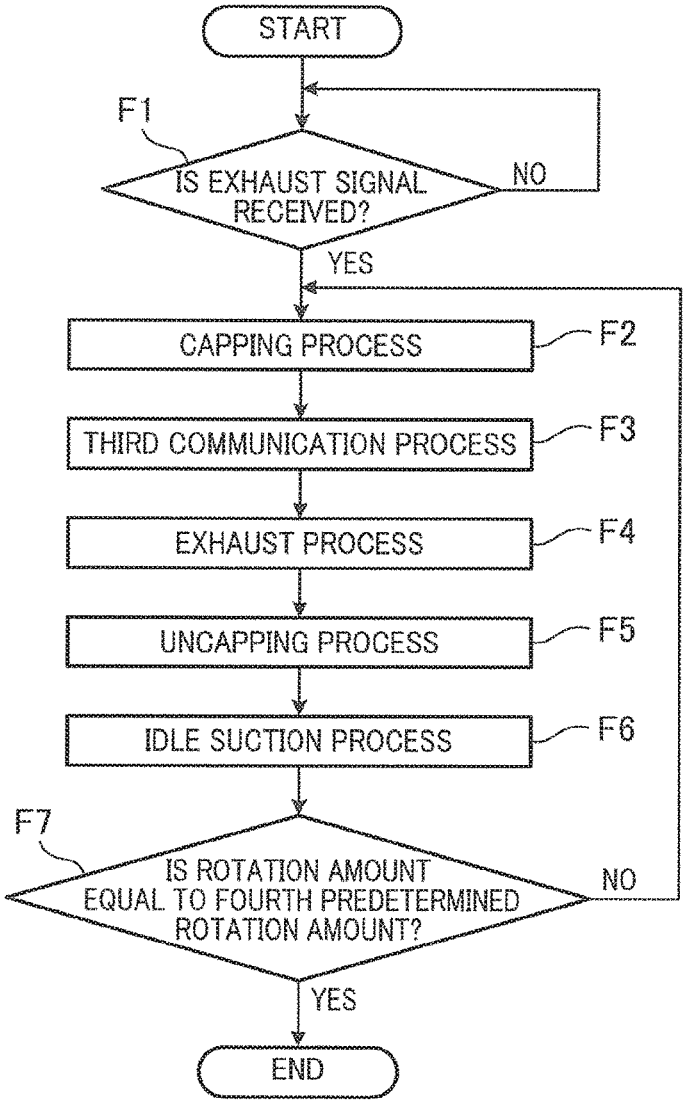

FIG. 41 is a flowchart showing the steps of an exhaust operation of Third Embodiment.

DESCRIPTION OF THE PREFERRED EMBODIMENTS

Figure 1:
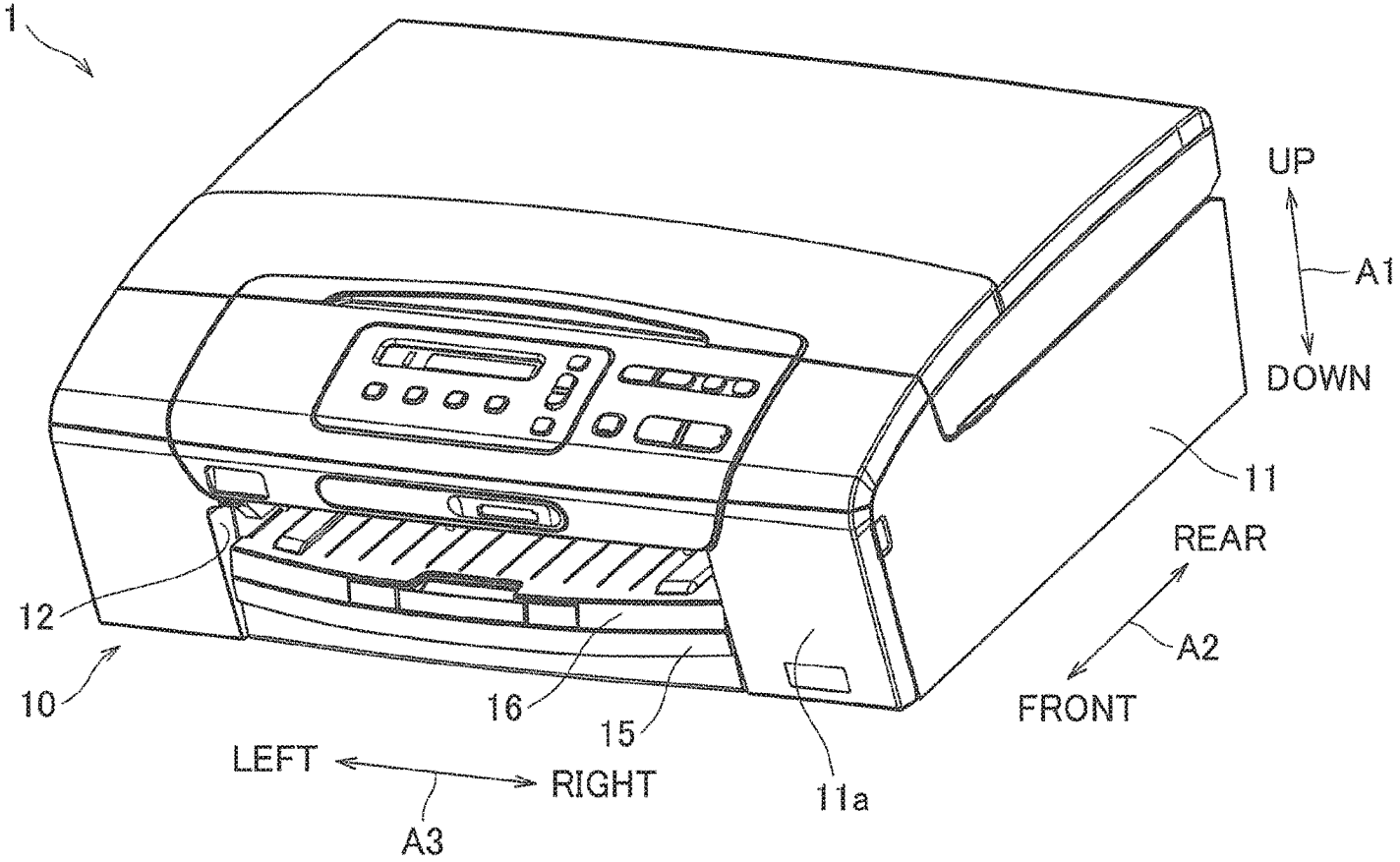
FIG. 1 shows a perspective of a multifunction machine which employs a printer of First Embodiment of the present invention.

To begin with, a multifunction machine 1 which employs a printer of the first aspect of the present invention (First Embodiment) will be described. This multifunction machine 1 is installed as shown in FIG. 1 when used. In the present embodiment, three directions indicated by arrows in FIG. 1 are an up-down direction A1, a front-rear direction A2, and a left-right direction A3. The three directions shown in FIG. 1 are used in other figures, too.

<Outline of Multifunction Machine 1>

As shown in FIG. 1, the multifunction machine 1 is basically a thin rectangular parallelepiped member, and a display, an operation button, and the like are provided on an upper surface of the multifunction machine 1. A printer 10 which is an example of a liquid ejection apparatus of the present invention is provided in a lower part of the multifunction machine 1. The multifunction machine 1 has functions such as a scanning function and a printing function.

The printer 10 includes a housing 11. Substantially at the center of a front wall 11*a* of the housing 11, an opening 12 is formed. A sheet feeding tray 15 and a sheet discharge tray 16 are provided to form upper and lower stages. The sheet feeding tray 15 is configured to be insertable and removable through the opening 12 in the front-rear direction A2, i.e., is attachable to and detachable from the housing 11. A sheet P with a desired size is placed on the sheet feeding tray 15. The multifunction machine 1 is connectable to an external device such as a personal computer (hereinafter, PC), and performs recording based on a recording command from the PC. Furthermore, functions are executed in response to a user's operation of the operation button.

<Internal Structure of Printer 10>

Figure 2:
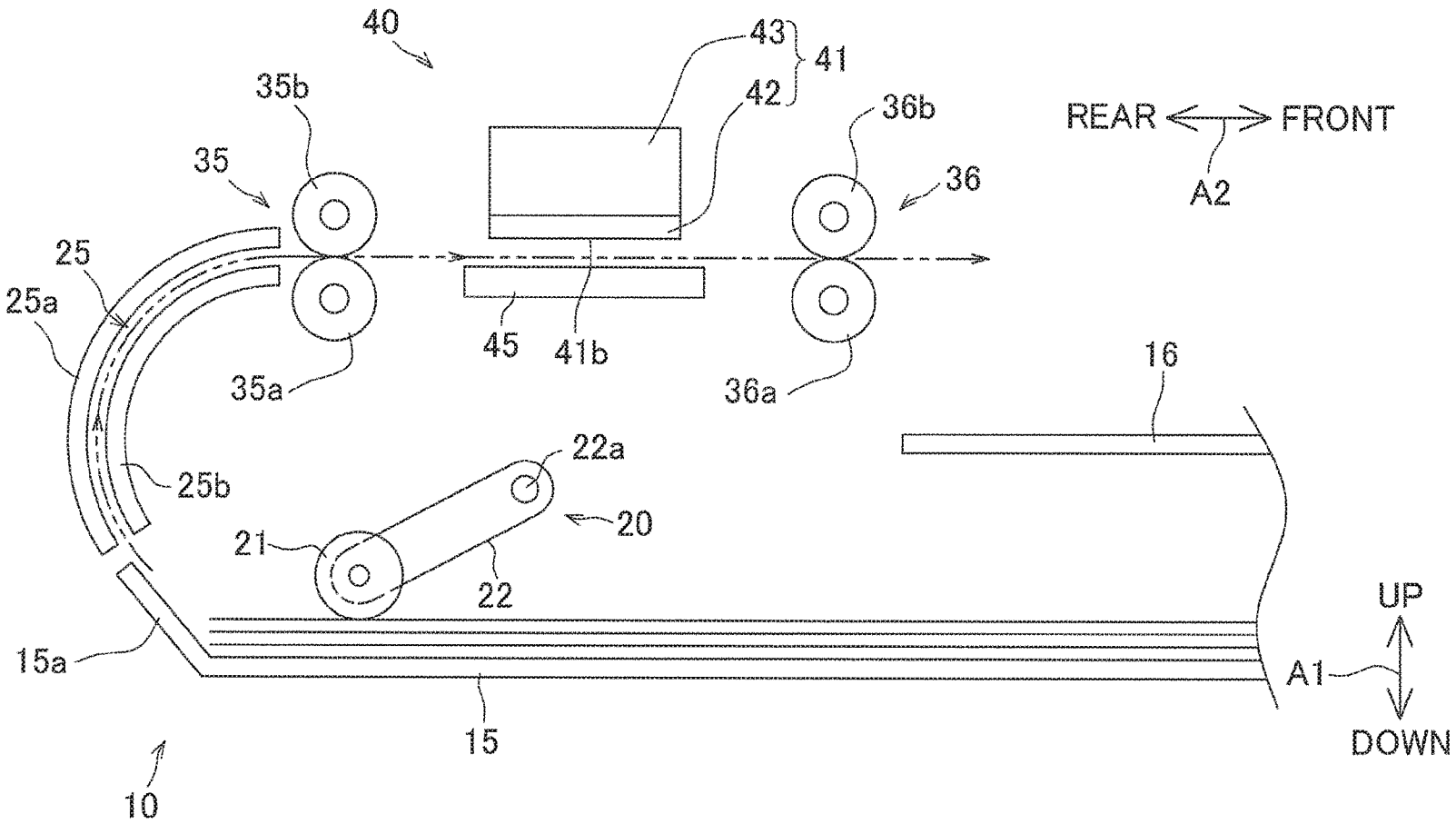
FIG. 2 shows a schematic profile of an internal structure of the printer of First Embodiment.
Figure 3:
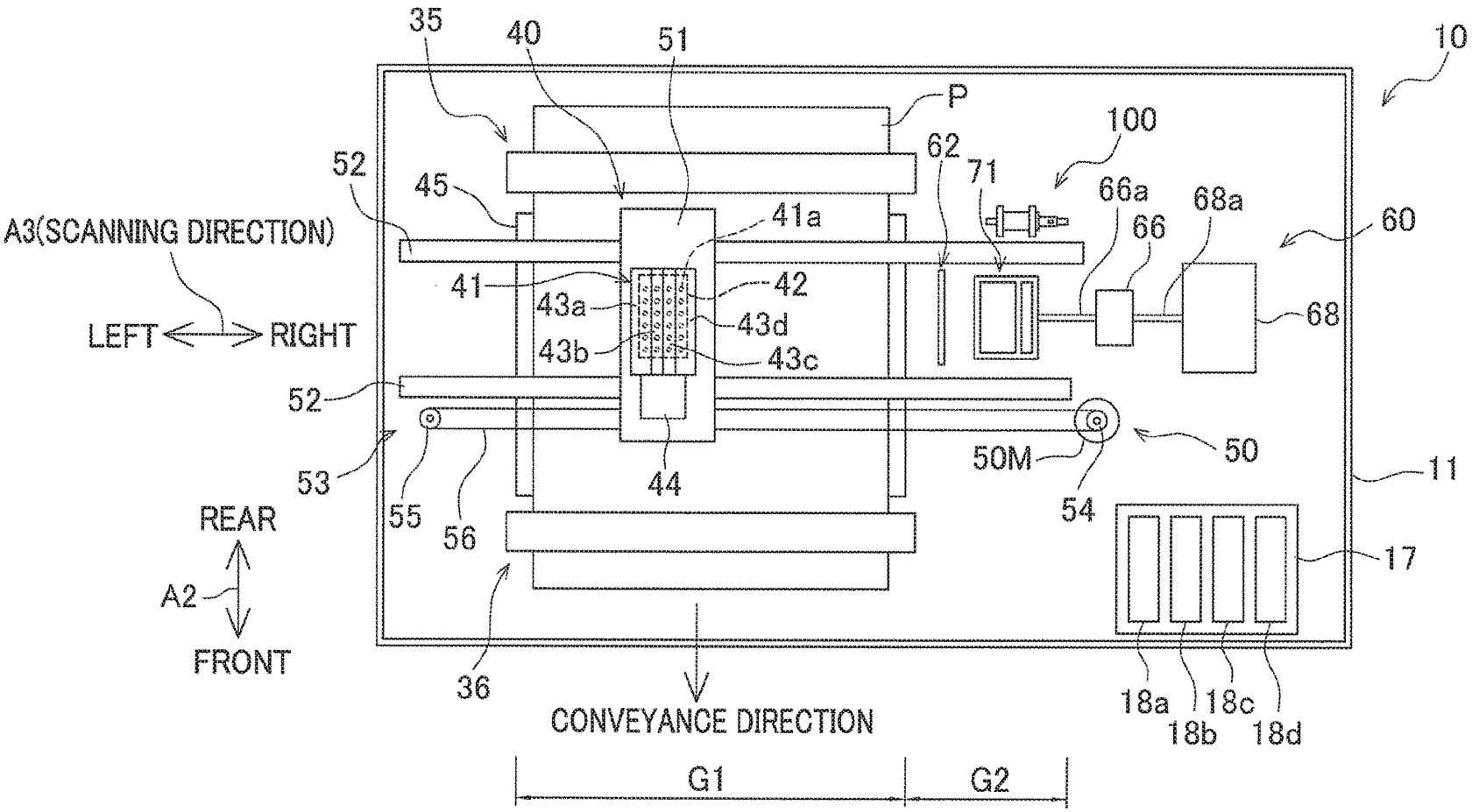
FIG. 3 shows a schematic plan view of the printer of First Embodiment.

Now, the internal structure of the printer 10 will be described. As shown in FIG. 2 and FIG. 3, the printer 10 includes a feeding unit 20, a conveyor roller pair 35, a recording unit 40, a holder 17, a sheet discharge roller pair 36, an ASF (Auto Sheet Feed) motor 20M (see FIG. 13), an LF (Line Feed) motor 35M (see FIG. 13), a maintenance unit 60, and a controller 5 (see FIG. 13). The feeding unit 20 feeds a sheet P placed on the sheet feeding tray 15 to a conveyance passage 25. The conveyor roller pair 35 conveys the sheet P fed by the feeding unit 20 to a recording unit 40. The recording unit 40 is, for example, of an inkjet recording type, and records an image onto the sheet P conveyed by the conveyor roller pair 35. The sheet discharge roller pair 36 discharges, to the sheet discharge tray 16, the sheet P on which the recording is done by the recording unit 40.

As shown in FIG. 3, the holder 17 is provided at a front right part in the housing 11. To the holder 17, four ink cartridges 18*a* to 18*d* storing four-color inks (black, yellow, cyan, and magenta), respectively, are detachably attached.

<Feeding Unit 20>

As shown in FIG. 2, the feeding unit 20 is provided above the sheet feeding tray 15. The feeding unit 20 includes a pickup roller 21 and an arm 22. The pickup roller 21 is pivoted to the leading end of the arm 22. The arm 22 is rotatably supported by a supporting shaft 22*a*, and is biased by a spring or the like to rotate downward so that the pickup roller 21 is in contact with the sheet feeding tray 15. The arm 22 is configured to be able to withdraw upward when the sheet feeding tray 15 is inserted or removed. The pickup roller 21 is rotated as power of the ASF motor 20M is transmitted thereto via a transmission mechanism (not illustrated), so that a sheet P stacked in the sheet feeding tray 15 is fed to the conveyance passage 25.

<Sheet Feeding Tray 15>

As shown in FIG. 2, the sheet feeding tray 15 includes an oblique wall 15*a*. This oblique wall 15*a* guides a sheet P to the conveyance passage 25 when the sheet P in the sheet feeding tray 15 is fed by the pickup roller 21.

<Conveyance Passage 25>

As shown in FIG. 2, the conveyance passage 25 is formed of an outer guide member 25*a* and an inner guide member 25*b* which oppose each other over a predetermined distance. From the rear end of the sheet feeding tray 15, the conveyance passage 25 is curved upward and toward the front side of the printer 10. The sheet P fed from the sheet feeding tray 15 is guided to make U-turn upward from below by the conveyance passage 25, and reaches the recording unit 40.

<Conveyor Roller Pair 35 and Sheet Discharge Roller Pair 36>

The conveyor roller pair 35 includes a conveyor roller 35*a* which is a lower roller and a pinch roller 35*b* which is an upper roller. The conveyor roller 35*a* is rotated as power of the LF motor 35M is transmitted thereto via a transmission mechanism (not illustrated). The pinch roller 35*b* is rotated by the rotation of the conveyor roller 35*a*. The conveyor roller 35*a* and the pinch roller 35*b* sandwich a sheet P in the up-down direction A1 in a synchronized manner, and convey the sheet P to the recording unit 40.

The sheet discharge roller pair 36 includes a sheet discharge roller 36*a* which is a lower roller and a spur roller 36*b* which is an upper roller. The sheet discharge roller 36*a* is rotated as power of the LF motor 35M is transmitted thereto via a transmission mechanism (not illustrated). The spur roller 36*b* is rotated by the rotation of the sheet discharge roller 36*a*. The sheet discharge roller 36*a* and the spur roller 36*b* sandwich a sheet P in the up-down direction A1 in a synchronized manner, and convey the sheet P to the sheet discharge tray 16.

<Recording Unit 40>

As shown in FIG. 2 and FIG. 3, the recording unit 40 includes a record head 41 (liquid ejection head), a head-moving mechanism 50, and a platen 45. The head-moving mechanism 50 includes a carriage 51. The carriage 51 is configured to reciprocate in a scanning direction (which is identical with the left-right direction A3 and is orthogonal to the conveyance direction of the sheets P). The record head 41 is supported by the carriage 51.

The record head 41 includes a head main body 42 and four sub-tanks 43*a* to 43*d*. The lower surface of the head main body 42 is an ejection surface 41*b* in which a plurality of ejection openings 41*a* are formed to eject ink to a sheet P conveyed to a position below the record head 41. As shown in FIG. 3, the ejection openings 41*a* are arranged so that four ejection opening rows, in each of which ejection openings are lined up in the conveyance direction, are lined up in the scanning direction. In the present embodiment, black ink is ejected from ejection openings 41*a* of the rightmost ejection opening row in FIG. 3, whereas color inks (magenta, cyan, and yellow) are ejected from ejection openings 41*a* of the other three ejection opening row s. Under the control of the controller 5 based on a recording command, the head main body 42 ejects inks of the respective colors from the ejection openings 41*a* as minute ink droplets.

The four sub-tanks 43*a* to 43*d* are lined up along the scanning direction. The sub-tanks 43*a* to 43*d* are integrated with a tube joint 44. Via four flexible tubes (not illustrated) connected with the tube joint 44, the sub-tanks 43*a* to 43*d* are connected with ink cartridges 18*a* to 18*d*, respectively. The sub-tanks 43*a* to 43*d* supply inks of the respective colors to the head main body 42.

Below the record head 41, a platen 45 is provided to support a sheet P conveyed by the conveyor roller pair 35. The platen 45 is provided at a part in the reciprocating range of the carriage 51, where a sheet P passes. Because the platen 45 is sufficiently wider than the maximum width of a conveyable sheet P, the sheet P conveyed in the conveyance passage 25 always passes the platen 45. The region on the platen 45 is an image recording region G1.

As shown in FIG. 3, the head-moving mechanism 50 includes paired guide rails 52 and a belt transmission mechanism 53. The paired guide rails 52 are provided to be separated from each other in the front-rear direction A2 and extend in the left-right direction A3 to be in parallel with each other. The carriage 51 is provided over the paired guide rails 52 and reciprocates along the left-right direction A3 on the paired guide rails 52.

The belt transmission mechanism 53 includes two pulleys 54 and 55, an endless timing belt 56, and a CR motor 50M. The two pulleys 54 and 55 are provided to be separated from each other in the left-right direction A3 and the timing belt 56 is stretched over these two pulleys. The pulley 54 is connected with a driving shaft of the CR motor 50M. As the CR motor 50M is driven, the timing belt 56 moves and the record head 41 moves in the scanning direction together with the carriage 51.

Under the control of the controller 5 based on a recording command, the record head 41 ejects inks of the respective colors thorough the ejection openings 41*a*. In other words, as the carriage 51 reciprocates in the left-right direction A3, the record head 41 scans the sheet P, and as the ejection openings 41*a* eject inks of the respective colors, an image is recorded on the sheet P conveyed on the platen 45. In the printer 10, a linear encoder (not illustrated) including light transmitting parts (slits) lined up in the scanning direction at intervals is provided. In the meanwhile, in the carriage 51, a transparent position sensor (not illustrated) including a light emitting element and a light receiving element is provided. The printer 10 is able to recognize a current position of the carriage 51 in the scanning direction based on an enumerated value of the light transmitting parts of the linear encoder detected by the position sensor during the movement of the carriage 51, and the rotational driving of the CR motor 50M is controlled based on the recognized position.

<Maintenance Unit 60>

Now, the maintenance unit 60 will be described with reference to FIG. 3 to FIG. 10C. The maintenance unit 60 prevents the ink in the ejection openings 41*a* formed in the ejection surface 41*b* from drying and removes bubbles and foreign matters in the record head 41. As shown in FIG. 3, the maintenance unit 60 is provided to the right of the platen 45. To be more specific, the maintenance unit 60 is provided in a maintenance region G2 which is to the right of the image recording region G1. The maintenance unit 60 includes a capping mechanism 61, a wiper member 62, a cleaning member 63, a moving mechanism 64, a maintenance frame 65, a suction pump 66, a switching mechanism 67, and a waste liquid tank 68.

The maintenance frame 65 includes a bottom plate 65*a* and a main body 65*b*. The main body 65*b* is provided at a left end of the bottom plate 65*a*. The bottom plate 65*a* supports the capping mechanism 61 from below. The main body 65*b* supports the wiper member 62 and the cleaning member 63. The main body 65*b* includes guide grooves 65*b*1 each of which extends in the up-down direction A1.

Figure 4:
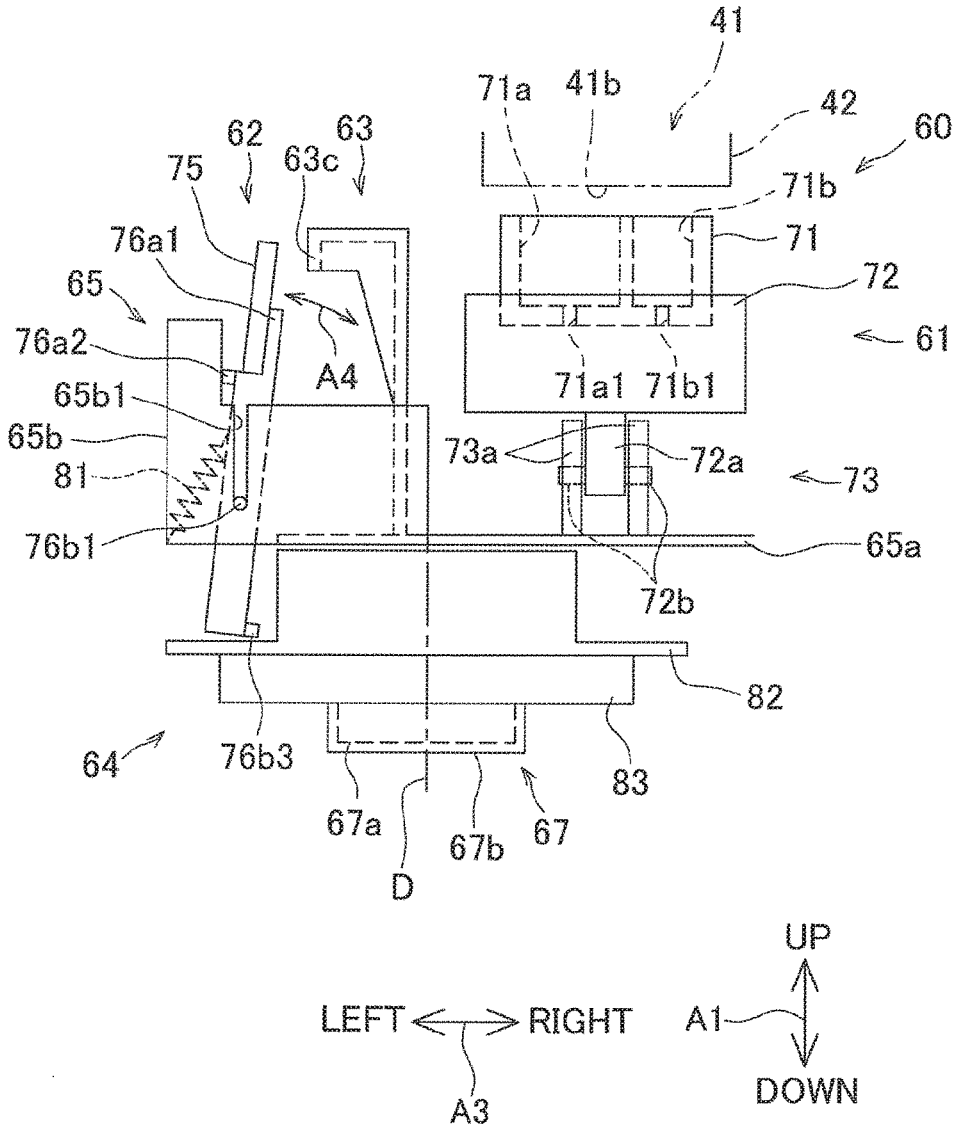
FIG. 4 is a schematic profile of a maintenance unit in the printer of First Embodiment.

As shown in FIG. 3 to FIG. 5B, the capping mechanism 61 includes a suction cap 71, a cap holder 72 supporting the suction cap 71, and a cap elevation mechanism 73 which moves up and down the cap holder 72. As shown in FIG. 4, the suction cap 71 is made of a flexible material such as rubber and synthetic resin, and is partitioned into two recesses 71*a* and 71*b*. The suction cap 71 includes two connection holes 71*a*1 and 71*b*1 which are formed at the bottoms of the respective recesses 71*a* and 71*b*. As indicated by two-dot chain lines in FIG. 4, when the record head 41 (carriage 51) reaches a maintenance position, the suction cap 71 opposes the ejection surface 41*b*. The maintenance position is a downstream position where the record head 41 is on the downstream of the wiper member 62 relative to a wiping direction in which a later-described wiper 75 wipes the ejection surface 41*b*. As the cap holder 72 is moved up by the cap elevation mechanism 73 in this state, the suction cap 71 becomes closely in contact with the ejection surface 41*b* and covers the ejection openings 41*a*. At this stage, a region of the ejection surface 41*b* where the ejection openings 41*a* from which inks of three colors are ejected is covered with the recess 71*a*, with the result that a closed space K1 is formed in the recess 71*a* (see FIG. 15A). Furthermore, a region in the ejection surface 41*b* where the ejection openings 41*a* from which black ink is ejected is covered with the recess 71*b*, with the result that a closed space K2 is formed in the recess 71*b* (see FIG. 15A).

The cap holder 72 supports the suction cap 71 from below. On the lower surface of the cap holder 72, a plate-shaped protrusion 72*a* is formed to protrude downward. At the leading end of the protrusion 72*a*, paired protrusions 72*b* are formed to protrude in the left-right direction A3. Each of the paired protrusions 72*b* is columnar in shape.

Figure 5A:
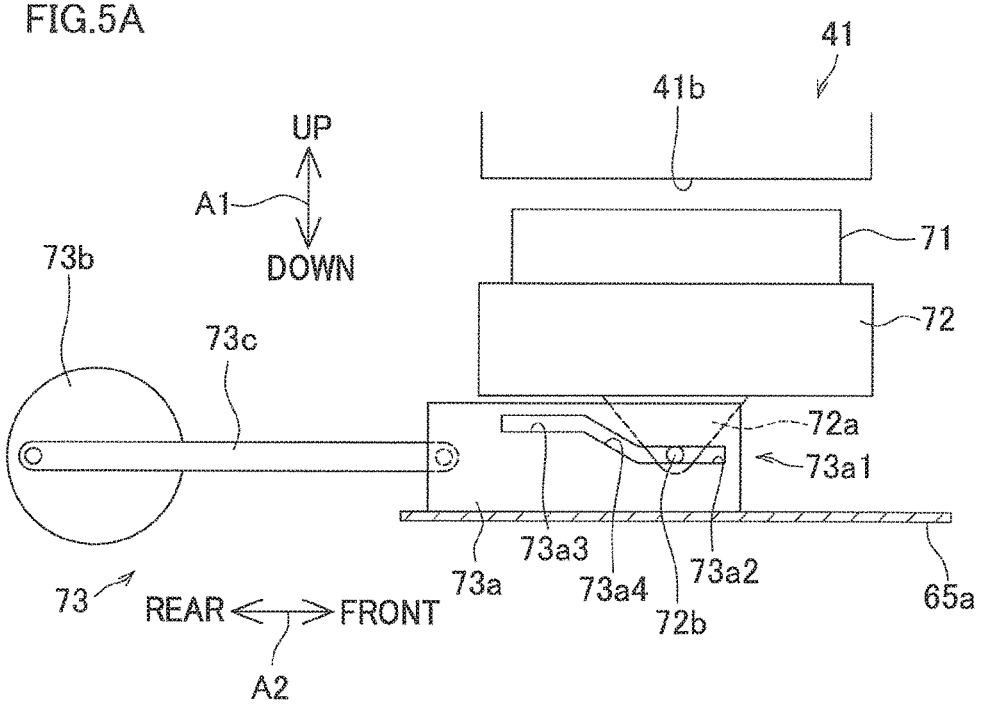
Figure 5B:
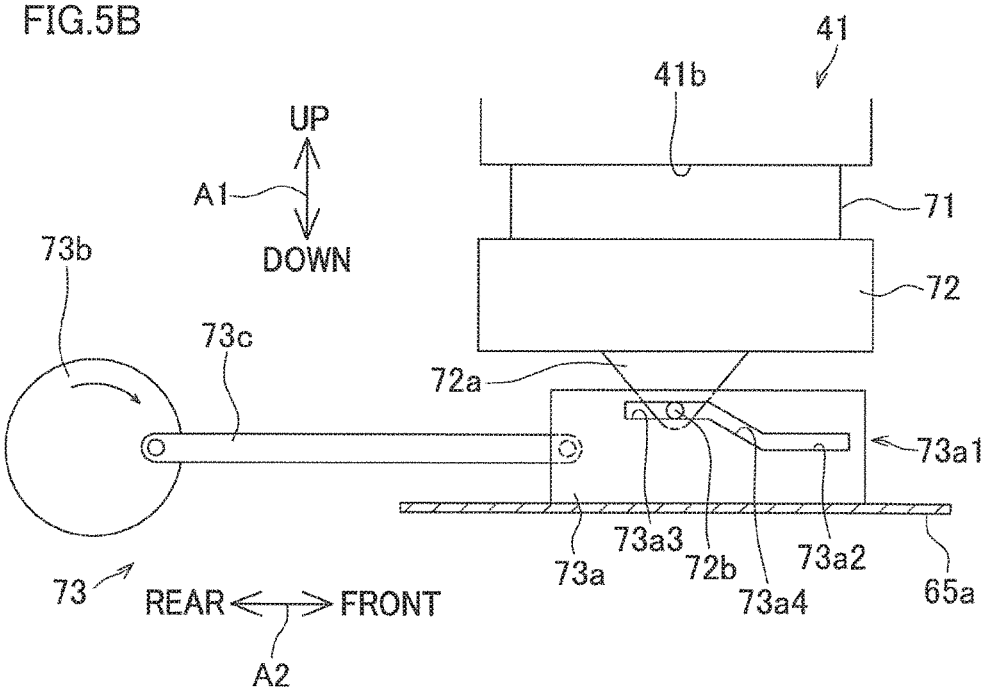
FIG. 5B shows a state in which the suction cap is at an abutting position.

As shown in FIG. 4, FIG. 5A and FIG. 5B, the cap elevation mechanism 73 includes paired slide cams 73*a*, a gear 73*b*, and a link 73*c* connecting the gear 73*b* with the slide cams 73*a*. The paired slide cams 73*a* are formed of plate-shaped components and are provided to sandwich the protrusion 72*a* in the left-right direction A3. The paired slide cams 73*a* are connected with each other by a connection member (not illustrated) which extends in the left-right direction A2. The paired slide cams 73*a* are arranged to protrude from the bottom plate 65*a* of the maintenance frame 65 to be slidable in the front-rear direction A2. In each slide cam 73*a*, a guide hole 73*a*1 in which the protrusion 72*b* may be inserted is formed to penetrate the slide cam 73*a* in the left-right direction A3. The guide hole 73*a*1 includes a front part 73*a*2, a rear part 73*a*3, and a connecting part 73*a*4 which connects the front part 73*a*2 with the rear part 73*a*3. Both of the front part 73*a*2 and the rear part 73*a*3 horizontally extend in the front-rear direction A2. The front part 73*a*2 is provided below the rear part 73*a*3. With this arrangement, the connecting part 73*a*4 extends obliquely.

As shown in FIG. 5A, when the slide cam 73*a* is at a position on a rear side, the protrusion 72*b* is positioned at the front part 73*a*2 and the cap holder 72 is provided at a position closest to the bottom plate 65*a* of the maintenance frame 65. In this state, the suction cap 71 is provided at a separated position of being separated from the ejection surface 41*b* of the record head 41 provided at the maintenance position. As the gear 73*b* rotates clockwise as shown in FIG. 5A and FIG. 5B for 180 degrees from a position shown in FIG. 5A to a position shown in FIG. 5B, the paired slide cams 73*a* connected with the link 73*c* move frontward. At the same time, the protrusion 72*b* is guided upward by the connecting part 73*a*4 and reaches the rear part 73*a*3. As the slide cam 73*a* is moved to a position on a front side in this way, the protrusion 72*b* is provided at the rear part 73*a*3 and the cap holder 72 is provided at a position furthest from the bottom plate 65*a* of the maintenance frame 65. In this state, the suction cap 71 is provided at an abutting position so as to be capable of contacting with the ejection surface 41*b* of the record head 41 at the maintenance position. In this way, as the gear 73*b* rotates, the cap elevation mechanism 73 moves the suction cap 71 between the abutting position and the separated position. The position of the slide cam 73*a* relative to the front-rear direction A2 is detectable based on the rotation amount of the ASF motor 20M which drives the gear 73*b*. On this account, as the position of the slide cam 73*a* relative to the front-rear direction A2 is controlled, the position (the separated position or the abutting position) of the suction cap 71 is controlled.

Figure 6A:
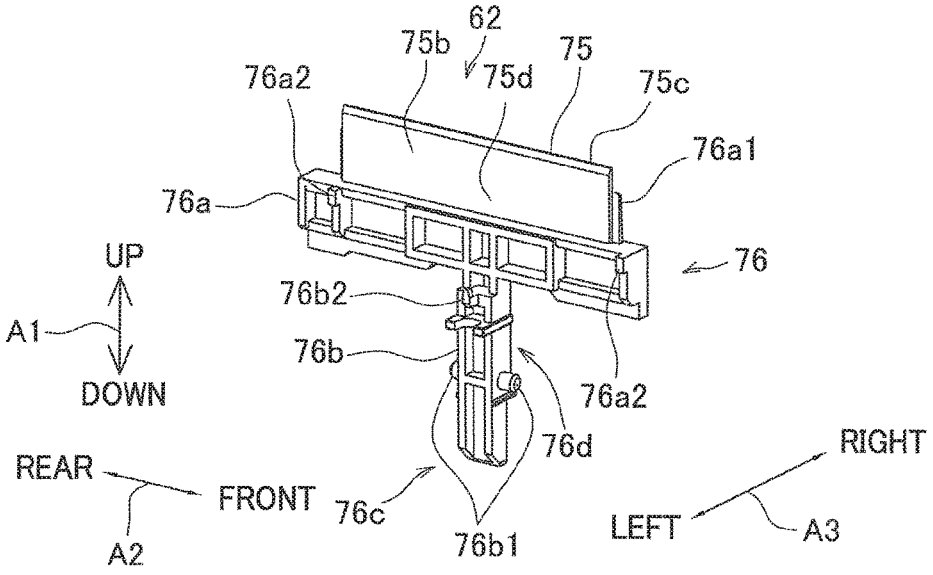
FIG. 6B shows a perspective of a wiper member of First Embodiment.
Figure 6B:
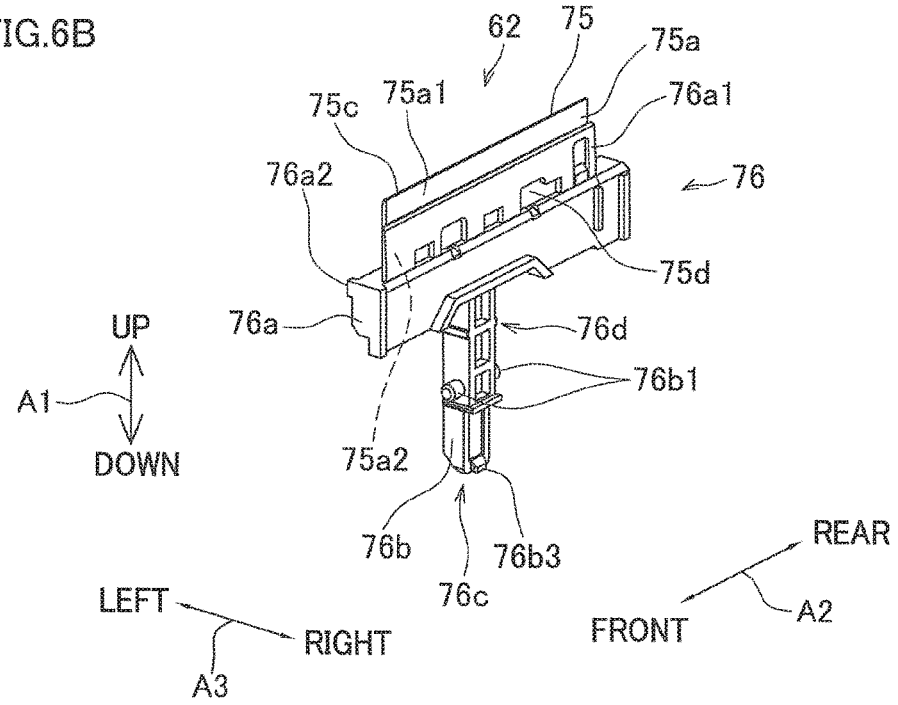

As shown in FIG. 6A and FIG. 6B, the wiper member 62 includes a wiper 75 and a wiper holder 76 supporting the wiper 75. The wiper 75 is made of a flexible material such as rubber and synthetic resin, and is a plate-shaped member including a right side surface 75*a* and a left side surface 75*b*. The wiper 75 is formed to be longer than the ejection surface 41*b* in the front-rear direction A2. The wiper 75 includes a leading end part 75*c* (a leading end of the wiper member 62) for wiping the ejection surface 41*b* and a supporting part 75*d* supporting the leading end part 75*c*. The right side surface 75*a* is divided into an upper side surface 75*a*1 at the leading end part 75*c* and a lower side surface 75*a*2 at the supporting part 75*d*. The upper side surface 75*a*1 functions as a wiping surface when the ejection surface 41*b* is wiped. The lower side surface 75*a*2 is an opposing surface opposing a later-described contact plate 76*a*1.

The wiper holder 76 includes a horizontal portion 76*a* which extends in the front-rear direction A2 and a vertical portion 76*b* which extends in the up-down direction A1. The horizontal portion 76*a* is longer than the wiper 75 in the front-rear direction A2. The vertical portion 76*b* extends downward from the center in the front-rear direction A2 of the horizontal portion 76*a*, and hence the wiper holder 76 is substantially T-shaped.

The horizontal portion 76*a* supports the supporting part 75*d* of the wiper 75, which protrudes from the upper surface of the horizontal portion 76*a*. The horizontal portion 76*a* includes a contact plate 76*a*1 which is provided to the right of the wiper 75. The contact plate 76*a*1 is longer than the wiper 75 in the front-rear direction A2 and opposes the lower side surface 75*a*2 of the wiper 75. The contact plate 76*a*1 is provided to be in contact with the lower side surface 75*a*2. As described later, the contact plate 76*a*1 restrains the bending of the wiper 75 when the record head 41 moves leftward as described below while being in contact with the left side surface 75*b* at the leading end part 75*c* of the wiper 75, so as to facilitate the later-described movement of the wiper member 62 from the wiping position to the separation position.

As shown in FIG. 6A, the horizontal portion 76*a* is provided with paired protrusions 76*a*2 which protrude leftward and rightward, respectively. The paired protrusions 76*a*2 are separated from each other in the front-rear direction A2. The paired protrusions 76*a*2 is engaged with the main body 65*b* of the maintenance frame 65 to retain the wiper member 62 at the wiping position, when the wiper member 62 is moved to the wiping position as described later. The paired protrusions 76*a*2 and the main body 65*b* constitute an engagement maintenance member of the present invention.

The vertical portion 76*b* is provided with paired protrusions 76*b*1 which protrude in the front-rear direction A2 from a substantial center in the up-down direction A1 of the vertical portion 76*b*. Each of the paired protrusions 76*b*1 is columnar in shape. As shown in FIG. 4, the wiper holder 76 is provided to penetrate the main body 65*b* in the up-down direction A1, and the paired protrusions 76*b*1 are provided in the guide groove 65*b*1 of the maintenance frame 65. With this, when the wiper member 62 (wiper holder 76) is at a position shown in FIG. 4, i.e., at the separation position where the lower end of the guide groove 65*b*1 is in contact with the protrusions 76*b*1, the wiper member 62 is supported by the guide groove 65*b*1 to be swingable in the direction indicated by the arrow A4 about the protrusions 76*b*1. The paired protrusions 76*b*1 constitute a swing axis of the wiper member 62 (wiper holder 76). The movement of the wiper member 62 (wiper holder 76) in the up-down direction A1 is guided by the guide groove 65*b*1.

A hook 76*b*2 is formed at an upper end 76*d* of the vertical portion 76*b*. The hook 76*b*2 is provided above the paired protrusions 76*b*1. To the hook 76*b*2, one end of a later-described spring 81 is attached. At a lower end 76*c* of the vertical portion 76*b* (i.e., a proximal end which is on the side opposite to the leading end part 75*c* of the wiper member 62 in the up-down direction A1), as shown in FIG. 6B, a protrusion 76*b*3 is formed to protrude rightward from the right side surface.

As shown in FIG. 4, the moving mechanism 64 includes a spring 81, a rotational cam 82, and a gear 83 provided below the rotational cam 82. The gear 83 is connected with the rotational cam 82 in an integral manner. As the gear 83 rotates, the rotational cam 82 rotates in the same direction. The spring 81 is attached to the hook 76*b*2 at one end (upper end), and is attached to the lower left end of the main body 65*b* of the maintenance frame 65 at the other end (lower end). The lower left end is to the left of and below the guide groove 65*b*1. On this account, the spring 81 biases the wiper member 62 (wiper holder 76) obliquely leftward and downward. When the wiper member 62 (wiper holder 76) is at the separation position, the spring 81 biases the wiper member 62 (wiper holder 76) in a direction in which the upper end of the wiper member 62 (the leading end part 75*c* of the wiper 75) rotates rightward and the lower end of the wiper member 62 rotates leftward about the paired protrusions 76*b*1. Therefore, when at the separation position, the wiper member 62 (wiper holder 76) is positioned while the paired protrusions 76*a*2 are in contact with the main body 65*b* of the maintenance frame 65.

Figure 7A:
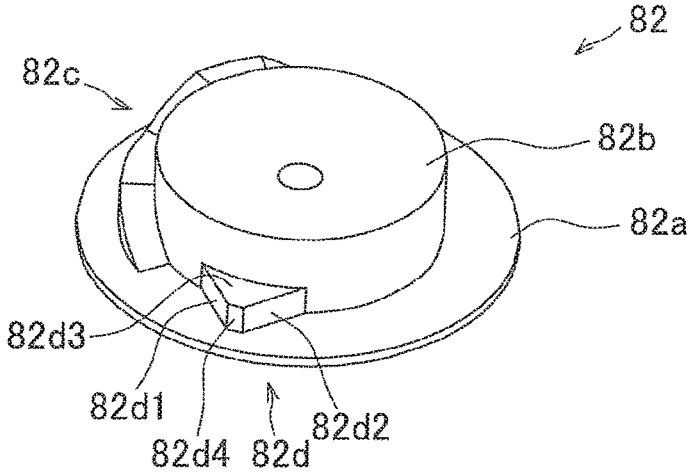
Figure 7B:
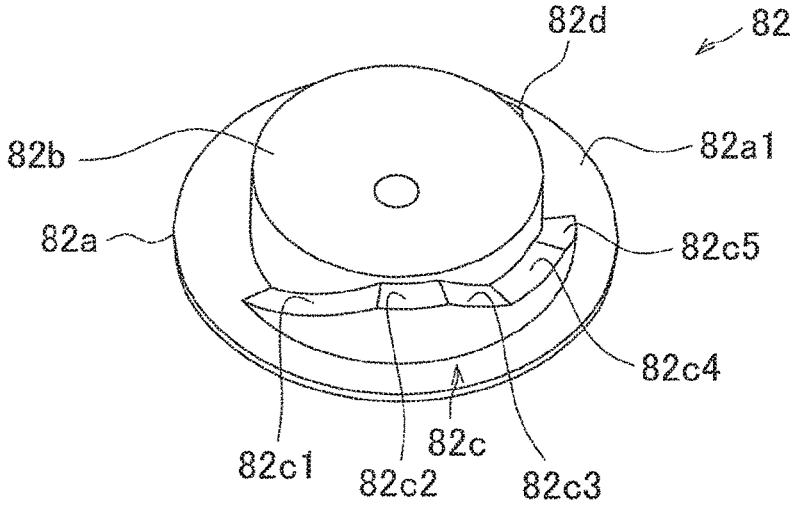
Figure 7C:
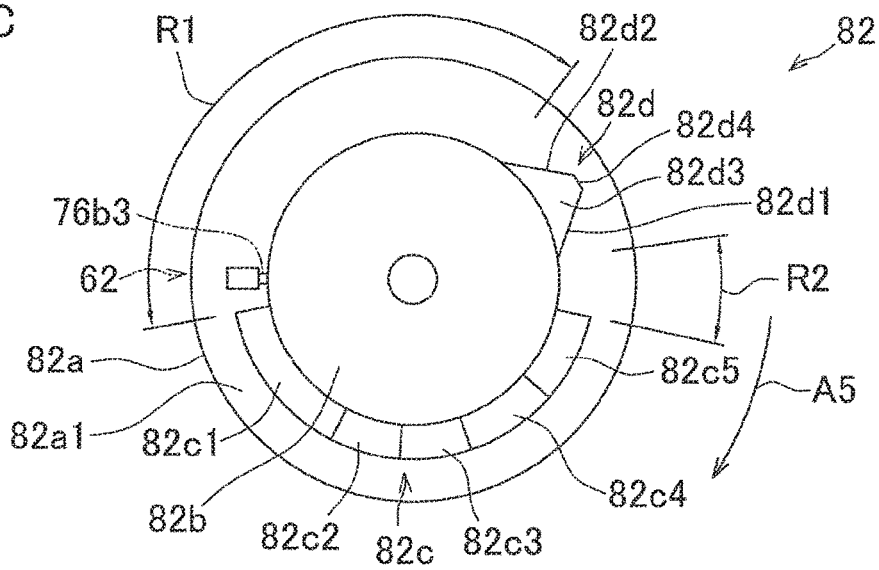
FIG. 7C shows a plan view of the rotational cam.

As shown in FIGS. 7A to 7C, the rotational cam 82 includes a disc 82*a* and a column 82*b* which protrudes upward from the center of the disc 82*a*. The rotational cam 82 is supported by the maintenance frame 65 to be rotatable about a rotation shaft D (see FIG. 4) which extends along the up-down direction A1. As the power of an AFS motor 20M is transferred to the gear 83, the rotational cam 82 rotates. The rotational cam 82 rotates only in a rotational direction indicated by the arrow A5 in FIGS. 7A to 7C, as described below.

The rotational cam 82 includes a protruding part 82*c* and a contact part 82*d*. The protruding part 82*c* and the contact part 82*d* are separated from each other in a rotational direction A5 (clockwise direction in FIG. 7C). As shown in FIG. 7C, the rotational cam 82 includes a first region R1 and a second region R2 which are separated from each other relative to the rotational direction A5 by the contact part 82*d* and the protruding part 82*c*. Furthermore, the protruding part 82*c* and the contact part 82*d* are formed on the upper surface 82*a*1 of the disc 82*a* and the side surface of the column 82*b* to overlap each other in the rotational direction A5. On the rotation track of the protruding part 82*c* and the contact part 82*d*, as indicated by a two-dot chain line in FIG. 7C, the lower end (proximal end) 76 of the wiper member 62 (wiper holder 76) at the separation position is positioned. When the wiper member 62 is at the separation position, the lower end 76*c* is provided to oppose the upper surface 82*a*1 and is overlapped with the protruding part 82*c* and the contact part 82*d* in the rotational direction A5. When the rotational cam 82 rotates in the rotational direction A5 from the position shown in FIG. 7C, the protruding part 82*c*, the second region R2, the contact part 82*d*, and the first region R1 are moved one by one to a position corresponding to the wiper member at the separation position in this order.

The protruding part 82*c* protrudes upward from the upper surface 82*a*1 and is formed to be longer than the contact part 82*d* in the rotational direction A5. The upper surface of the protruding part 82*c* is constituted by faces 82*c*1 to 82*c*5 which are different from one another in the tilt angle along the rotational direction A5. Among the faces 82*c*1 to 82*c*5, the face 82*c*2 is the uppermost from the upper surface 82*a*1 of the disc 82*a*. When the wiper member 62 (wiper holder 76) is at the separation position, the lower surface of the lower end 76*c* contacts with the face 82*c*1 and the wiper member 62 (wiper holder 76) is pushed upward as the rotational cam 82 rotates in the rotational direction A5. As the rotation of the rotational cam 82 advances, the lower surface of the lower end 76*c* contacts with the face 82*c*2. In this state, the wiper member 62 (wiper holder 76) is at the wiping position (see FIG. 15B). The moving mechanism 64 forms a part of a wiper moving mechanism for moving the wiper to the wiping position.

The wiping position is a position where the leading end part 75*c* is above the ejection surface 41*b* in the up-down direction A1 (i.e., a position where the leading end part 75*c* is capable of contacting with the ejection surface 41*b*). The separation position is a position where the leading end part 75*c* is below the ejection surface 41*b* in the up-down direction A1.

Figures 15A, 15B, 15C, 15D, 15E:
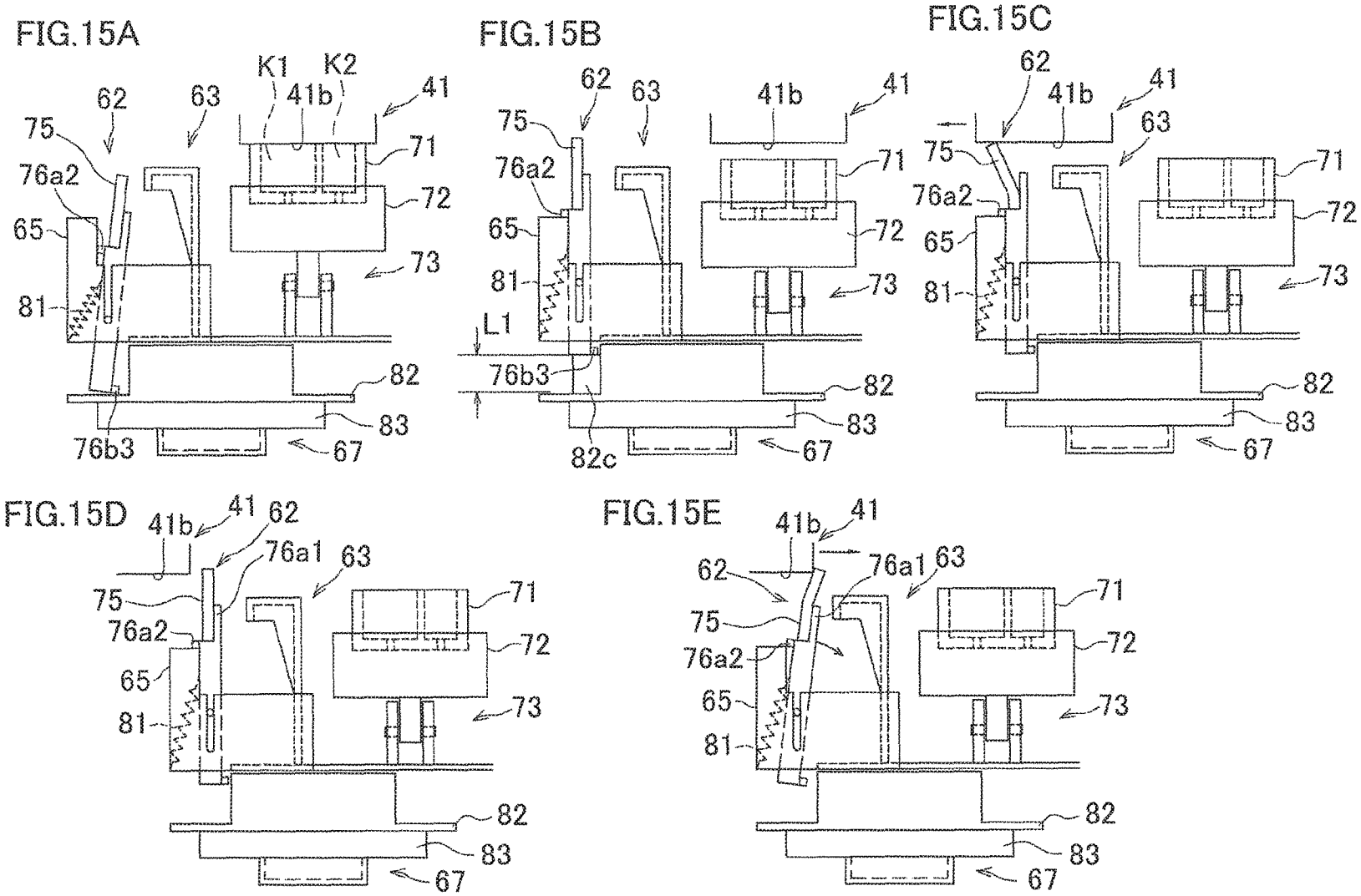
FIGS. 15A to 15E show operations from the switching of a wiper member of First Embodiment from a separation position to a wiping position to the return of the wiper member from the wiping position to the separation position after an ejection surface is wiped by a wiper.

The moving distance of the wiper member 62 between the wiping position and the separation position is a first distance L1 (predetermined distance) in the up-down direction A1 (i.e., an intersecting direction intersecting with the ejection surface 41*b*) (see FIG. 15B). The contact part 82*d* is not overlapped in the up-down direction A1 with the wiper member 62 at the wiping position (see FIG. 15B) but is overlapped in the up-down direction A1 with the wiper member 62 at the separation position by a second distance L2 (<the first distance L1) (see FIG. 16B). The contact part 82*d* is distant from the wiper holder 76 in the up-down direction A1 when the wiper member 62 is positioned at the wiping position. The contact part 82*d* is overlapped with a moving range of the wiper holder 76 in the intersecting direction by moving the wiper member 62 by the first distance L1 in the up-down direction A1. The contact part 82*d* has a length (corresponding to the second distance L2) which is shorter than the moving range (corresponding to the first distance L1) in the intersecting direction.

The contact part 82*d* includes two side surfaces 82*d*1 and 82*d*2 protruding in the up-down direction A1 and a horizontal upper surface 82*d*3. The upper surface 82*d*3 of the contact part 82*d* is below the face 82*c*2. In other words, the contact part 82*d* is lower in height than the contact part 82*c* in terms of the height from the disc 82*a*. On this account, the wiper holder 76 and the contact part 82*d* do not contact with each other even if the rotational cam 82 rotates while the wiper member 62 is at the wiping position. To put it differently, the contact part 82*d* is shaped in such a way that the contact part 82*d* is farther in the up-down direction A1 from the leading end part 75*c* of the wiper member 62 than from the lower end 76*c* of the wiper member 62 in the wiping position and is able to be in contact with the lower end 76*c* of the wiper member 62 at the separation position. The side surface 82*d*1 is a slope which is inclined so that the separation distance from the rotation shaft D decreases in the rotational direction A5. In the meanwhile, the side surface 82*d*2 is a slope which is inclined so that the separation distance from the rotation shaft D increases in the rotational direction A5. The contact part 82*d* includes a top face 82*d*4 which connects the two side surfaces 82*d*1 and 8*d*2 with each other and is more distant from the rotation shaft D than the two side surfaces 82*d*1 and 82*d*2 is from the rotation shaft D. When the wiper member 62 is at the separation position, the lower end 76*c* and the side surface 82*d*1 are in contact with each other as the rotational cam 82 rotates in the rotational direction A5 while the lower end 76*c* is provided in the second region R2 (see FIG. 16A and FIG. 17D). As the rotational cam 82 rotates and the lower end 76*c* and the top face 82*d*4 are in contact with each other, the wiper member 62 moves from a first position to a second position (see FIG. 16C and FIG. 17F) against the biasing force of the spring 81. The first position is a position where the wiper member 62 is provided until the wiper holder 76 of the wiper member 62 at the separation position contacts with the contact part 82*d*. The second position is a position where the wiper holder 76 of the wiper member 62 at the separation position contacts with the top face 82*d*4. The wiper 75 contacts with the cleaning member 63 while the wiper member 62 moves between the first position and the second position.

Figure 8A:
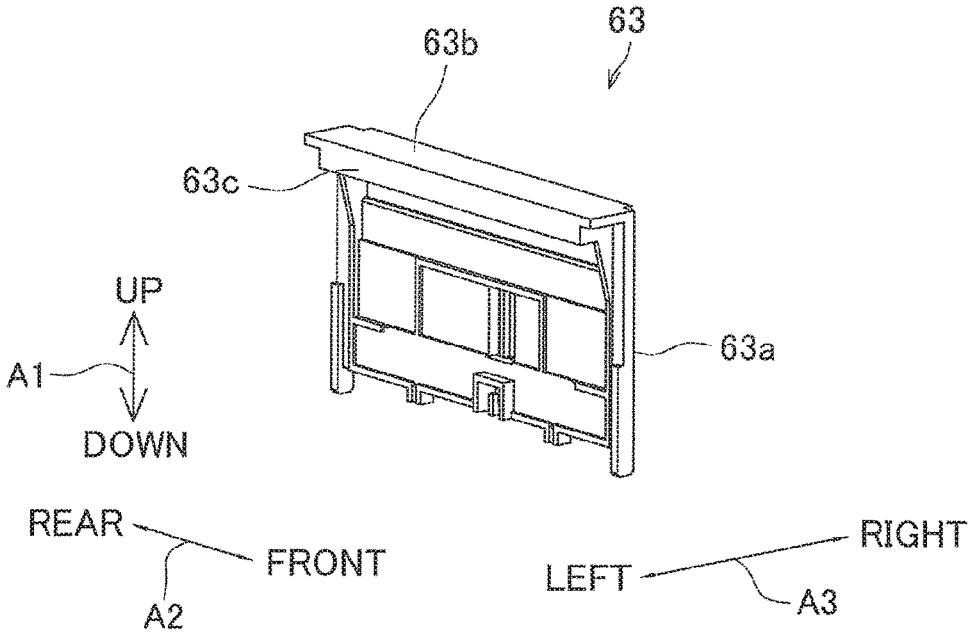
Figure 8B:
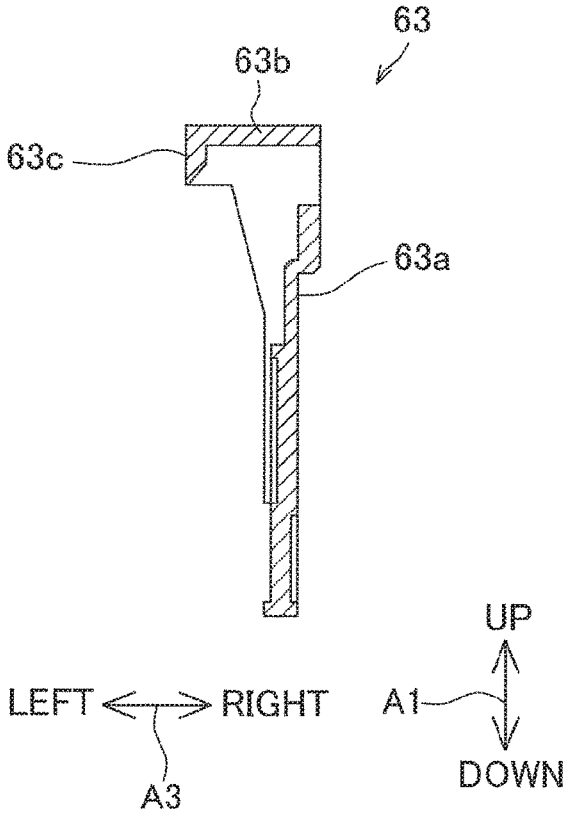
FIG. 8B is a cross section of the cleaning member.

As shown in FIG. 4, the cleaning member 63 is supported while standing in the main body 65*b* of the maintenance frame 65. The cleaning member 63 is formed by resin or the like, and includes a plate-shaped portion 63*a* extending in the up-down direction A1, a horizontal portion 63*b*, and a protrusion 63*c* as shown in FIG. 8A and FIG. 8B.

The horizontal portion 63*b* is formed at the upper end of the plate-shaped portion 63*a* and is long in the front-rear direction A2. As shown in FIG. 8B, the protrusion 63*c* is formed to protrude downward from the left end of the horizontal portion 63*b*. The protrusion 63*c* is longer than the wiper 75 in the front-rear direction A2.

The switching mechanism 67 (driven member) is provided for switching the connection target of the suction pump 66 between two connection holes 71*a*1 and 71*b*1 of the suction cap 71. Although not illustrated, the connection hole 71*a*1 of the suction cap 71 is connected with a later-described Co port 67*b*3 via a tube. Furthermore, the connection hole 71*b*1 of the suction cap 71 is connected with a later-described Bk port 67*b*2 via a tube. As shown in FIG. 4, FIG. 9, and FIGS. 10A to 10C, the switching mechanism 67 includes a switching member 67*a* provided below the gear 83 and a cover 67*b* housing the switching member 67*a*.

The switching member 67*a* is made of an elastic material such as rubber, is columnar in shape, and is fixed to the center of the lower surface of the rotational cam 82. In the switching member 67*a*, a switching passage 67*c* is formed. The switching passage 67*c* includes a circular central groove 67*c*1 formed at the center of the lower surface of the switching member 67*a*, three vertical grooves 67*c*2 formed in the side peripheral surface of the switching member 67*a*, and three horizontal grooves 67*c*3 connecting the central groove 67*c*1 with the three vertical grooves 67*c*2. The three vertical grooves 67*c*2 extend along the up-down direction A1 and are separated from one another along the rotational direction A5. The horizontal grooves 67*c*3 horizontally extend from the central groove 67*a*1 along the radial direction of the switching member 67*a*.

Figure 9:
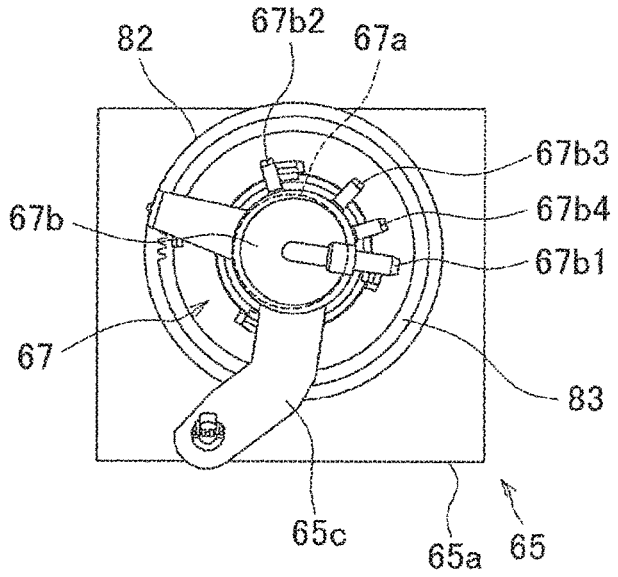
FIG. 9 shows the maintenance unit of First Embodiment from below.
Figure 10A:
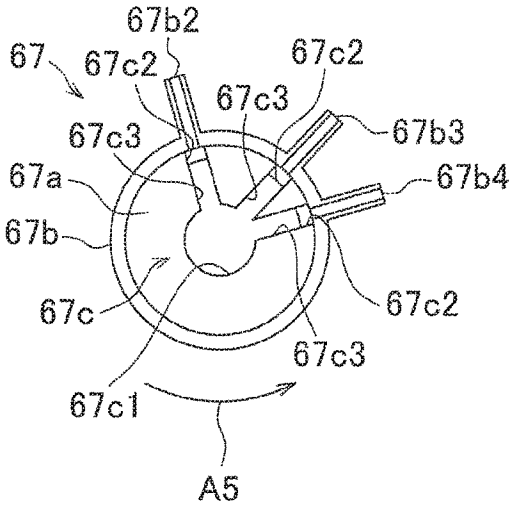
FIG. 10A shows a state in which a switching member of First Embodiment is positioned to be in a first state.

As the FIG. 9, the cover 67*b* is a cylinder with a bottom. At the center of the bottom of the cover 67*b*, an intake port 67*b*1 is formed. The intake port 67*b*1 includes a hole (pump hole) which connects the inside of the cover 67*b*1 with the outside. The intake port 67*b*1 is connected with the suction pump 66 through a tube 66*a* (see FIG. 3). The intake port 67*b*1 is provided to oppose the central groove 67*c*1 and communicates with the central groove 67*c*1. On the circular peripheral wall of the cover 67*b*, ports 67*b*2 to 67*b*4 are formed along the rotational direction A5 to be separated from one another. As shown in FIG. 10A, the ports 67*b*2 to 67*b*4 are provided at the same intervals as the three vertical grooves 67*c*2 along the rotational direction A5. On this account, when the switching member 67*a* is at the rotational position shown in FIG. 10A, the ports 67*b*2 to 67*b*4 communicate with one another via the switching passage 67*c*. Each of the ports 67*b*2 to 67*b*4 includes a hole (cap hole) which connects the inside of the cover 67*b*1 with the outside.

The first port is a Bk port 67*b*2 which communicates with a space which communicates with the connection hole 71*b*1 of the suction cap 71 and receives discharged black ink. The second port is a Co port 67*b*3 which communicates with a space which communicates with the connection hole 71*a*1 of the suction cap 71 and receives discharged color ink. The remaining one of the ports is an atmosphere port 67*b*4 which is open to the atmosphere.

Figure 10B:
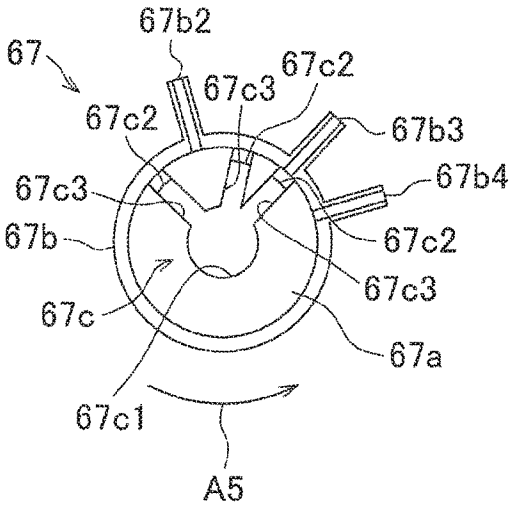
FIG. 10B shows a state in which the switching member is positioned to be in a second state.
Figure 10C:
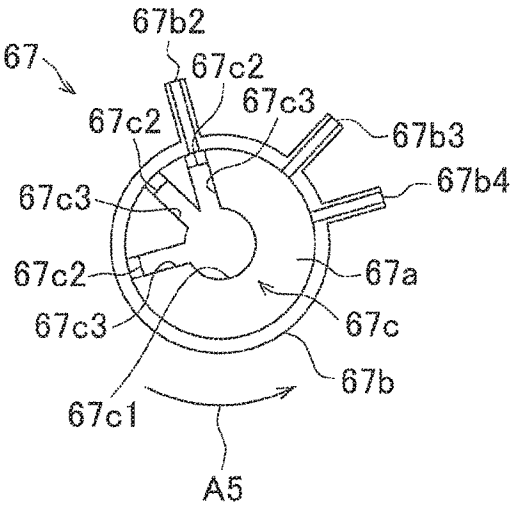
FIG. 10C shows a state in which the switching member is positioned to be in a third state.

As shown in FIG. 9, the cover 67*b* is supported by an arm 65*c* which is connected with the bottom plate 65*a* of the maintenance frame 65. The cover 67*b* is rotatable relative to the rotational cam 82 and the switching member 67*a*. The switching member 67*a* is selectively set in one of the first to the third states as the switching member 67*a* rotates together with the rotational cam 82. As shown in FIG. 10A, the first state is a state in which the three ports 67*b*2 to 67*b*4 communicate with one another via the switching passage 67*c*. As shown in FIG. 10B, the second state is a state in which the suction pump 66 communicates with the connection hole 71*a*1 of the suction cap 71 via the switching passage 67*c* and the Co port 67*b*3. As shown in FIG. 10C, the third state is a state in which the suction pump 66 communicates with the connection hole 71*b*1 of the suction cap 71 via the switching passage 67*c* and the Bk port 67*b*2. As such, the rotational cam 82 drives the switching mechanism 67 by the rotation. It is noted that, a position of the rotational cam 82 relative to the rotational direction A5 (i.e., a rotational angle of the rotational cam 82) is also detectable based on a rotation amount of the ASF motor 20M. For this reason, by changing the position of the rotational cam 82 relative to the rotational direction A5, the stop position of the rotational cam 82 with respect to the wiper member 62 and the state (one of the first state to the third state) of the switching mechanism 67 are controllable.

The suction pump 66 is a known tube pump. When the switching member 67*a* is in the second or third state, ink is discharged to the closed space K1 or the closed space K2 as the rotor of the suction pump 66 is rotated. The suction pump 66 is driven by receiving power from the LF motor 35M. The waste liquid tank 68 is connected with the suction pump 66 via a tube 68*a* and stores waste ink sucked by the suction pump 66.

Figure 11A:
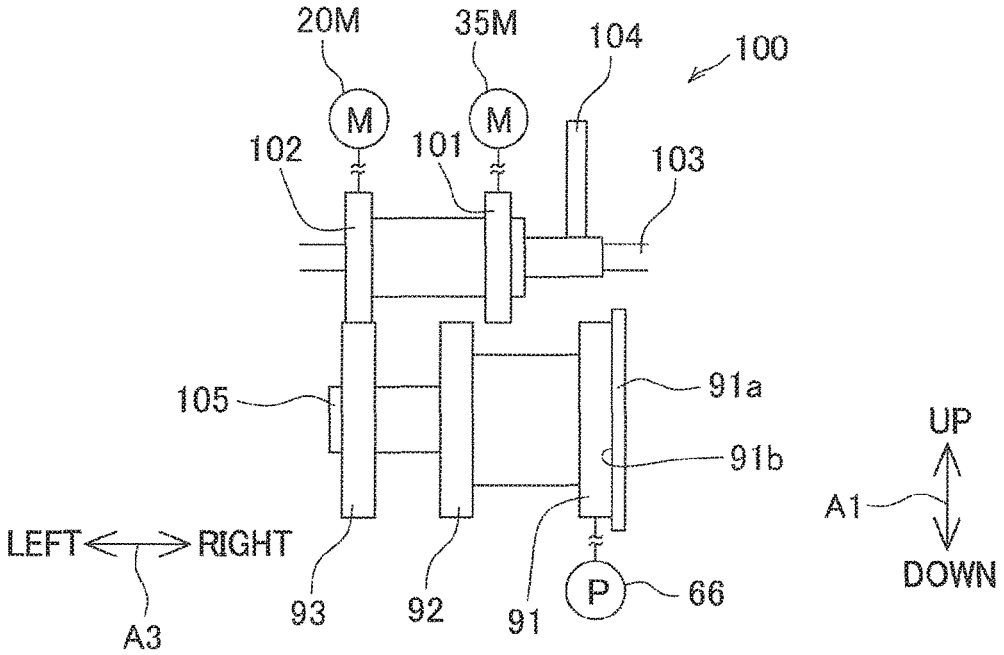
Figure 11B:
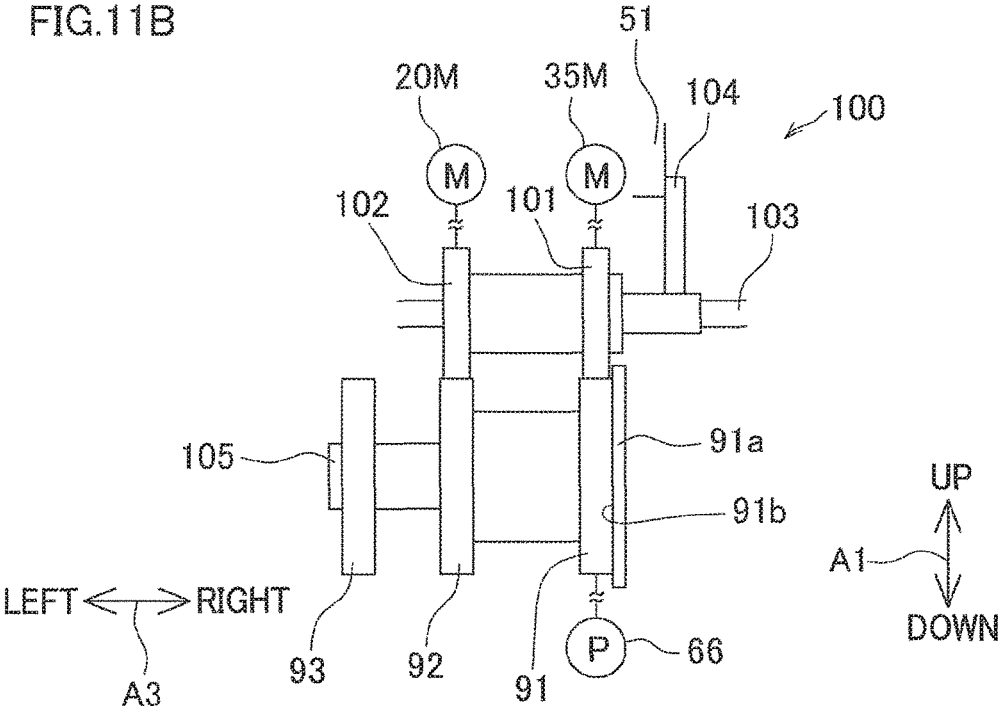
FIG. 11B shows a power transmission state of each gear when the record head is at a maintenance position.

Now, a power transmission mechanism 100 configured to selectively transfer the power of the ASF motor 20M to the pickup roller 21, the cap elevation mechanism 73, the moving mechanism 64 or the switching mechanism 67 and selectively transfer the power of the LF motor 35M to the conveyor roller 35*a* or the suction pump 66 will be described. As shown in FIG. 3, the power transmission mechanism 100 is provided rearward of the suction cap 71. As shown in FIG. 11A and FIG. 11B, the power transmission mechanism 100 is configured to selectively transfer powers of two systems independently output from the ASF motor 20M and the LF motor 35M to each mechanism.

The LF motor 35M is connected with one end (on the left side in FIG. 3) of the conveyor roller 35*a*. At the other end (on the right side in FIG. 3) of the conveyor roller 35*a*, an LF gear (not illustrated) is provided to rotate coaxially with and together with the conveyor roller 35*a*. A first drive gear 101 shown in FIG. 11A and FIG. 11B is engaged with the LF gear to be slidable along the axis, and is rotationally driven by the power of the LF motor 35M. The axis of the first drive gear 101 is in parallel with the axis of the LF gear, and the first drive gear 101 is horizontally movable relative to the LF gear. Because the length of the LF gear in the axial direction (hereinafter, the thickness of the LF gear) is sufficiently greater than the sliding range of the first drive gear 101, the first drive gear 101 is always engaged with the LF gear in the sliding range of the first drive gear 101.

As the power is transmitted from the output shaft of the ASF motor 20M to the second drive gear 102 via an ASF gear (not illustrated), the second drive gear 102 is rotationally driven. The axis of the second drive gear 102 is in parallel with the axis of the ASF gear, and the second drive gear 102 is horizontally movable relative to the ASF gear. Because the thickness of the ASF gear is sufficiently greater than the sliding range of the second drive gear 102, the second drive gear 102 is always engaged with the ASF gear in the sliding range of the second drive gear 102.

As shown in FIG. 11A, the first drive gear 101 and the second drive gear 102 are pivoted by one supporting shaft 103 to be slidable in the axial direction. The first drive gear 101 is provided to the right of the second drive gear 102. The axis of the supporting shaft 103 extends along the left-right direction A3 and is in parallel with the scanning direction of the carriage 51. As the first drive gear 101 and the second drive gear 102 slide along the supporting shaft 103, the first drive gear 101 and the second drive gear 10 are selectively engaged with later-described first to third transmission gears 91 to 93.

On the supporting shaft 103, a switching lever 104 is provided to the right of the first drive gear 101 to be slidable. The first drive gear 101, the second drive gear 102, and the switching lever 104 are mutually in contact and are integrated on the supporting shaft 103, and are biased by a coil spring (not illustrated) toward the image recording region G1 along the axis of the supporting shaft 103. The first drive gear 101 and the second drive gear 102 are integrated but independently rotatable. The switching lever 104 extends along the up-down direction A1 and is positioned to be in contact with the carriage 51 when the carriage 51 reaches the maintenance region G2.

Below the first drive gear 101 and the second drive gear 102, a first transmission gear 91, a second transmission gear 92, and a third transmission gear 93 are provided in this order from right to left in a parallel manner, on a supporting shaft 105 which is in parallel with the supporting shaft 103. The first transmission gear 91 is able to be engaged with the first drive gear 101. The second and third transmission gears 92 and 93 are able to be engaged with the second drive gear 102. The first to third transmission gears 91 to 93 are identical with one another in external diameter.

To the right of the first transmission gear 91, a bevel gear 91*a* is provided. The external diameter of the bevel gear 91*a* is longer than that of the first transmission gear 91, and hence a regulating face 91*b* protruding radially outward is formed therebetween. As the first drive gear 101 is in contact with the regulating face 91*b*, the first drive gear 101 is positioned to be engaged with the first transmission gear 91.

The first transmission gear 91 transmits power to the suction pump 66 together with the bevel gear 91*a* which is provided at one end side of the first transmission gear 91. As the rotational direction of the second transmission gear 92 is switched, the second transmission gear 92 selectively transmits power to the cap elevation mechanism 73 or to the moving mechanism 64 and the switching mechanism 67. The third transmission gear 93 transmits power to the pickup roller 21.

When the carriage 51 is at a position other than the maintenance position, e.g., in the image recording region G1, the switching lever 104 is not in contact with the carriage 51. In this state, as shown in FIG. 11A, the first drive gear 101 is not engaged with any one of the first to third transmission gears 91 to 93. In the meanwhile, the second drive gear 102 is engaged with the third transmission gear 93. This allows the power of the ASF motor 20M to be transmitted to the third transmission gear 93. In other words, as the LF motor 35M and the ASF motor 20M are controlled, the conveyor roller pair 35, the sheet discharge roller pair 36, and the pickup roller 21 are rotated and a sheet P is conveyed. It is noted that none of the first and second drive gears 101 and 102 is engaged with the second transmission gear 92. To put it differently, a non-transmission state in which the powers of the ASF motor 20M and the LF motor 35M are not transmitted to any one of the cap elevation mechanism 73, the moving mechanism 64, and the switching mechanism 67 is established.

When the carriage 51 moves to the maintenance region G2 and the record head 41 is at the maintenance position, as shown in FIG. 11B, the first drive gear 101 moves to a position of being engaged with the first transmission gear 91 and the second drive gear 102 moves to a position of being engaged with the second transmission gear 92, as the carriage 51 and the switching lever 104 are in contact with each other. With this, a transmission state in which the power of the LF motor 35M is transmitted to the first transmission gear 91 and the power of the ASF motor 20M is transmitted to the second transmission gear 92 is established. As a result, maintenances such as a purging operation of discharging ink through the ejection openings 41*a* become possible.

Figure 12A:
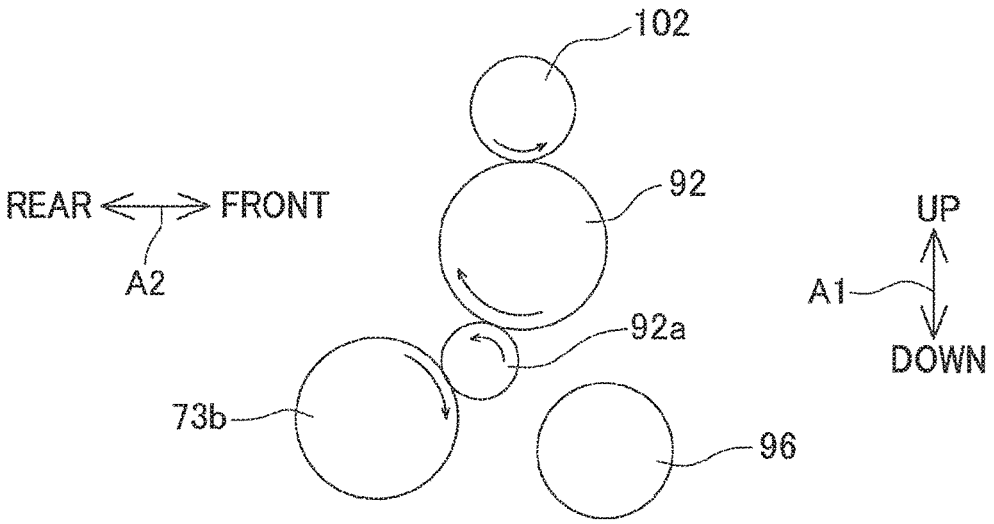
Figure 12B:
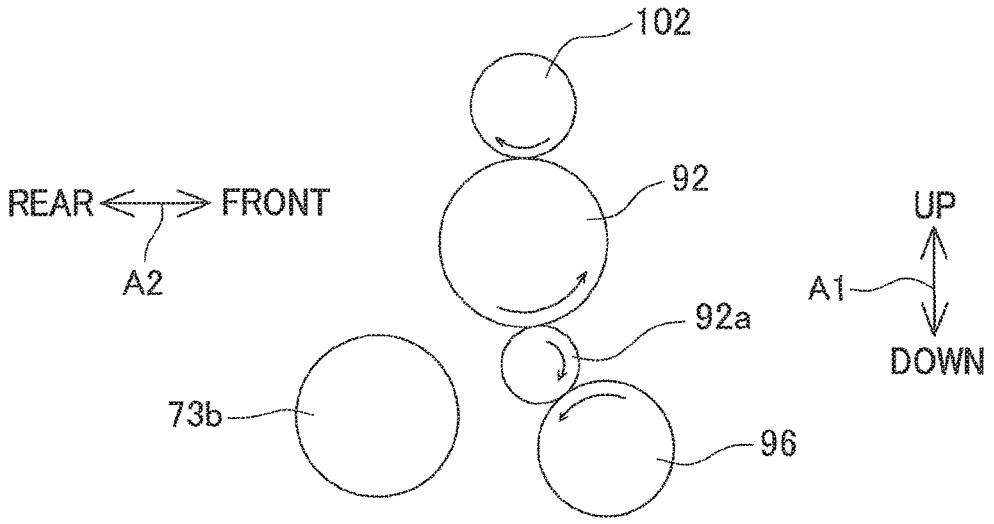
FIG. 12B shows a power transmission state of each gear when the ASF motor is rotated forward while the record head is at the maintenance position.

As shown in FIG. 12A and FIG. 12B, the second transmission gear 92 is always engaged with a planetary gear 92*a*. When the ASF motor 20M is driven backward while the second drive gear 102 is engaged with the second transmission gear 92, the planetary gear 92*a* moves to a position of being engaged with the gear 73*b* and transmits the power of the ASF motor 20M to the gear 73*b*, as shown in FIG. 12A. The gear 73*b* is rotated in one direction (clockwise in FIG. 12A and FIG. 12B) by the power of the ASF motor 20M. This makes it possible to drive the cap elevation mechanism 73. In the meanwhile, when the ASF motor 20M is rotated forward, the planetary gear 92*a* moves to a position of being engaged with the gear 96 and transmits the power of the ASF motor 20M to the gear 96 as shown in FIG. 12B. The gear 96 is rotated in the direction opposite to the rotational direction of the gear 73*b* (anticlockwise in FIG. 12A and FIG. 12B) by the power of the ASF motor 20M. The gear 96 is engaged with the gear 83 via an unillustrated gear train. This makes it possible to drive the moving mechanism 64 and the switching mechanism 67. The first drive gear 101, the second drive gear 102, and the switching lever 104 constitute a switching mechanism for switching the powers from the ASF motor 20M and the LF motor 35M. The second transmission gear 92, the planetary gear 92*a*, the gear 96 and the like to which the power from the switching mechanism is transmitted constitute a transmission mechanism. The switching mechanism, the transmission mechanism and the ASF motor (drive motor) 20M constitute a rotation mechanism for rotating the cap elevation mechanism 73 (another driven member), the rotational cam 82, and the switching mechanism 67 (driven member). It is noted that a mechanism for transmission from the first and third transmission gears 91 and 93 to each mechanism may be a known transmission mechanism utilizing a gear train, a belt, or the like.

Figure 13:
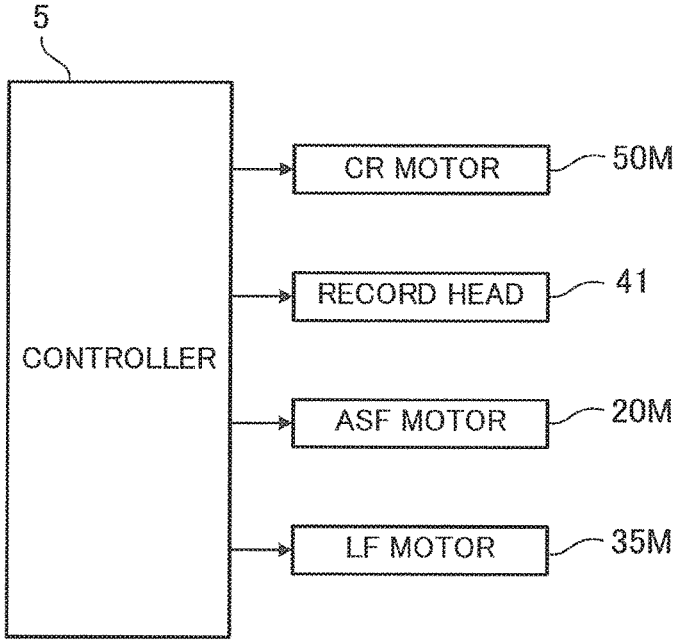
FIG. 13 is a block diagram of a control system of the printer of First Embodiment.
Figure 14:
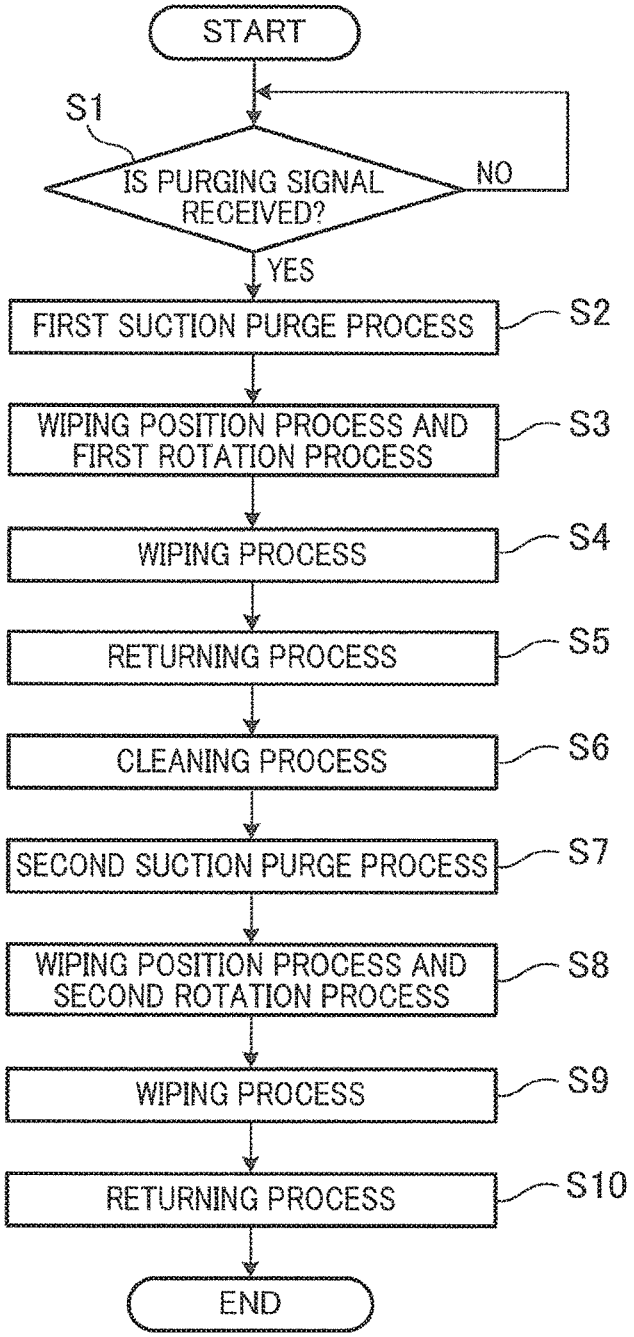
FIG. 14 shows a flowchart of the steps of a maintenance operation of First Embodiment.

As shown in FIG. 13, the controller 5 includes a CPU (Central Processing Unit), a ROM (Read Only Memory), a RAM (Random Access Memory), an ASIC (Application Specific Integrated Circuit), or the like, and the ASF motor 20M, the LF motor 35M, the CR motor 50M, the record head 41, and the like are controlled by cooperation of the members of the controller 5. For example, the controller 5 controls the record head 41, the ASF motor 20M, the LF motor 35M, the CR motor 50M, or the like based on a recording command from the PC to record an image or the like on a sheet P. Furthermore, the controller 5 controls the CR motor 50M, the ASF motor 20M, the LF motor 35M, or the like to perform a maintenance operation such as the purging operation of discharging ink through the ejection openings 41*a*. While the controller 5 of the present embodiment includes one CPU and one ASIC, the controller 5 may include only one CPU and this CPU integrally performs required operations, or the controller 5 may include a plurality of CPUs and required operations may be performed by these CPUs in a shared manner. Alternatively, the controller 5 may include only one ASIC and this ASIC integrally perform required operations, or the controller 5 may include a plurality of ASICs and required operations may be performed by these ASICs in a shared manner.

Now, the maintenance operation of the printer 10 will be described with reference to FIG. 14 to FIG. 17E Upon receiving a purging signal for executing suction purge (S1: YES), the controller 5 executes, to begin with, a first suction purge process of discharging color ink (S2). When no purging signal is received (S1: NO), the controller 5 repeats the step S1. The following description presupposes that the record head 41 (carriage 51) is in the image recording region G1 when receiving the purging signal.

Subsequently, in S2, the controller 5 controls the CR motor 50M so as to move the carriage 51 such that the record head 41 moves from the image recording region G1 to the maintenance position in the maintenance region G2 (i.e., to the position where the ejection surface 41*b* and the suction cap 71 oppose each other in the up-down direction A1). At this stage, the power of the LF motor 35M becomes transmittable to the suction pump 66 and the power of the ASF motor 20M become transmittable to the cap elevation mechanism 73, the moving mechanism 64, and the switching mechanism 67 by the power transmission mechanism 100.

Figures 17A, 17B, 17C, 17D, 17E, 17F:
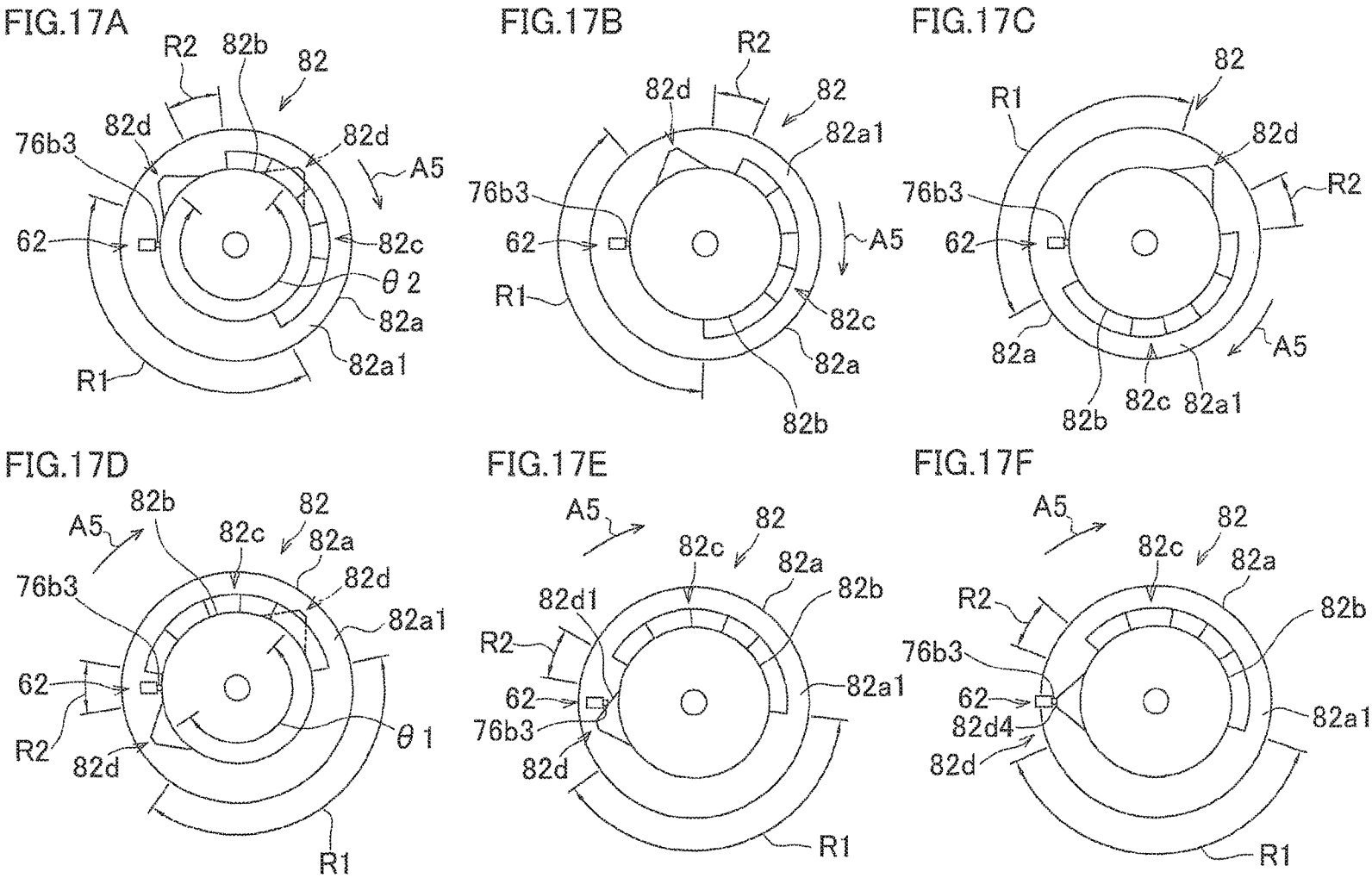

The controller 5 drives the ASF motor 20M backward to move the suction cap 71 from the separated position to the abutting position as shown in FIG. 15A. At this stage, the switching mechanism 67 is in the first state. The positional relationship between the rotational cam 82 and the wiper member 62 when the switching mechanism 67 is in the first state is shown in FIG. 17A. That is to say, the lower end 76*c* is in the first region R1 and is in the vicinity of the contact part 82*d*. Thereafter, the controller 5 drives the ASF motor 20M forward to cause the switching mechanism 67 to be in the second state (i.e., a state in which the suction pump 66 communicates with the connection hole 71*a*1 of the suction cap 71). At this stage, the positional relationship between the rotational cam 82 and the wiper member 62 is as shown in FIG. 17B, and the lower end 76*c* is in the first region R1 and is far from the contact part 82*d* along the rotational direction A5 as compared to the cases where the switching mechanism 67 is in the first state. Then the controller 5 drives the LF motor 35M to drive the suction pump 66 for a predetermined time. As a result, the pressure in the closed space K1 is decreased and the color ink is discharged from the ejection openings 41*a* to the recess 71*a*.

Subsequently, the controller 5 drives the ASF motor 20M backward, and drives the LF motor 35M to drive the suction pump 66 for a predetermined time while the suction cap 71 has been moved from the abutting position to the separated position as shown in FIG. 15B. As a result, the color ink remaining in the recess 71*a* is discharged to the waste liquid tank 68. In this way, the first suction purge process is finished.

Thereafter, the controller 5 executes a wiping position process and a first rotation process (S3). To begin with, as the controller 5 drives the ASF motor 20M forward, the rotational cam 82 is rotated in the rotational direction A5 from a position shown in FIG. 17B to a position shown in FIG. 17C. The original position of the rotational cam 82 of the present embodiment is shown in FIG. 17C. The multi-function machine 1 of the present embodiment is provided with a switch (not illustrated) which is in contact with the rotational cam 82 only when the rotational cam 82 is at the original position. When contacting with the rotational cam 82, the switch outputs a signal to the controller 5 to indicate that the rotational cam 82 is at the original position. Based on the signal from the switch, the controller 8 recognizes that the rotational cam 82 is at the original position. When the rotational cam 82 is at the original position, the switching mechanism 67 is arranged to be in the third state shown in FIG. 10C. Thereafter, the controller 5 drives the ASF motor 20M forward, and rotates the rotational cam 82 from the original position for a first rotational angle θ1 in the rotational direction A5, as shown in FIG. 17D. The first rotational angle θ1 shown in FIG. 17D is an example of the rotational angle of the contact part 82*d*. The same holds true for rotational angles of protruding part 82*c*, a particular part of the first region R1 and a particular part of the second region R2. To put it differently, the rotational angle of any particular part of the rotational cam 82 at the original position is required to be the first rotational angle θ1. As the rotational cam 82 rotates, as shown in FIG. 15B, the lower end 76*c* contacts with the protruding part 82*c* and the wiper member 62 moves to the wiping position against the biasing force of the spring 81. As the wiper member 62 moves to the wiping position, the paired protrusions 76*a*2 are engaged with the maintenance frame 65, with the result that the wiper member 62 is retained at the wiping position (wiping position process).

When the rotational cam 82 rotates from the original position for the first rotational angle θ1, the lower end 76*c* is provided at a position corresponding to the second region R2 (first rotation process). As the wiper member 62 is provided at such a position, the contact part 82*d* is positioned on the upstream of the wiper member 62 which is returned to the separation position in a later-described returning process (S5). In the present embodiment, an area covered by the rotation for 180 degrees of the contact part 82*d* in the rotational direction A5 is referred to as downstream of the contact part 82*d*, whereas an area covered by the rotation for 180 degrees of the contact part 82*d* in the direction opposite to the rotational direction A5 is referred to as upstream of the contact part 82*d*. On this account, relative to the rotational direction A5, the second region R2 is on the downstream of the contact part 82*d* and the first region R1 is on the upstream of the contact part 82*d*. To put it differently, relative to the rotational direction A5, the contact part 82*d* is on the upstream of the second region R2 and on the downstream of the first region R1.

Subsequently, the controller 5 executes a wiping process (S4). That is to say, the controller 5 controls the CR motor 50M so as to move the carriage 51 such that the record head 41 moves from the maintenance region G2 to the image recording region G1. As a result, as shown in FIG. 15C, the record head 41 moves leftward. At this stage, the ejection surface 41*b* contacts with the leading end part 75*c* of the wiper 75, and the wiper member 62 wipes the color ink adhered to the ejection surface 41*b* in the direction rightward relative to the ejection surface 41*b* (i.e., in a wiping direction which is a movement direction relative to the ejection surface 41*b*). When the record head 41 at in a position different from the maintenance position, no power is transmitted from each of the motors 20M and 35M to the suction pump 66, the cap elevation mechanism 73, the moving mechanism 64, and the switching mechanism 67.

Subsequently, the controller 5 executes a returning process (S5). That is to say, the controller 5 controls the CR motor 50M so as to move the carriage 51 such that the record head 41 moves from the image recording region G1 to the maintenance position. In other words, the record head 41 is moved rightward (i.e., in a direction in which the movement direction of the wiper member 62 relative to the ejection surface 41*b* is opposite to the wiping direction) from a position shown in FIG. 15D (i.e., a position to the left of the wiper member 62). As a result, as shown in FIG. 15E, the record head 41 contacts with the leading end part 5*c* of the wiper 75. At this stage, because the lower side surface 75*a*2 is in contact with the contact plate 76*a*1, the bending of the wiper 75 is restrained. Because the bending of the wiper 75 is restrained in this way, the wiper member 62 is rotated about the paired protrusions 76*b*1 by the force generated by the movement of the record head 41, against the biasing force of the spring 81. As a result, the engagement of the paired protrusions 76*a*2 with the maintenance frame 65 is canceled, and the wiper member 62 is moved to the separation position by the biasing force of the spring 81. As such, by a simple operation of causing the record head 41 to be in contact with the wiper member 62, the wiper member 62 is returned to the separation position by the biasing force of the spring 81. In this state, as shown in FIG. 17D, the lower end 76*c* is in the second region R2. The head-moving mechanism 50 which moves the record head 41 in the manner as above is a part of the wiper moving mechanism of moving the wiper from the wiping position to the separation position. As the record head 41 is provided at the maintenance position, the power of the LF motor 35M is transmittable to the suction pump 66 and the power of the ASF motor 20M is transmittable to the cap elevation mechanism 73, the moving mechanism 64, and the switching mechanism 67 by the power transmission mechanism 100.

Subsequently, the controller 5 executes a cleaning process (S6). That is to say, the controller 5 rotates the ASF motor 20M forward, and rotates the rotational cam 82 from a position shown in FIG. 17D to a position shown in FIG. 17A, and then stops the rotational cam 82. When the rotational cam 82 is at a position shown in FIG. 17D, the wiper member 62 is at the first position as shown in FIG. 16A. When the rotational cam 82 is at a position shown in FIG. 17E, the protrusion 76*b*3 of the wiper member 62 is in contact with the side surface 82*d*1 of the contact part 82*d*, and as shown in FIG. 16B, the wiper member 62 rotates rightward against the biasing force of the spring 81 and the upper side surface 75*a*1 is in contact with the protrusion 63*c*. When the rotational cam 82 is at a position shown in FIG. 17F, the protrusion 76*b*3 is in contact with the top face 82*d*4 and the lower end 76*c* moves to the second position. At this stage, as shown in FIG. 16C, the leading end part 75*c* is provided at a position where the leading end part 75*c* has passed the protrusion 63*c*. As the wiper 75 contacts with the cleaning member 63 while the wiper member 62 rotates from the first position to the second position, the ink adhered to and remaining on the upper side surface 75*a*1 is removed. As the rotational cam 82 rotates to the position shown in FIG. 17A, the protrusion 63*c* is no longer in contact with the contact part 82*d*, and the wiper member 62 returns to the first position as shown in FIG. 16A due to the biasing force of the spring 81. Because the rotational cam 82 is at a position shown in FIG. 17A at this stage, the switching mechanism 67 is in the first state as described above.

Subsequently, the controller 5 executes a second suction purge process (S7). That is to say, the controller 5 drives the ASF motor 20M backward to move the suction cap 71 from the separated position to the abutting position. Thereafter, the controller 5 drives the ASF motor 20M forward to rotate the rotational cam 82 to the original position, with the result that the switching mechanism 67 is switched to the third state (i.e., a state in which the suction pump 66 communicates with the connection hole 71*b*1 of the suction cap 71). At this stage, the positional relationship between the rotational cam 82 and the wiper member 62 is as shown in FIG. 17C. In this relationship, the lower end 76*c* is in the first region R1 and is far from the contact part 82*d* and approaches the protruding part 82*c* in the rotational direction A5 as compared to the case where the switching mechanism 67 is in the second state. Then the controller 5 drives the LF motor 35M to drive the suction pump 66 for a predetermined time. As a result, the pressure in the closed space K2 is decreased and the black ink is discharged from the ejection openings 41*a* to the recess 71*b*.

Subsequently, the controller 5 drives the ASF motor 20M backward, and drives the LF motor 35M and drives the suction pump 66 for a predetermined time after moving the suction cap 71 from the abutting position to the separated position. As a result, the black ink remaining in the recess 71*b* is discharged to the waste liquid tank 68. In this way, the second suction purge process is finished. While in the present embodiment the second suction purge is executed after the first suction purge, the second suction purge may be executed first.

Subsequently, the controller 5 executes a wiping position process and a second rotation process (S8). The controller 5 drives the ASF motor 20M forward to rotate the rotational cam 82 in the rotational direction A5 from a position shown in FIG. 17C to a position shown in FIG. 17A. That is to say, as shown in FIG. 17A, the rotational cam 82 is rotated in the rotational direction A5 from the original position, for a second rotational angle θ2. Being similar to the first rotational angle θ1, the rotational angle of any particular part of the rotational cam 82 at the original position is required to be the second rotational angle θ2. The second rotational angle θ2 is larger than the first rotational angle θ1 and is smaller than 360 degrees. In the same manner as in S3, on account of the rotation of the rotational cam 82, the wiper member 62 moves to the wiping position and the wiper member 62 is maintained at the wiping position (wiping position process). As the rotational cam 82 rotates from the original position for the second rotational angle θ2, the lower end 76*c* is positioned in the first region R1 (second rotation process). As the wiper member 62 is positioned in this way, the contact part 82*d* is provided on the downstream of the wiper member 62 which is returned to the separation position in a later-described returning process (S10).

Subsequently, the controller 5 executes a wiping process which is similar to S4 (S9). With this, the ejection surface 41*b* contacts with the leading end part 75*c* and the black ink adhered to the ejection surface 41*b* is wiped.

Subsequently, the controller 5 executes a returning process which is similar to S5 (S10). With this, the wiper member 62 returns to the separation position. At this stage, the lower end 76*c* is provided in the downstream region RE Because in S10 the record head 41 is provided at the maintenance position, the power of the LF motor 35M is transmittable to the suction pump 66 and the power of the ASF motor 20M is transmittable to the cap elevation mechanism 73, the moving mechanism 64, and the switching mechanism 67 by the power transmission mechanism 100.

In this way, the first rotation process is executed in S3, and when the wiper member 62 returns to the separation position in the returning process in S5, the lower end 76*c* is provided in the second region R2. On this account, when the rotational cam 82 is rotated, the lower end 76*c* contacts with the contact part 82*d* and cleaning is performed as the wiper 75 is in contact with the cleaning member 63. In the meanwhile, the second rotation process is executed in S8, and when the wiper member 62 returns to the separation position in the returning process in S10, the lower end 76*c* is positioned in the first region R1. On this account, even if the rotational cam 82 is rotated, the wiper member 62 is in contact with the protruding part 82*c* and the wiper member 62 is provided at the wiping position. To put it differently, because the wiper holder 76 does not contact with the contact part 82*d* even if the rotational cam 82 rotates, the wiper 75 does not unnecessary contact with the cleaning member 63. As such, the maintenance operation is finished.

As described above, in the present embodiment, the wiper moving mechanism formed of the moving mechanism 64 and the head-moving mechanism 50 is able to move the wiper member 62 between the wiping position and the separation position. When the wiper member 62 is at the wiping position, the contact part 82*d* does not make contact with the wiper holder 76 even if the rotational cam 82 rotates. Meanwhile, when the wiper member 62 is at the separation position, the contact part 82*d* makes contact with the wiper holder 76 as the rotational cam 82 rotates, and hence the wiper 75 makes contacts with the cleaning member 63. On this account, cleaning of the wiper 75 by removing ink adhered thereto is executable. Therefore, the wiper 75 is selectively cleaned. This prevents the wiper 75 from making unnecessary contact with the cleaning member 63 even if the rotational cam 82 is rotated to drive the switching mechanism 67, and hence the deterioration of the wiper 75 is restrained.

The rotational cam 82 includes the first region R1 and the second region R2 separated from each other by the contact part 82*d* and the protruding part 82*c*. On this account, when the wiper holder 76 of the wiper member 62 at the separation position is provided at a position corresponding to the first region R1, the wiper member 62 is provided at the wiping position without the wiper 75 being cleaned, when the rotational cam 82 rotates. In the meanwhile, when the wiper holder 76 of the wiper member 62 at the separation position is provided at a position corresponding to the second region R2, the wiper 75 is cleaned by the cleaning member 63 because the wiper holder 76 contacts with the contact part 82*d* as the rotational cam 82 rotates. On this account, when the wiper member 62 is returned from the wiping position to the separation position, the wiper 75 is selectively cleaned by providing the wiper holder 76 in the first region R1 or the second region R2.

As the wiper holder 76 is swingably supported by the maintenance frame 65 and the contact part 82*d* includes the side surface 82*d*1, the wiper 75 is cleaned by the cleaning member 63 by causing the wiper holder 76 to be in contact with the side surface 82*d*1 and swinging the wiper holder 76.

In the first rotation process in S3, the contact part 82*d* is provided on the upstream of the wiper holder 76 of the wiper member 62 having been returned to the separation position, and in the second rotation process in S10, the contact part 82*d* is provided on the downstream of the wiper holder 76 of the wiper member 62 returned to the separation position. On this account, the wiper 75 is selectively cleaned by simple control. In the first rotation process in S3, the wiper holder 76 of the wiper member 62 returning to the separation position rotates to be positioned in the second region R2, and in the second rotation process in S10, the wiper holder 76 of the wiper member 62 returning to the separation position rotates to be positioned in the first region. With this, the wiper 75 is selectively cleaned by simple control, too.

Because of the transmission mechanism formed of members such as the second transmission gear 92, the planetary gear 92*a*, and the gear 96, the rotational cam 82 and the switching mechanism 67 and the cap elevation mechanism 73 are individually driven only by switching the rotational direction of the ASF motor 20M.

Because of the switching mechanism formed of members such as the first drive gear 101, the second drive gear 102, and the switching lever 104, power is supplied to either the rotational cam 82 and the switching mechanism 67 or the cap elevation mechanism 73 only when the record head 41 is at the maintenance position (downstream position).

The controller 5 executes the first and second rotation processes when the record head 41 is at the maintenance position. With this, even in the arrangement in which the power is transmitted to the rotational cam 82 only when the record head 41 is at the maintenance position, the first or second rotation process is executable before the returning process.

In First Embodiment, the first and second suction purge processes are executed based on one purging signal, and the cleaning process is executed after the wiping process regarding the first suction purge process executed for the first time. On this account, the wiping process regarding the second suction purge process executed for the last time can be executed by the cleaned wiper 75.

As a variation, the wiping process may be executed more than once after each suction purge process in the first and second suction purge processes. In this case, the cleaning process is executed before the wiping process executed for the last time. For example, when the wiping process is executed three times, the second rotation process is executed in the wiping position processes for the first and third executions of the wiping process, whereas the first rotation process is executed in the wiping position process for the second execution of the wiping process. With this arrangement, the wiper 75 is cleaned when the wiping position process is executed for the third execution of the wiping process. On this account, the last wiping process in each suction purge process is performed by using the cleaned wiper 75. Because the wiper 75 is selectively cleaned, the deterioration of the wiper 75 is restrained in this variation.

As another variation, the cleaning process may be executed once when the suction purge process is executed more than once based on the purging signal. Because the wiper 75 is selectively cleaned, the deterioration of the wiper 75 is restrained also in this variation.

While in First Embodiment the switching mechanism 67 is a driven member of the present invention (first aspect) and the cap elevation mechanism 73 is another driven member of the present invention (first aspect), these driven members may be swapped, or another mechanism may constitute the driven member and the another driven member of the present invention (first aspect). Furthermore, the another driven member may not be provided. In this case, the transmission mechanism formed of members such as the second transmission gear 92, the planetary gear 92*a*, and the gear 96 may not be provided. Furthermore, in the case above, the switching mechanism formed of members such as the first drive gear 101, the second drive gear 102, and the switching lever 104 may not be provided, either.

The structure of the contact part may be different from the structure described in First Embodiment. For example, when the rotation shaft of the cam extends along the intersecting direction, the contact part may be not provided on the side surface along the intersecting direction of the cam but provided on a surface intersecting with the intersecting direction of the cam (e.g., the upper surface of the column 82*b* in First Embodiment). Furthermore, the rotation shaft of the cam may intersect with (e.g., may be orthogonal to) the intersecting direction. When the rotation shaft of the cam is orthogonal to the intersecting direction, the contact part may be provided on a side surface along the rotation shaft of the cam.

While in First Embodiment the wiper moving mechanism for moving the wiper member 62 between the wiping position and the separation position is formed of the protruding part 82*c* of the rotational cam 82 and the head-moving mechanism 50, the wiper moving mechanism may be formed of a mechanism different from the wiper moving mechanism above. In this case, the rotation processes above (first and second rotation processes) are executable no matter whether the record head 41 is at the maintenance position.

Now, a printer according to the second aspect of the present invention (Second Embodiment) will be described. The printer of the present embodiment is substantially identical with the printer of First Embodiment, and hence the features identical with those in First Embodiment may not be explained.

In the present embodiment, as shown in FIG. 18, paired protrusions 72*c* which are separated from each other in an up-down direction A1 (second moving direction) are provided on a side surface opposing the cleaning member 63 of the cap holder 72. As shown in FIG. 19A, the paired protrusions 72*c* are provided substantially at the center in the front-rear direction A2 of the cap holder 72.

While the contact plate 76*a*1 (contact part) is provided to be in contact with the lower side surface 75*a*2, a gap is formed between the wiper 75 and the contact plate 76*a*1 when the wiper 75 is bended away from the contact plate 76*a*1 to allow the wiper 75 to wipe the ejection surface 41*b*.

Because such a contact plate 76*a*1 is provided, ink adhered to the upper side surface 75*a*1 of the leading end part 75*c* of the wiper 75 is drawn downward on account of capillarity by the gap between the wiper 75 and the contact plate 76*a*1 formed at the time of wiping. This makes the ink less likely to remain on the upper side surface 75*a*1. Furthermore, when the record head 41 moves leftward while keeping in contact with the left side surface 75*b* at the leading end part 75*c* of the wiper 75 as described below, the contact plate 76*a*1 restrains the bending of the wiper 75 and therefore contributes to the movement of the wiper holder 76 (wiper member 62) from the wiping position to the separation position.

The upper end 76*d* (first part) of the vertical portion 76*b* is close to the ejection surface 41*b* as compared to the paired protrusions 76*b*1. The lower end 76*c* (second part) is far from the ejection surface 41*b* as compared to the paired protrusions 76*b*1.

The contact part 82*d* is equivalent to the contact part of the present invention and the protruding part 82*c* is equivalent to the another contact part of the present invention.

The cleaning member 63 further includes a protruding portion 63*d* as shown in FIG. 18 and FIG. 20. The protruding portion 63*d* is formed to protrude rightward from the right side surface of the plate-shaped portion 63*a*. The protruding portion 63*d* is provided at the center of the plate-shaped portion 63*a* relative to the front-rear direction A2 and is between the paired protrusions 72*c*. With this arrangement, when the suction cap 71 moves from the separated position to the abutting position, the paired protrusions 72*c* are engaged with the protruding portion 63*d*, with the result that the cleaning member 63 moves from a cleaning position shown in FIG. 18 to a non-cleaning position (see FIG. 23D). As such, the cleaning member 63 is moved in the up-down direction A1 (second moving direction) by the cap elevation mechanism 73. The cleaning position is a position where the lower end (plate-shaped portion 63*a*) of the cleaning member 63 contacts with the bottom plate 65*a*, and is a position where the upper side surface 75*a*1 of the wiper 75 contacts with the left side surface of the protrusion 63*c* when the wiper holder 76 at the separation position is swung in the direction (first moving direction) indicated by the arrow A4. The non-cleaning position is a position where the cleaning member 63 is provided when the suction cap 71 is at the abutting position, and is a position where the wiper 75 and the protrusion 63*c* are not in contact with each other even if the wiper holder 76 is swung in the direction indicated by the arrow A4.

In the present embodiment, the first moving mechanism of the present invention for moving the wiper member 62 between the wiping position and the separation position is formed of the ASF motor 20M, the power transmission mechanism 100, the head-moving mechanism 50, and the moving mechanism 64. As described later, the head-moving mechanism 50 cancels the engagement between the paired protrusions 76*a*2 of the wiper holder 76 and the maintenance frame 65 in S24, so as to contribute to the movement of the wiper holder 67 to the separation position. The ASF motor 20M, the power transmission mechanism 100, and the moving mechanism 64 constitute the second moving mechanism of the present invention for moving the wiper member 62 between the first position and the second position. The head-moving mechanism 50 constitutes a third moving mechanism of the present invention. The ASF 20M, the power transmission mechanism 100, and the cap elevation mechanism 73 constitute a fourth moving mechanism of the present invention which is capable of moving the suction cap 71 between the abutting position and the separated position and moving the cleaning member 63 between the non-cleaning position and the cleaning position.

Now, a maintenance operation of the printer of the present embodiment will be described with reference to FIG. 21 to FIG. 25B. Upon receiving a purging signal (S21: YES), the controller 5 executes a suction purge process (S22). When not receiving the purging signal (S21: NO), the controller 5 repeats the process of S21. The following explanation presupposes that the record head 41 (carriage 51) is provided in the image recording region G1 when receiving the purging signal.

Subsequently, in S22, the controller 5 controls the CR motor 50M to move the carriage 51 so that the record head 41 moves from the image recording region G1 to the maintenance position in the maintenance region G2. At this stage, the power of the LF motor 35M is transmittable to the suction pump 66 and the power of the ASF motor 20M is transmittable to the cap elevation mechanism 73, the moving mechanism 64, and the switching mechanism 67 by the power transmission mechanism 100.

Figures 22A, 22B, 22C, 22D, 22E:
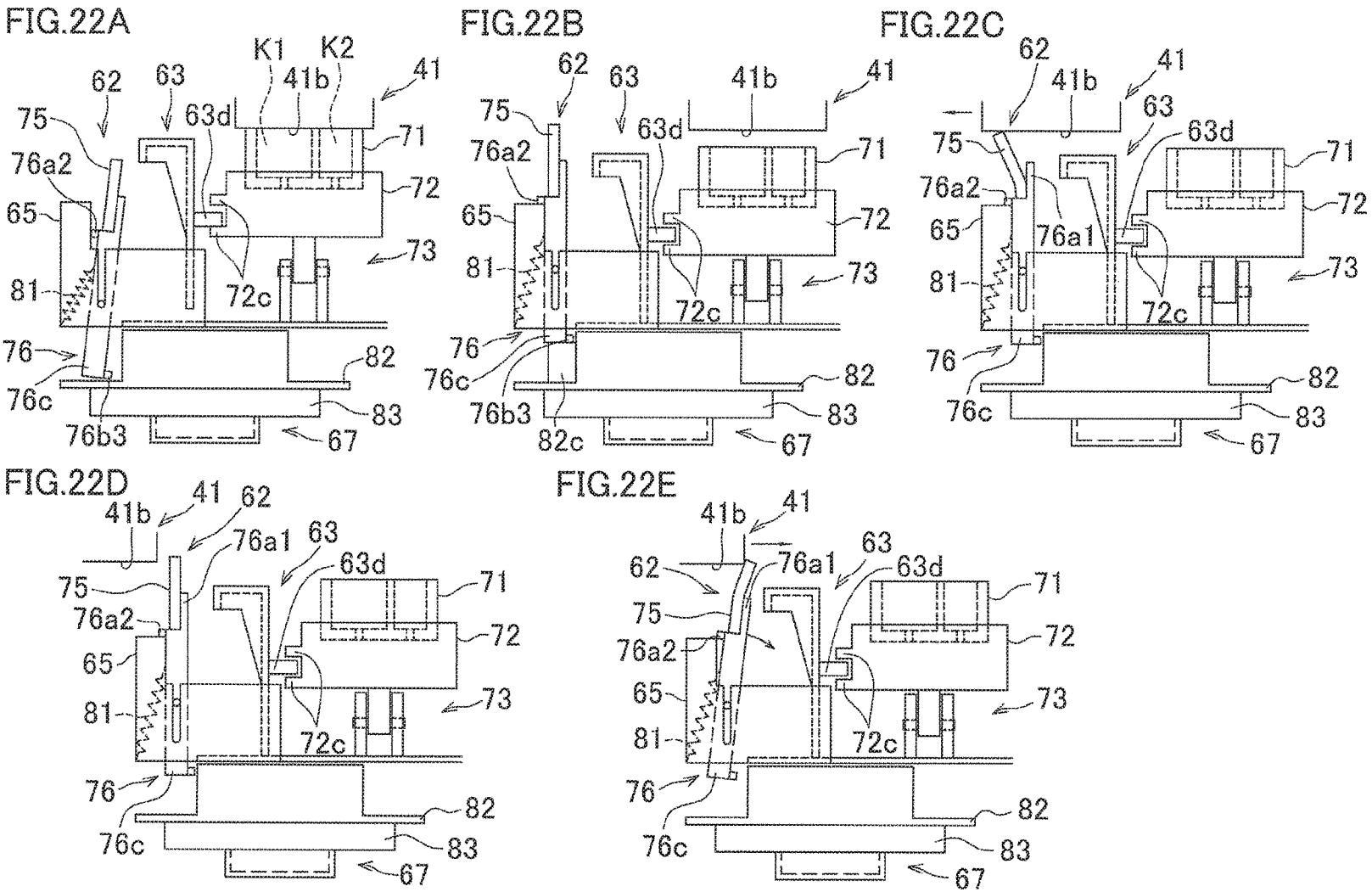

The controller 5 drives the ASF motor 20M backward to, as shown in FIG. 22A, move the suction cap 71 from the separated position to the abutting position (capping process). At this stage, the switching mechanism 67 is in the first state. Thereafter, the controller 5 drives the ASF motor 20M forward to switch the switching mechanism 67 to the second state (in which the suction pump 66 communicates with the connection hole 71*a*1 of the suction cap 71). The controller 5 then drives the LF motor 35M to drive the suction pump 66 for a predetermined time. With this, the pressure in the closed space K1 is decreased and the color ink is discharged from the ejection openings 41*a* to the recess 71*a*.

Thereafter, the controller 5 drives the ASF motor 20M forward to switch the switching mechanism 67 to the third state (in which the suction pump 66 communicates with the connection hole 71*b*1 of the suction cap 71). Then the controller 5 drives the LF motor 35M to drive the suction pump 66 for a predetermined time. With this, the pressure in the closed space K2 is decreased and the black ink is discharged from the ejection openings 41*a* to the recess 71*b*.

Subsequently, the controller 5 drives the ASF motor 20M backward to, as shown in FIG. 22B, move the suction cap 71 from the abutting position to the separated position (uncapping process). Then the controller 5 drives the LF motor 35M to drive the suction pump 66 for a predetermined time. With this, the black ink remaining in the recess 71*b* is discharged to the waste liquid tank 68. Thereafter, the controller 5 drives the ASF motor 20M forward to switch the switching mechanism 67 to the second state, and drives the LF motor 35M to drive the suction pump 66 for a predetermined time. With this, the color ink remaining in the recess 71*a* is discharged to the waste liquid tank 68. In this way, the suction purge process is finished.

Figure 24A:
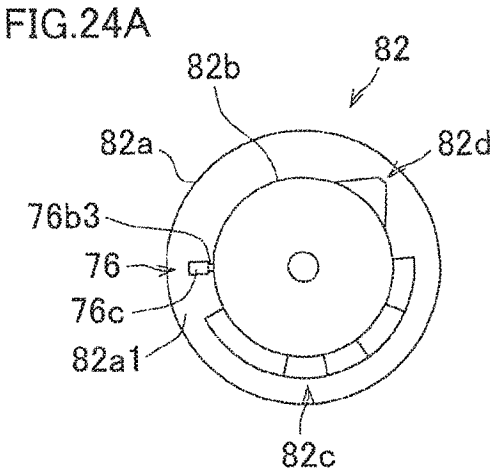
Figure 24B:
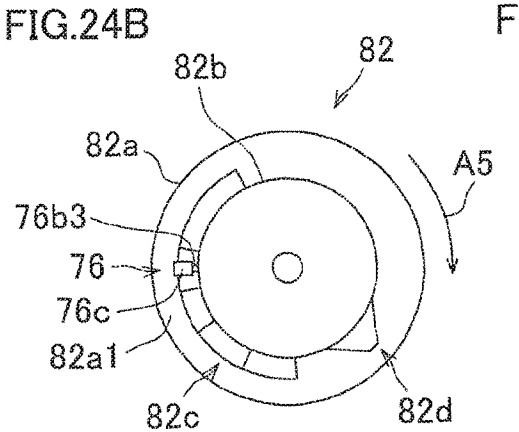
Figure 24C:
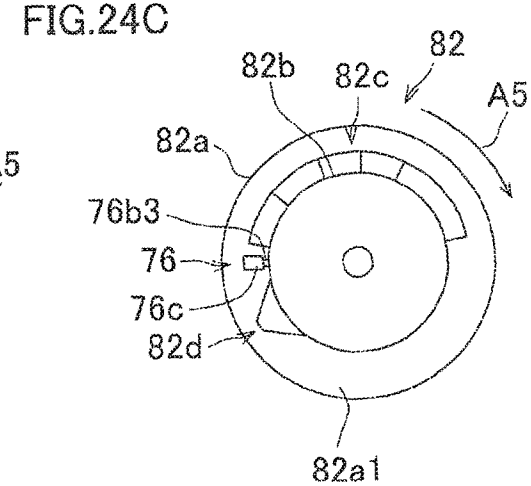

In the suction purge process, in order to drive the switching mechanism 67, the rotational cam 82 rotates at least once. That is to say, when the rotational cam 82 rotates from a position shown in FIG. 24A to a position shown in FIG. 24B, the contact part 82*c* and the lower end 76*c* are in contact with each other as shown in FIG. 22B. With this, the wiper holder 76 moves to the wiping position against the biasing force of the spring 81 (wiping position process). When the wiper holder 76 reaches the wiping position, the paired protrusions 76*a*2 of the wiper holder 76 are engaged with the maintenance frame 65 and hence the wiper holder 76 is maintained at the wiping position. Before a later-described wiping process is executed and after the discharge of the ink remaining in the suction cap 71 is finished, the controller 5 controls the ASF motor 20M to, as shown in FIG. 24C, rotate and stop the rotational cam 82 so that the lower end 76*c* is positioned between the contact parts 82*c* and 82*d* relative to the rotational direction A5.

Subsequently, the controller 5 executes the wiping process (S23). That is to say, the controller 5 controls the CR motor 50M to move the carriage 51 so as to move the record head 41 from the maintenance region G2 to the image recording region G1. With this, as shown in FIG. 22C, the record head 41 moves leftward and the ejection surface 41*b* contacts with the leading end part 75*c* of the wiper 75, with the result that the ejection surface 41*b* is wiped. At this stage, the wiper 75 is bended leftward in each of FIGS. 22A to 22E (i.e., in the direction opposite to the moving direction (wiping direction) of the wiper 75 relative to the ejection surface 41*b*) on account of the contact with the ejection surface 41*b*, and hence a gap is formed between the lower side surface 75*a*2 of the wiper 75 and the contact plate 76*a*1. This makes the ink wiped off from the ejection surface 41*b* by the wiper 75 and adhered to the upper side surface 75*a*1 of the wiper 75 likely to be drawn to the gap, and makes the ink less likely to remain on the upper side surface 75*a*1.

Subsequently, the controller 5 executes a cancellation process (S24). That is to say, the controller 5 controls the CR motor 50M to move the carriage 51 so as to move the record head 41 from the image recording region G1 to the maintenance position. To put it differently, the record head 41 is moved rightward (i.e., moved in the wiping direction) from a position shown in FIG. 22D. With this, as shown in FIG. 22E, the record head 41 contacts with the leading end part 75*c* of the wiper 75. At this stage, the bending of the wiper 75 is restrained because the lower side surface 75*a*2 and the contact plate 76*a*1 are in contact with each other. Because the wiper 75 is less likely to be bended in this way, the wiper member 62 is rotated about the paired protrusions 76*b*1 by the force generated by the movement of the record head 41, against the biasing force of the spring 81. As a result, the engagement between the paired protrusions 76*a*2 and the maintenance frame 65 is canceled and the wiper holder 76 is provided at the separation position by the biasing force of the spring 81.

Figures 23A, 23B, 23C, 23D, 23E:
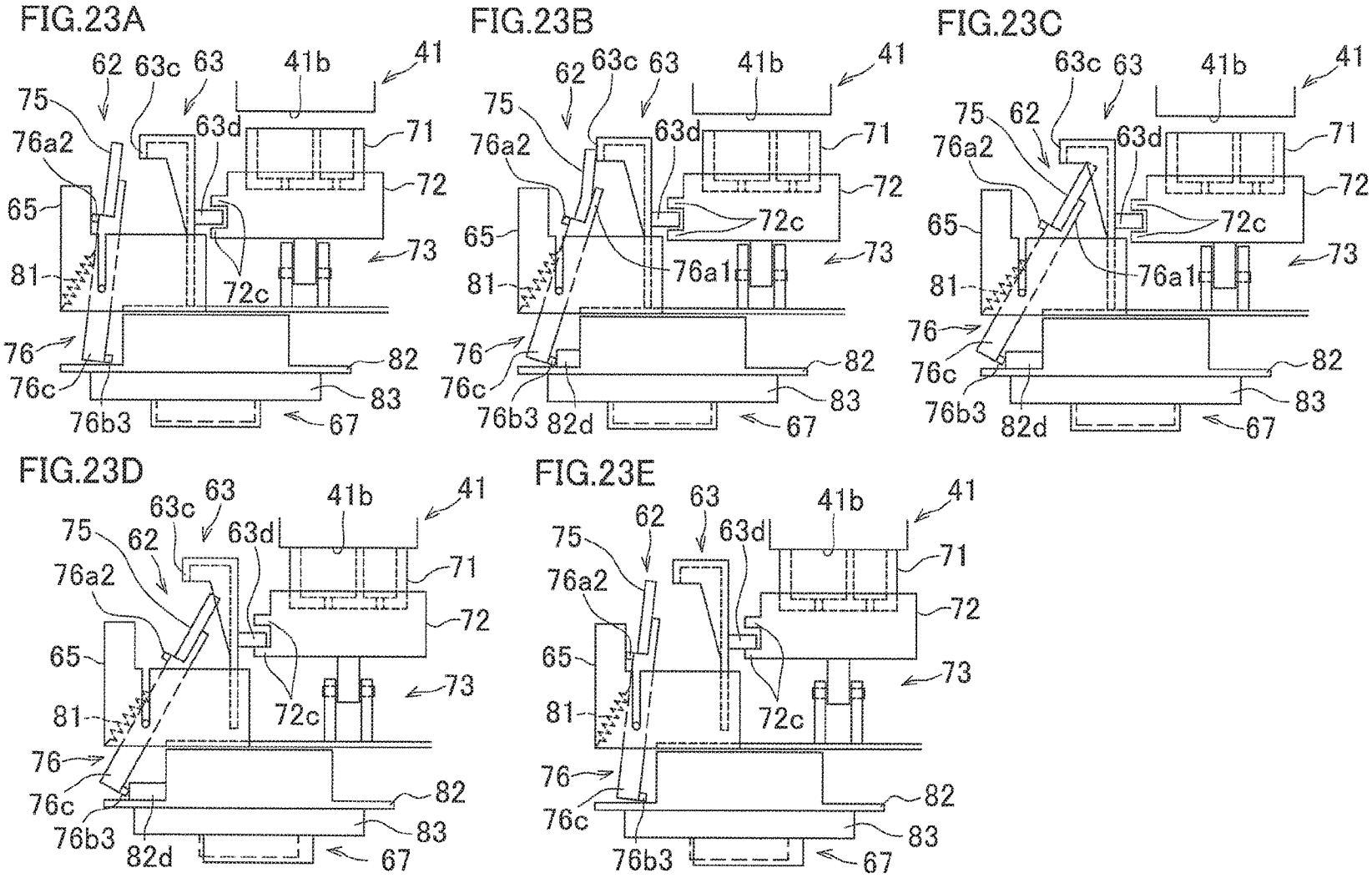
Figure 24D:
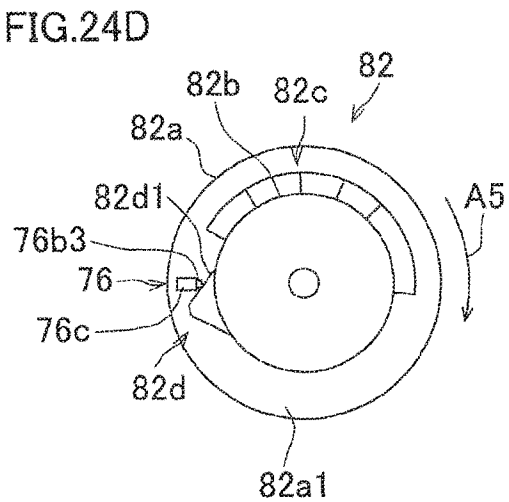
Figure 24E:
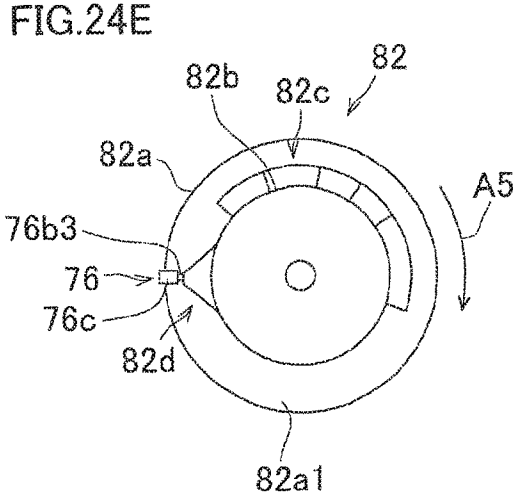

Subsequently, the controller 5 executes a cleaning process (S25). That is to say, the controller 5 controls the ASF motor 20M to move the rotational cam 82 from a position shown in FIG. 24C to a position shown in FIG. 24E and stops the rotational cam 82 at the position shown in FIG. 24E. When the rotational cam 82 is at the position shown in FIG. 24C, the wiper holder 76 is at the first position as shown in FIG. 23A. Thereafter, as the rotational cam 82 is rotated as shown in FIG. 24D, the protrusion 76*b*3 of the wiper holder 76 contacts with the side surface 82*d*1 of the contact part 82*d*, the wiper holder 76 rotates rightward against the biasing force of the spring 81 as shown in FIG. 23B, and the upper side surface 75*a*1 of the leading end part 75*c* of the wiper 75 contacts with the protrusion 63*c* of the cleaning member 63. At this stage, as shown in FIG. 25A, the wiper 75 is arranged such that the entire upper side surface 75*a*1 of the leading end part 75*c* is in contact with the protrusion 63*c*. Thereafter, as the rotational cam 82 rotates to a position shown in FIG. 24E, the protrusion 76*b*3 of the wiper holder 76 contacts with the top face 82*d*4 of the contact part 82*d* and the wiper holder 76 rotates to the second position shown in FIG. 23C. When the wiper holder 76 rotates from the first position to the second position, the ink adhered to and remaining on the upper side surface 75*a*1 of the wiper 75 is removed as the wiper 75 contacts with the cleaning member 63 (cleaning operation).

Subsequently, the controller 5 executes an avoiding process (S26). That is to say, the controller 5 drives the ASF motor 20M backward to, as shown in FIG. 23D, move the suction cap 71 from the separated position to the abutting position. In accordance with the movement of the cap holder 72 at this stage, the protrusion 72*c* and the protruding portion 63*d* are engaged with each other and the cleaning member 63 moves from the cleaning position to the non-cleaning position. In other words, the avoiding process is executed as the capping process is executed. At this stage, as shown in FIG. 25B, the cleaning member 63 moves upward while the upper edge of the leading end part 75*c* of the wiper 75 and the lower edge of the protrusion 63*c* of the cleaning member 63 are maintained to be in parallel to each other.

Subsequently, the controller 5 executes a returning process (S27). That is to say, the controller 5 controls the ASF motor 20M to move the rotational cam 82 from a position shown in FIG. 24E to a position shown in FIG. 24A and stop the rotational cam 82 at the position shown in FIG. 24A. Because of this rotation of the rotational cam 82 at this stage, the protrusion 76*b*3 and the contact part 82*d* become no longer in contact with each other. Furthermore, at this timing, the wiper holder 76 returns to the first position as shown in FIG. 23E on account of the biasing force of the spring 81. When the wiper holder 76 returns from the second position to the first position, the wiper 75 does not contact with the cleaning member 63 because the cleaning member 63 is provided at the non-cleaning position. In this way, the maintenance operation is finished.

As described above, according to the present embodiment, because the avoiding process (S26) is executed after the cleaning process (S25) for cleaning the wiper 75, the wiper 75 and the cleaning member 63 do not contact with each other when the returning process (S27) is executed. This makes it easy to return the wiper holder 76 from the second position to the first position.

In the avoiding process, the cleaning member 63 is provided at the non-cleaning position of not contacting with the wiper 75. On this account, the contact resistance at the time of returning the wiper holder 76 to the first position is eliminated. The wiper holder 76 therefore certainly returns to the first position.

The wiper holder 76 is swingably supported by the maintenance frame 65, the moving mechanism 64 includes members such as the rotational cam 82 including the contact part 82*d* and the spring 81, the contact part 82*d* is caused to contact with the lower end 76*c* to swing the wiper holder 76 from the first position to the second position in the cleaning process, and the contact part 82*d* is separated from the lower end 76*c* to swing the wiper holder 76 from the second position to the first position in the returning process. As such, a simple arrangement allows the wiper holder 76 to be swung between the first position and the second position.

The cleaning member 63 is arranged to be movable in accordance with the movement of the suction cap 71 and the cap holder 72. On this account, the movement of the cleaning member 63 and the movement of the suction cap 71 and the cap holder 72 can be both performed by the cap elevation mechanism 73.

The controller 5 executes the cleaning process when the suction cap 71 is at the separated position and executes the returning process when the suction cap 71 is at the abutting position. As the capping process is executed in this way, the avoiding process is executed.

In Second Embodiment, in the avoiding process, the cleaning member 63 is moved to the non-cleaning position where the wiper 75 and the cleaning member 63 do not contact with each other even if the wiper holder 76 moves from the second position to the first position in the returning process. Alternatively, the cleaning member 63 may be moved to a position where the wiper 75 and the cleaning member 63 contact with each other in the returning process. In this case, in the returning process, the interference with the contact plate 76*a*1 must be avoided and the contact area between the wiper 75 and the cleaning member 63 is required to small as compared to the contact area in the cleaning process. With this, the contact resistance between the wiper 75 and the cleaning member 63 when the returning process is executed is reduced. This facilitates the return of the wiper holder 76 from the second position to the first position.

In the avoiding process, the upper edge of the leading end part 75*c* of the wiper 75 and the lower edge of the protrusion 63*c* of the cleaning member 63 may not be maintained to be in parallel to each other when the cleaning member 63 may move. The fourth moving mechanism of the present invention (second aspect) may be a mechanism which moves the wiper holder 76 downward so that the wiper 75 is positioned to be lower than the wiper 75 at the second position or may be a mechanism which moves both of the wiper holder 76 and the cleaning member 63 so that the wiper 75 and the cleaning member 63 move away from each other. By employing such a mechanism, in the avoiding process, the wiper holder 76 is moved downward to move the wiper 75 downward or both of the wiper holder 76 and the cleaning member 63 are moved in the direction in which the wiper 75 and the cleaning member 63 move away from each other.

The first moving mechanism of the present invention (second aspect) may include a dedicated moving mechanism which moves at least one of the wiper holder 76 and the record head 41 between the wiping position and the separation position. With this, it is unnecessary to cancel the engagement between the paired protrusions 76*a*2 of the wiper holder 76 and the maintenance frame 65 by moving the record head 41 to the wiping direction so as to cause the record head 41 to contact with the wiper 75. Furthermore, the engagement maintenance member becomes unnecessary.

The cleaning member 63 may be moved between the cleaning position and the non-cleaning position by another dedicated moving mechanism (fourth moving mechanism) which is different from the cap elevation mechanism 73 which is configured to move up or down the suction cap 71. Furthermore, while the cleaning member 63 moves between the cleaning position and the non-cleaning position as the protruding portion 63*d* is engaged with the protrusion 72*c* of the cap holder 72, the cleaning member 63 may be directly supported by the cap holder 72. In summary, the cleaning member 63 is required to be movable in accordance with the movement of the cap member which is formed of the suction cap 71 and the cap holder 72.

While in Second Embodiment the head-moving mechanism 50 is employed as the third moving mechanism of the present invention (second aspect), a moving mechanism configured to move both of the wiper member 62 and the record head 41 in a direction in parallel to the wiping direction or a moving mechanism configured to move the wiper member 62 in a direction in parallel to the wiping direction may be employed instead of the head-moving mechanism 50.

The contact part may not be plate-shaped as in the case of the contact plate 76*a*1. For example, the contact part may be formed of protrusions which are lined up in the front-rear direction A2 on the upper surface of the wiper holder 76. In summary, the contact part is required to be able to restrain the bending of the wiper 75 when the record head 41 moving in the wiping direction contacts with the wiper 75.

The engagement maintenance member may not be the paired protrusions 76*a*2 provided on the wiper holder 76. The engagement maintenance member may be differently shaped on condition that the wiper holder 76 is engaged with and maintained by the maintenance frame 65. Furthermore, the engagement maintenance member may be provided in the maintenance frame 65.

Now, a printer of the third aspect of the present invention (Third Embodiment) will be described. The printer of the present embodiment is substantially identical with the printer of First Embodiment, and hence the features identical with those in First Embodiment may not be explained.

As shown in FIG. 26, in the present embodiment, the record head 41 further includes four exhaust units 45*a* to 45*d*. The four exhaust units 45*a* to 45*d* are provided to the right of the sub-tank 43*d* and are lined up in the front-rear direction A2. The exhaust units 45*a* to 45*d* communicate with four sub-tanks 43*a* to 43*d*, respectively, in order to allow bubbles in each sub-tank 43 to be discharged.

A maintenance unit 60 of the present embodiment is configured to recover the ejection performance by forcibly eject the ink from the ejection openings 41*a* of the head main body 42 and to discharge bubbles from the sub-tanks 43 through the exhaust units 45*a* to 45*d*. The maintenance unit 60 is provided at the maintenance position in the maintenance region G2 which is to the right of the image recording region G1, within the moving range of the carriage 51 in the scanning direction. This maintenance unit 60 will be detailed later.

Now, the sub-tanks 43*a* to 43*d* will be described. Because the four sub-tanks 43*a* to 43*d* storing inks of four colors, respectively, are structurally identical with one another, the following will describe one of the sub-tanks 43 (hereinafter, this sub-tank may be referred to as a sub-tank 43).

As shown in FIG. 27, the sub-tank 43 includes a passage 46 which is connected with the tube joint 44 at one end. The passage 46 (liquid supply passage) includes a damper chamber 46*a* and a bubble storage chamber 46*b*. The damper chamber 46*a* is connected with the tube joint 44 and extends in the front-rear direction A2. An upper part of the damper chamber 46*a* is covered with a flexible film 47. On this account, a pressure variation occurring in the ink in the passage 46 is absorbed by the damper chamber 46*a*. This makes the pressure variation less likely to be transferred to the ink in the head passage 123 in the head main body 42, and hence the ink ejection is stabilized.

The bubble storage chamber (bubble storage) 46*b* extends in the up-down direction A1, and is connected with the damper chamber 46*a* at the upper end and is connected with a supply opening 125 of the head main body 42 at the lower end. The ink in the sub-tank 43 flows to the supply opening 125 from the damper chamber 46*a* via the bubble storage chamber 46*b*. On account of such a flow of the ink, bubbles entering the passage 46 from the outside are gathered at an upper part of the bubble storage chamber 46*b* and stored.

Now, the head main body 42 will be described. As shown in FIG. 28, FIG. 29A, and FIG. 29B, the head main body 42 includes a passage unit 121 and an actuator unit 122. The passage unit 121 is formed by laminating five plates 131 to 135. The lowermost plate 135 among the five plates 131 to 135 is a nozzle plate 135 in which a plurality of nozzles 135*a* constituting the ejection openings 41*a* are formed. In the meanwhile, in the upper remaining four plates 131 to 134, holes such as manifolds 136 and pressure chambers 137 communicating with the nozzles 135*a* are formed.

As shown in FIG. 28, the ejection openings 41*a* are arranged so that four ejection opening rows 124 in each of which the ejection openings 41*a* are lined up in the front-rear direction A2 are lined up in the left-right direction A3. In the present embodiment, the black ink is ejected from the ejection openings 41*a* belonging to the rightmost ejection opening row 124*d* in FIG. 28, and color inks (yellow, cyan, and magenta) are ejected from the ejection openings 41*a* belonging to the other three ejection opening rows 124*a*, 124*b*, and 124*c*. To be more specific, from the leftmost ejection opening row 124, the second leftmost ejection opening row 124, and the rightmost ejection opening row 124 in FIG. 28, yellow, cyan, and magenta inks are ejected, respectively.

Now, a passage structure formed in the upper four plates 131 to 134 of the passage unit 121 and communicating with the nozzles 135*a* will be described. To begin with, as shown in FIG. 28, at a rear end (upstream end in the conveyance direction) of the upper surface of the passage unit 121, four supply openings 125 are formed to be lined up in the scanning direction. To these supply openings 125, inks of four colors are supplied from the sub-tanks 43*a* to 43*d*. The four supply openings 125 are constituted by a yellow supply opening 125*a*, a cyan supply opening 125*b*, a magenta supply opening 125*c*, and a black supply opening 125*d*.

In the passage unit 121, four manifolds 136 each of which extends in the front-rear direction A2 are formed. The four manifolds 136 are connected with four supply openings 125, respectively, at the rear ends. In each manifold 136, the ink flows from a back side toward a front side. In other words, the ink flows in the conveyance direction.

In addition to the above, the passage unit 121 includes a plurality of pressure chambers 137 corresponding to the respective nozzles 135*a*. The pressure chambers 137 are formed in the plate 131 which is the topmost layer of the passage unit 121, and are disposed in a planar fashion to correspond to the respective nozzles 135*a*. As shown in FIG. 28, the pressure chambers 137 are disposed to correspond to the four ejection opening rows 124, respectively, so that four pressure chamber rows in each of which the pressure chambers 137 are lined up in the front-rear direction A2 are lined up in the left-right direction A3. In this way, as indicated by an arrow in FIG. 29B, a plurality of individual passages 126 each of which is branched from each manifold 136 and reaches the nozzle 135*a* via the pressure chamber 137 are formed in the passage unit 121. These four manifolds 136 and the individual passages 126 constitute a head passage 123 formed in the passage unit 121.

As shown in FIG. 28, FIG. 29A, and FIG. 29B, the actuator unit 122 includes a diaphragm 141, piezoelectric layers 142 and 143, a plurality of individual electrodes 144, and a common electrode 145. The diaphragm 141 covers the pressure chambers 137 and is joined with the upper surface of the passage unit 121. The two piezoelectric layers 142 and 143 are laminated on the upper surface of the diaphragm 141. The individual electrodes 144 are provided on the upper surface of the upper piezoelectric layer 143 to oppose the respective pressure chambers 137. The common electrode 145 is provided between the two piezoelectric layers 142 and 143 and across the pressure chambers 137.

When a signal is supplied from the controller 5 and a drive signal is supplied from a driver IC 138 to each individual electrode 144, piezo electrostriction occurs at a part where the upper piezoelectric layer 143 opposes the pressure chamber 137, with the result that the diaphragm 141 is warped. This changes the capacity of the pressure chamber 137, and hence the ink in the individual passage 126 is pressurized and ejected from the nozzle 135*a* (ejection opening 41*a*).

Now, the exhaust units 45*a* to 45*d* will be described with reference to FIG. 26, FIG. 30A, and FIG. 30B. As shown in FIG. 26, the exhaust units 45*a* to 45*d* are provided to the right of the sub-tank 43*d*. As shown in FIG. 30A and FIG. 30B, for the four sub-tanks 43*a* to 43*d* storing the inks of four colors (yellow, cyan, magenta, and black), the four exhaust units 45*a* to 45*d* are provided, respectively.

The four exhaust units 45*a* to 45*d* corresponding to the respective four sub-tanks 43*a* to 43*d* are structurally identical with one another. Each of the exhaust units 45*a* to 45*d* includes a case 151 fixed to the side surface of the sub-tank 43*d*, an exhaust passage 152 which extends in the up-down direction A1 in the case 151, and an on-off valve 153 which is configured to open and close the exhaust passage 152. The exhaust passage 152 is connected with a connection passage 48 (see FIG. 27) which communicates at its upper end with the upper end of the bubble storage chamber 46*b*. The exhaust passage 152 extends to reach an exhaust port (outlet) 152*a* which is formed at the lower end of the case 151. The exhaust passage 152 and the connection passage 48 constitute a communication path 161.

The on-off valve 153 includes a valve member 154 which is provided in the exhaust passage 152 to be movable in the up-down direction A1 and is capable of closing the exhaust passage 152 and a coil spring 155 biasing the valve member 154 downward.

The valve member 154 includes a bottomed cylindrical valve body 156 which is movable in the up-down direction A1 in the exhaust passage 152 and a valve rod 157 which extends downward from a bottom of the valve body 156. The external diameter of the valve body 156 is shorter than the inner diameter of the exhaust passage 152, and ink is allowed to flow between the valve body 156 and the inner wall surface of the exhaust passage 152. Furthermore, to the lower surface of the valve body 156, an annular sealing member 158 is attached. The valve body 156 is configured to close the exhaust passage 152 by contacting with a valve seat 159 formed at a stepped portion in the middle of the exhaust passage 152, via the sealing member 158.

The coil spring 155 is provided between an upper end of the case 151 and the valve body 156 of the valve member 154 in a compressed manner. This coil spring 155 biases the valve member 154 downward. When the valve body 156 is moved upward by later-described open/close members 78*a* to 78*d* against the biasing force of the coil spring 155, the valve body 156 is separated from the valve seat 159 and hence the exhaust passage 152 is opened.

The maintenance unit 60 of the present embodiment further includes a drive mechanism 69 (see FIG. 35A and FIG. 35B).

As shown in FIG. 5A, FIG. 5B, FIG. 30A, FIG. 30B, and FIG. 31, a capping mechanism 61 of the present embodiment includes a suction cap 71, an exhaust cap 77, a cap holder 72 supporting the suction cap 71 and the exhaust cap 77, a cap elevation mechanism 73 configured to move up or down the cap holder 72, open/close members 78*a* to 78*d* configured to open or close on-off valves 153 of exhaust units 45*a* to 45*d*, respectively, and a solenoid 79 configured to move the open/close members 78*a* to 78*d*.

The suction cap 71 of the present embodiment includes a cap 171*a* is provided with a recess 171*a*1 which is open upward and a cap 171*b* is provided with a recess 171*b*1 which is open upward. As shown in FIG. 31, the caps 171*a* and 171*b* are integrated and made of a flexible material such as rubber and synthetic resin. In a bottom of the cap 171*a*, a connection hole 171*a*2 is formed. The connection hole 171*a*2 is connected with a tube 171*a*3. In a bottom of the cap 171*b*, a connection hole 171*b*2 is formed, too. The connection hole 171*b*2 is connected with a tube 171*b*3. As indicated by two-dot chain lines in FIG. 31, the suction cap 71 opposes the ejection surface 41*b* when the record head 41 (carriage 51) reaches the maintenance position. In this state, as the cap holder 72 is moved upward by the cap elevation mechanism 73, the suction cap 71 is provided at an abutting position (described later) of being in contact with the ejection surface 41*b*, so as to cover the ejection openings 41*a*. At this stage, a region of the ejection surface 41*b* where the ejection openings 41*a* ejecting color inks of three colors is covered with the cap 171*a*, with the result that a closed space K1 is formed in the recess 171*a*1 (see FIG. 38A). Furthermore, a region of the ejection surface 41*b* where the ejection openings 41*a* ejecting black ink is covered with the cap 171*b*, with the result that a closed space K2 is formed in the recess 171*b*1 (see FIG. 38A).

The exhaust cap 77 includes a recess 77*a* which is open upward and is made of a flexible material such as rubber and synthetic resin. In a bottom of the exhaust cap 77, a connection hole 77*b* is formed. The connection hole 77*b* is connected with the tube 77*c*. As indicated by two-dot chain lines in FIG. 31, when the record head 41 (carriage 51) reaches the maintenance position, the exhaust cap 77 opposes the lower surfaces of the exhaust units 45*a* to 45*d*. In this state, as the cap holder 72 is moved upward by the cap elevation mechanism 73, the exhaust cap 77 is provided at an abutting position (described later) of being in contact with the lower surfaces of the exhaust units 45*a* to 45*d*, and covers the four exhaust ports 152*a*. At this stage, a closed space K3 is formed in the recess 77*a* (see FIG. 30B).

The cap holder 72 supports the suction cap 71 and the exhaust cap 77 from below. On the lower surface of the cap holder 72, a plate-shaped protrusion 72*a* is formed to protrude downward. At the leading end of the protrusion 72*a*, paired protrusions 72*b* are formed to protrude in the left-right direction A3. Each of the paired protrusions 72*b* is columnar in shape.

As shown in FIG. 5A, FIG. 5B, and FIG. 31, the cap elevation mechanism 73 includes paired slide cams 73*a*, a gear 73*b*, and a link 73*c* connecting the gear 73*b* with the slide cams 73*a*. The paired slide cams 73*a* are each formed of a plate-shaped component and are provided to sandwich the protrusion 72*a* in the left-right direction A3. The paired slide cams 73*a* are supported to be slidable in the front-rear direction A2 while protruding from the bottom plate 65*a* of the maintenance frame 65. Each slide cam 73*a* is provided with a guide hole 73*a*1 which penetrates the slide cam 73*a* in the left-right direction A3 and in which the protrusion 72*b* may be provided. The guide hole 73*a*1 includes a front part 73*a*2, a rear part 73*a*3, and a connecting part 73*a*4 connecting the front part 73*a*2 with the rear part 73*a*3. Both of the front part 73*a*2 and the rear part 73*a*3 horizontally extend in the front-rear direction A2. The front part 73*a*2 is provided below the rear part 73*a*3. On this account, the connecting part 73*a*4 obliquely extends.

In the cap elevation mechanism 73 structured in this manner, as shown in FIG. 5A, when the slide cam 73*a* is provided at a position on a front side, the protrusion 72*b* is provided in the front part 73*a*2 and the cap holder 72 is provided at a position closest to the bottom plate 65*a* of the maintenance frame 65. At this stage, the suction cap 71 and the exhaust cap 77 are provided at a separated position where the caps are separated from the ejection surface 41*b* of the record head 41 provided at the maintenance position and the lower surfaces of the exhaust units 45*a* to 45*d*. As the gear 73*b* rotates clockwise in FIG. 32A and FIG. 32B for 180 degrees from a position shown in FIG. 32A to a position shown in FIG. 32B, the paired slide cams 73*a* connected with the link 73*c* move forward. At this stage, the protrusion 72*b* is guided upward by the connecting part 73*a*4 and is moved to the rear part 73*a*3. As the slide cam 73*a* is moved to a position on a front side, the protrusion 72*b* is provided in the rear part 73*a*3 and the cap holder 72 is provided at a position farthest from the bottom plate 65*a* of the maintenance frame 65. At this stage, the suction cap 71 and the exhaust cap 77 are provided at an abutting position where the caps are able to be in contact with the ejection surface 41*b* of the record head 41 provided at the maintenance position and the lower surfaces of the exhaust units 45*a* to 45*d*. In this way, as the gear 73*b* rotates, the cap elevation mechanism 73 is able to move the suction cap 71 and the exhaust cap 77 between the abutting position and the separated position. The position of the slide cam 73*a* relative to the front-rear direction A2 is detectable based on an output value (rotation amount) of a rotary encoder 69M1 (see FIG. 36) connected with the drive motor 69M of the drive mechanism 69 for driving the gear 73*b*. By controlling the position of the slide cam 73*a* relative to the front-rear direction A2, the position (the separated position or the abutting position) of the suction cap 71 and the exhaust cap 77 is controlled. The rotary encoder 69M1 is connected with the rotation shaft of the drive motor 69M and outputs a rotation amount of the drive motor 69M to the controller 5.

Each of the four open/close members 78*a* to 78*d* (hereinafter, matters in common between all open/close members may be indicated by the reference sign 78) is a rod-shaped member extending in the up-down direction. As shown in FIG. 30A and FIG. 30B, the open/close members 78*a* to 78*d* are lined up in the front-rear direction A2 at intervals. Each open/close member 78 penetrates the exhaust cap 77 while maintaining the air-tightness between the open/close member 78 and the bottom wall of the exhaust cap, and is arranged to be movable in the up-down direction relative to the exhaust cap 77. When the record head 41 reaches the maintenance position, as shown in FIG. 30A and FIG. 30B, the open/close members 78 are positioned right below the corresponding exhaust ports 152*a* of the lower surfaces of the exhaust units 45*a* to 45*d*.

As shown in FIG. 30A and FIG. 30B, the open/close members 78*a* to 78*d* are connected with one another at the lower ends, and are integrally movable in the up-down direction. As the solenoid 79 drives, the open/close members 78*a* to 78*d* move between a valve open position and a valve closed position. As shown in FIG. 30A, the valve closed position is a position where the open/close members 78*a* to 78*d* are separated from the on-off valves 153 and close the on-off valves 153. As shown in FIG. 30B, the valve open position is a position where the open/close members 78*a* to 78*d* are in contact with the on-off valves 153 and open these on-off valves 153.

Thereafter, as shown in FIG. 30B, when the open/close members 78*a* to 78*d* move upward relative to the exhaust cap 77 while the exhaust ports 152*a* of the lower surfaces of the exhaust units 45*a* to 45*d* are covered with the exhaust cap 77, the upper ends of the open/close members 78*a* to 78*d* are inserted into the exhaust passages 152 through the exhaust ports 152*a*, with the result that the valve rod 157 in each exhaust passage 152 is pushed upward. In response to this, the valve body 156 moves upward together with the valve rod 157 and is separated from the valve seat 159, and hence the exhaust passage 152 is opened (valve opening). When the open/close members 78*a* to 78*d* move downward, the upper ends of the open/close members 78*a* to 78*d* are separated from the valve rods 157. As a result, the valve body 156 (sealing member 158) is pressed onto the valve seat 159 by the biasing force of the coil spring 155, with the result that the exhaust passage 152 is closed.

As shown in FIG. 32A and FIG. 32B, the rotational cam 82 of the present embodiment includes a cam main body 82*x*, a protruding part 82*c*, a contact part 82*d*, and detection targets 82*e* and 82*f*. The cam main body 82*x* includes a disc 82*a* and a column 82*b*. The cam main body 82*x* is supported by the maintenance frame 65 to be rotatable about a rotation shaft D (see FIG. 31) which extends along the up-down direction A1.

The first position is a position closer to the rotation shaft D than to the detection targets 82*e* and 82*f* in the radial direction of the rotational cam 82. The second position is a position where the wiper member 62 at the separation position is provided when contacting with the top face 82*d*4. The wiper 75 contacts with the cleaning member 63 while the wiper member 62 moves from the first position to the second position. The second position is a position which is farther from the rotation shaft D of the rotational cam 82 than the detection targets 82*e* and 82*f* in the radial direction of the rotational cam 82, and is a position which is a part of the lower end 76*c*, where the outermost part in the radial direction of the rotational cam 82 is provided (see FIG. 40C).

As shown in FIG. 32A and FIG. 32B, the detection targets 82*e* and 82*f* are separated from each other along the rotational direction A5. Each of the detection targets 82*e* and 82*f* is formed of a plate-shaped component positioned at a peripheral edge of the disc 82*a* and protrudes upward from the upper surface 82*a*1. The detection target 82*f* (second detection target) is provided to oppose the protruding part 82*c* along the radial direction of the rotational cam 82. In the meanwhile, the detection target 82*e* (first detection target) is, in the rotational direction A5, provided to oppose a part of the side surface of the column 82*b* which is between the protruding part 82*c* and the contact part 82*d* and upstream of the contact part 82*d*. In the present embodiment, an area covered by the rotation for 180 degrees of the contact part 82*d* in the rotational direction A5 is referred to as downstream of the contact part 82*d*, whereas an area covered by the rotation for 180 degrees of the contact part 82*d* in the direction opposite to the rotational direction A5 is referred to as upstream of the contact part 82*d*.

The detection targets 82*e* and 82*f* are disposed so that, among intermediate regions R11 and R12 provided between the detection targets 82*e* and 82*f* along the rotational direction A5, one intermediate region R11 is longer than the other intermediate region R12 in the rotational direction A5. The intermediate region R11 is equivalent to a specific intermediate region of the present invention. In the rotational direction A5, the length of the specific intermediate region R11 is greater than the width of the lower end 76*c* as shown in FIG. 32C. In other words, the width of the lower end 76*c* is less than the length of the specific intermediate region R11 in the rotational direction A5.

Now, the positional relationship between the contact part 82*d* and the detection targets 82*e* and 82*f* will be described. As shown in FIG. 32C, across one end to the other end in the rotational direction A5, the contact part 82*d* is provided in the specific intermediate region R11 (i.e., between the detection targets 82*e* and 82*f*). With this arrangement, the contact part 82*d* opposes neither one of the detection targets 82*e* and 82*f* in the radial direction of the rotational cam 82. Furthermore, the contact part 82*d* is provided so that the lower end 76*c* of the wiper member 62 passes the specific intermediate region R11 when the rotational cam 82 rotates while being in contact with the protrusion 76*b*3. To put it differently, the contact part 82*d* is provided so that the movement locus L of the lower end 76*c* when the rotational cam 82 moves while being in contact with the protrusion 76*b*3 intersects with the specific intermediate region R11 (see FIG. 40E). Furthermore, the contact part 82*d* is provided so that the movement locus L does not intersect with the detection targets 82*e* and 82*f*. In other words, the lower end 76*c* does not contact with the detection targets 82*e* and 82*f* while moving from the first position to the second position.

The moving mechanism 64 of the present embodiment further includes a cam sensor 86. As shown in FIG. 32C, the cam sensor 86 is disposed to oppose a peripheral edge of the upper surface 82*a*1 of the rotational cam 82. The cam sensor 86 is an optical sensor including a light emitting element 86*a* and a light receiving element 86*b*. The light emitting element 86*a* and the light receiving element 86*b* are separated from each other along the radial direction of the rotational cam 82. The light emitting element 86*a* is on the outer side of the detection targets 82*e* and 82*f* relative to the radial direction of the rotational cam 82, and is configured to emit light to the light receiving element 86*b*. The light receiving element 86*b* is on the inner side of the detection targets 82*e* and 82*f* relative to the radial direction of the rotational cam 82 and is configured to receive the light emitted from the light emitting element 86*a*. With this arrangement, as each of the detection targets 82*e* and 82*f* blocks the light from the light emitting element 86*a* during the rotation of the rotational cam 82, each of the two detection targets 82*e* and 82*f* is detectable by the cam sensor 86. The cam sensor 86 is arranged to have positional relationships such that, when the rotational cam 82 rotates in the rotational direction A5, the cam sensor 85 passes the detection target 82*e*, the intermediate region R12, the detection target 82*f*, and the specific intermediate region R11 in this order and then return to the detection target 82*e*. Furthermore, the cam sensor 86 outputs a detection signal to the controller 5 when detecting each of the detection targets 82*e* and 82*f*. The cam sensor 86 may be a mechanical switch which detects each of the detection targets 82*e* and 82*f* when contacting with each of the detection targets 82*e* and 82*f*. In short, any type of sensor may be employed as the cam sensor on condition that each of the detection targets 82*e* and 82*f* is individually detectable.

The switching mechanism 67 of the present embodiment is configured to switch a connection state between the suction pump 66, the cap 171*a* for color ink, the cap 171*b* for black, and the exhaust cap 77. Although not particularly illustrated, the tube 171*a*3 connected with the cap 171*a* is connected with a later-described Co port 67*b*3. Furthermore, the tube 171*b*3 connected with the cap 171*b* is connected with a later-described Bk port 67*b*2. Furthermore, the tube 77*c* connected with the exhaust cap 77 is connected with a later-described exhaust port 67*b*4.

As the rotational cam 82 rotates, the switching member 67*a* (rotational body) also rotates. The switching passage 67*c* includes a circular central groove 67*d* formed at the center of the lower surface of the switching member 67*a* and two switching grooves (passage grooves) 67*g*1 and 67*g*2 connected with the central groove 67*d*. The switching groove 67*g*1 is formed of a vertical groove 67*e*1 formed in the side peripheral surface of the switching member 67*a* and a horizontal groove 67*f*1 connecting the central groove 67*d* with the vertical groove 67*e*1. The switching groove 67*g*2 is formed of a vertical groove 67*e*2 formed in the side peripheral surface of the switching member 67*a* and a horizontal groove 67*f*2 connecting the central groove 67*d* with the vertical groove 67*e*2. The vertical grooves 67*e*1 and 67*e*2 extend along the up-down direction A1 and are separated from each other along the rotational direction A5. The horizontal grooves 67*f*1 and 67*f*2 horizontally extend from the central groove 67*d*, along the radial direction of the switching member 67*a*. Relative to the rotational direction A5, the width of the switching groove 67*g*2 is greater than the width of the switching groove 67*g*1.

The switching mechanism 67 is provided at an intermediate part of a passage formed of the tubes 171*a*3, 171*b*3, 77*c*, and 66*a* connecting the suction cap 71 and the exhaust cap 77 with the suction pump 66. The intake port 67*b*1 is provided to oppose the central groove 67*d* and communicates with the central groove 67*d*.

Among the three ports 67*b*2 to 67*b*4, the first port is a Bk port 67*b*2 which communicates with a space which communicates with the cap 171*b* and receives the discharged black ink. The second port is a Co port 67*b*3 which communicates with a space which communicates with the cap 171*a* and receives the discharged color ink. The third port is an exhaust port 67*b*4 which communicates with a space which communicates with the exhaust cap 77 and mainly receives bubbles discharged from the sub-tanks 43*a* to 43*d*.

The switching member 67*a* is selectively switched to one of the first to third states as the switching member 67*a* rotates together with the rotational cam 82. As shown in FIG. 34A, the first state is a state in which the suction pump 66 communicates with the cap 171*a* via the switching passage 67*c* and the Co port 67*b*3. As shown in FIG. 34B, the second state is a state in which the suction pump 66 communicates with the cap 171*b* via the switching passage 67*c* and the Bk port 67*b*2. As shown in FIG. 34C, the third state is a state in which the suction pump 66 communicates with the exhaust cap 77 via the switching passage 67*c* and the exhaust port 67*b*4.

Based on a detection signal from the cam sensor 86 and an output value from the rotary encoder 69M1, the position of the rotational cam 82 relative to the rotational direction A5 is controlled so that the stop position of the rotational cam 82 with respect to the wiper member 62 and the switching of the switching mechanism 67 to one of the first state to third state are controlled.

The suction pump 66 is a known tube pump. By rotating the rotor of the suction pump 66 when the switching member 67*a* is in one of the first state to third state, the suction cap is able to discharge ink to one of the suction cap 71 and the exhaust cap 77. The suction pump 66 rotates as a pump motor 66M (see FIG. 36) connected with the rotor is driven.

As shown in FIG. 35A and FIG. 35B, the drive mechanism 69 includes a drive gear 69*a*, a transmission gear 69*b*, a planetary gear 69*c*, a gear 69*d*, a drive motor 69M (see FIG. 36), and a rotary encoder 69M1 (see FIG. 3: motor sensor). The drive gear 69*a* rotates as power is transmitted thereto from the output shaft of the drive motor 69M. The transmission gear 69*b* is arranged to be always engaged with the drive gear 69*a* and the planetary gear 69*c*. This planetary gear 69*c* moves to a position of being engaged with the gear 73*b* when the drive motor 69M is driven backward as shown in FIG. 35A, so as to transmit the power of the drive motor 69M to the gear 73*b*. The gear 73*b* is rotated in one direction (clockwise direction in FIG. 35A and FIG. 35B) by the power from the drive motor 69M. This allows the cap elevation mechanism 73 to be driven. In the meanwhile, the planetary gear 69*c* moves to a position of being engaged with the gear 69*d* when the drive motor 69M is driven forward as shown in FIG. 35B, and transmits the power from the drive motor 69M to the gear 69*d*. The gear 69*d* is rotated in a direction opposite to the rotation of the gear 73*b* (i.e., counterclockwise in FIG. 35A and FIG. 35B) by the power from the drive motor 69M. The gear 69*d* is engaged with the gear 83 via an unillustrated gear train. This allows the rotational cam 82 to rotate in the rotational direction A5 to drive the wiper moving mechanism 64 and the switching mechanism 67. In this way, a transmission mechanism which transmits the power of the drive motor 69M by a gear train including members such as the drive gear 69*a*, the transmission gear 69*b*, the planetary gear 69*c*, and the gear 69*d* of the drive mechanism 69 to rotate the rotational cam 82 only in the rotational direction A5 is formed, and a rotation mechanism for rotating the rotational cam 82 is formed by the drive mechanism 69 including the transmission mechanism.

The controller 5 executes, by controlling members such as the CR motor 50M, the pump motor 66M, the drive motor 69M, and the solenoid 79, maintenance operations such as a purging operation of discharging ink through the ejection openings 41*a* and an exhaust operation of discharging bubbles in the sub-tank 43 from the exhaust ports 152*a* of the exhaust units 45*a* to 45*d*.

Now, the maintenance operations of the printer of the present embodiment will be described with reference to FIG. 37 to FIG. 41. To begin with, the purging operation will be described. Upon receiving a purging signal (S31: YES), the controller 5 executes, to begin with, a first suction purge process of discharging color ink. When not receiving the purging signal (S31: NO), the controller 5 repeats S31. The following explanation presupposes that the record head 41 (carriage 51) is provided in the image recording region G1 when receiving the purging signal.

In the first suction purge process, the controller 5 executes a capping process (S32), a first communication process (S33), a suction purge process (S34), an uncapping process (S35), and an idle suction process (S36) in order. In S32, the controller 5 controls the CR motor 50M to move the carriage 51 so as to move the record head 41 from the image recording region G1 to a maintenance position in the maintenance region G2 (i.e., a position where the ejection surface 41*b* and the suction cap 71 oppose each other in the up-down direction A1). Thereafter, the controller 5 drives the drive motor 69M backward to move the suction cap 71 and the exhaust cap 77 from the separated position to the abutting position as shown in FIG. 38A (capping process).

Subsequently, in S33, the controller 5 drives the drive motor 69M forward to rotate the rotational cam 82 and the switching member 67*a* in the rotational direction A5 from predetermined original positions. The first signal output from the cam sensor 86 when the rotational cam 82 is rotated from the original position is a detection signal which is output in response to the detection of the detection target 82*e*. The second signal output from the cam sensor 86 is a detection signal which is output in response to the detection of the detection target 82*f*. Based on the signal output from the cam sensor 86 in response to the detection of the detection target 82*e*, the controller 5 executes a first communication process of switching the switching mechanism 67 to the first state. To put it differently, the controller 5 stops the drive motor 69M when the rotary encoder 69M1 detects a first predetermined rotation amount after the cam sensor 86 detects the detection target 82*e*. The first predetermined rotation amount is a rotation amount smaller than the rotation amount that the rotary encoder 69M1 detects during a period from the detection of the detection target 82*e* by the cam sensor 86 to the detection of the detection target 82*f* by the cam sensor 86. As such, as shown in FIG. 40A, the rotational cam 82 is stopped at a position where the detection target 82*e* has passed the cam sensor 86 whereas the detection target 82*f* has not passed the cam sensor 86. At this stage, the switching member 67*a* is stopped at a position shown in FIG. 34A. In other words, the first state in which the cap 171*a* communicates with the suction pump 66 is established. It is noted that, if the drive motor 69M is stopped immediately when the cam sensor 86 detects the detection target 82*e*, the stop position of the rotational cam 82 deviates in the rotational direction A5 each time the rotational cam 82 is stopped, and hence the precision of the stop position is deteriorated. On this account, the drive motor 69M is stopped after the rotation is continued for the first predetermined rotation amount after the detection of the detection target 82*e* by the cam sensor 86. In this way, the precision of the stop position of the rotational cam 82 is improved.

Figures 38A, 38B, 38C, 38D, 38E:
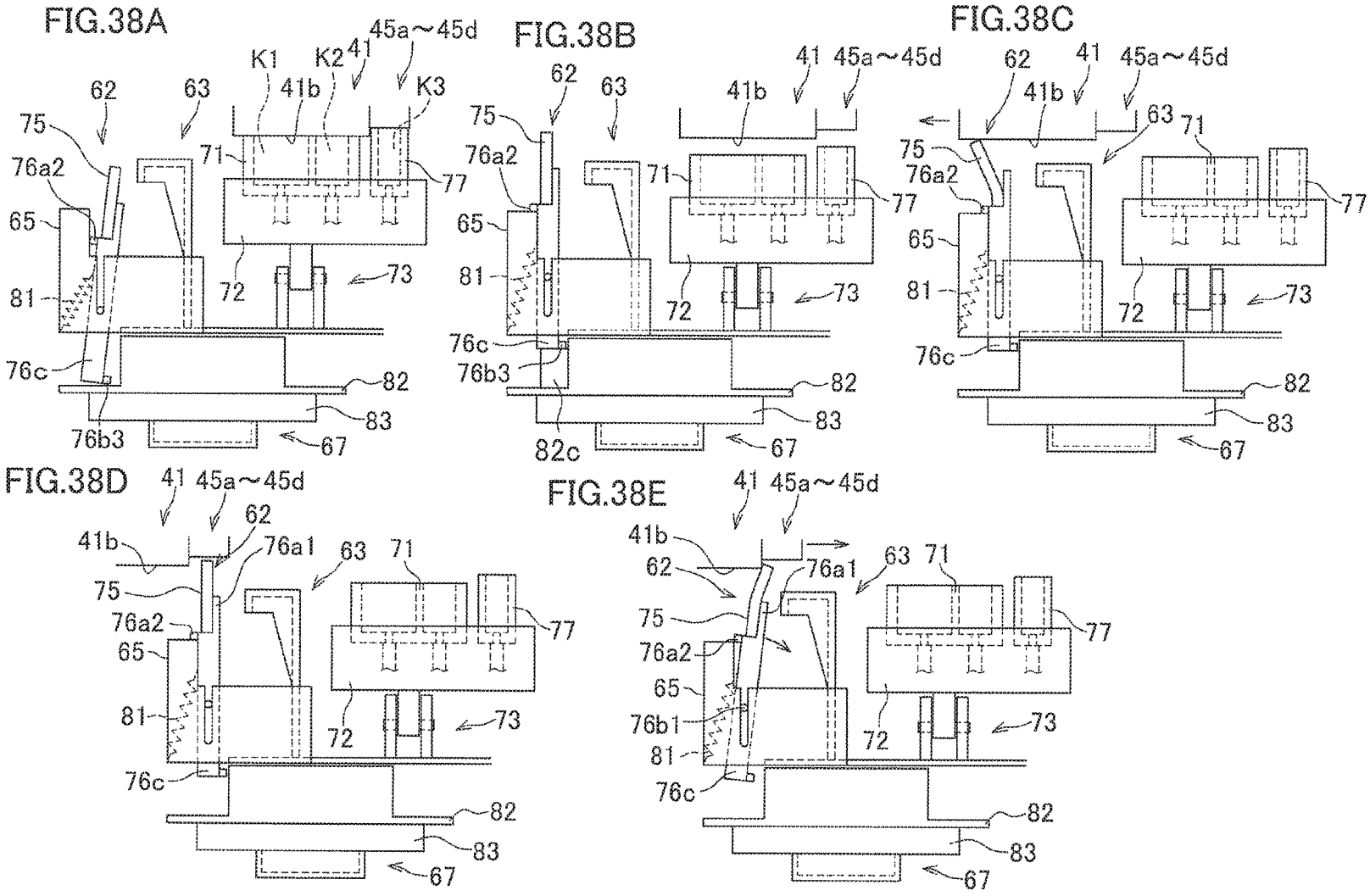

As described above, as the rotational cam 82 is rotated from the original position to the position where the first state is established, during the rotation, as shown in FIG. 38B, the lower end 76*c* and the protruding part 82*c* contact with each other, and the wiper member 62 is moved to the wiping position against the biasing force of the spring 81. As the wiper member 62 reaches the wiping position, the paired protrusions 76*a*2 of the wiper member 62 are engaged with the maintenance frame 65, and the wiper member 62 is retained at the wiping position.

Subsequently, in S34, the controller 5 drives the pump motor 66M to drive the suction pump 66 for a predetermined time. With this, the pressure in the closed space K1 is decreased and the color ink is discharged from the ejection openings 41*a* to the recess 171*a*1 (suction purge process).

Subsequently, in S35, the controller 5 drives the drive motor 69M backward to move the suction cap 71 and the exhaust cap 77 from the abutting position to the separated position as shown in FIG. 38B (uncapping process). Thereafter, in S36, the controller 5 drives the pump motor 66M to drive the suction pump 66 for a predetermined time. As a result, the color ink remaining in the recess 171*a*1 is discharged to the waste liquid tank 68 (idle suction process). In this way, the first suction purge process is finished.

Subsequently, the controller 5 executes a wiping process (S37). That is to say, the controller 5 controls the CR motor 50M to move the carriage 51 so as to move the record head 41 from the maintenance region G2 to the image recording region G1. With this, as shown in FIG. 38C, the record head 41 is moved leftward and the ejection surface 41*b* contacts with the leading end part 75*c* of the wiper 75 (wiping section), with the result that the color ink adhered to the ejection surface 41*b* is wiped. Thereafter, the controller 5 controls the CR motor 50M to move the carriage 51 so as to move the record head 41 from the image recording region G1 to the maintenance position. In other words, the record head 41 is moved rightward from a position shown in FIG. 38D (i.e., from a position to the left of the wiper member 62). With this, as shown in FIG. 38E, the record head 41 contacts with the leading end part 75*c* of the wiper 75. Because the lower side surface 75*a*2 and the contact plate 76*a*1 are in contact with each other at this stage, the bending of the wiper 75 is restrained. Because the wiper 75 is less likely to be bended in this way, the wiper member 62 is rotated about the paired protrusions 76*b*1 by the force generated by the movement of the record head 41, against the biasing force of the spring 81. As a result, the engagement between the paired protrusions 76*a*1 and the maintenance frame 65 is canceled and the wiper member 62 is provided at the separation position by the biasing force of the spring 81.

Subsequently, the controller 5 executes a cleaning process (S38). That is to say, the controller 5 drives the drive motor 69M forward to rotate the rotational cam 82 from a position shown in FIG. 40A to a position shown in FIG. 40D and then stops the rotational cam 82. To put it differently, the controller 5 stops the drive motor 69M when the rotary encoder 69M1 detects a second predetermined rotation amount after the cam sensor 86 detects the detection target 82*f*. The second predetermined rotation amount is a rotation amount smaller than the rotation amount that the rotary encoder 69M1 detects during a period from the detection of the detection target 82*f* by the cam sensor 86 to the detection of the detection target 82*e* by the cam sensor 86. As such, as shown in FIG. 40D, the rotational cam 82 is stopped at a position where the detection target 82*f* has passed the cam sensor 86 whereas the detection target 82*e* has not passed the cam sensor 86. At this stage, the switching member 67*a* is stopped at a position shown in FIG. 34B. In other words, the second state in which the connection hole 171*b*2 communicates with the suction pump 66 is established.

When the rotational cam 82 is at a position shown in FIG. 40A, the wiper member 62 is at the first position as shown in FIG. 39A. When the rotational cam 82 is at a position shown in FIG. 40B, the protrusion 76*b*3 contacts with the side surface 82*d*1, and as shown in FIG. 39B, the wiper member 62 rotates against the biasing force of the spring 81 and the upper side surface 75*a*1 contacts with the protrusion 63*c*. When the rotational cam 82 is at a position shown in FIG. 40C, the protrusion 76*b*3 contacts with the top face 82*d*4, and an outer part of the lower end 76*c* moves to a second position which is on the outside of the rotational cam 82. During the rotation of the lower end 76*c* from the first position to the second position, the ink adhered to and remaining on the upper side surface 75*a*1 is removed as the wiper 75 contacts with the cleaning member 63. Thereafter, as the rotational cam 82 rotates to a position shown in FIG. 40D, the protrusion 76*b*3 and the contact part 82*d* becomes no longer in contact with each other, and the lower end 76*c* is returned to the first position as shown in FIG. 39A by the biasing force of the spring 81. Thereafter, the controller 5 drives the drive motor 69M forward to provide the rotational cam 82 and the switching member 67*a* at the original positions.

When the lower end 76*c* moves from the first position to the first position via the second position as described above, as shown in FIG. 40E, the lower end 76*c* passes the specific intermediate region R11. To be more specific, the movement locus L of the lower end 76*c* when the lower end 76*c* moves between the first position and the second position is, as shown in FIG. 40E, formed along the radial direction of the rotational cam 82 and intersects with the specific intermediate region R11. The movement locus L is formed around the contact part 82*d* which rotates in accordance with the rotation of the rotational cam 82 and does not intersect with the two detection targets 82*e* and 82*f*. In other words, during the process of the movement of the lower end 76*c* from the first position to the first position via the second position, the lower end 76*c* does not contact with the detection targets 82*e* and 82*f*. To put it differently, the detection targets 82*e* and 82*f* are provided at positions where these targets do not contact with the wiper member 62 when the lower end 76*c* moves from the first position to the first position via the second position. Furthermore, when the wiper member 62 reaches the second position, the lower end 76*c* is provided at a position on the outside as compared to the rotational cam 82.

Subsequently, the controller 5 executes a second suction purge process. In the second suction purge process, the controller 5 executes a capping process (S39), a second communication process (S40), a suction purge process (S41), an uncapping process (S42), and an idle suction process (S43) in order. Being similar to S32, in S39, the controller 5 drives the drive motor 69M backward to move the suction cap 71 and the exhaust cap 77 from the separated position to the abutting position (capping process).

Subsequently, being similar to S33, in S40, the controller 5 drives the drive motor 69M forward to rotate the rotational cam 82 and the switching member 67*a* in the rotational direction A5 from the original positions. The controller 5 executes a second communication process to switch the switching mechanism 67 to the second state based on a signal from the cam sensor 86 detecting the detection target 82*f*. In other words, being similar to S38, the controller 5 stops the drive motor 69M when the rotary encoder 69M1 detects a second predetermined rotation amount after the cam sensor 86 detects the detection target 82*f*. As such, the switching member 67*a* is stopped at a position shown in FIG. 34B, and the second state is established. Furthermore, when the rotational cam 82 is rotated from the original position to a position where the second state is established, the wiper member 62 is retained at the wiping position during the rotation.

Subsequently, being similar to S34, in S41, the controller 5 drives the pump motor 66M to drive the suction pump 66 for a predetermined time. With this, the pressure in the closed space K2 is decreased and hence the black ink is discharged from the ejection openings 41*a* to the recess 171*b*1 (suction purge process).

Subsequently, being similar to S35, in S42, the controller 5 drives the drive motor 69M backward to move the suction cap 71 and the exhaust cap 77 from the abutting position to the separated position (uncapping process). Thereafter, being similar to S36, in S43, the controller 5 drives the pump motor 66M to drive the suction pump 66 for a predetermined time. With this, the black ink remaining in the recess 171*b*1 is discharged to the waste liquid tank 68 (idle suction process). In this way, the second suction purge process is finished. Thereafter, the controller 5 drives the drive motor 69M forward and stops the rotational cam 82 at a position where the first state is established, and provides the lower end 76*c* at a position which is between the protruding part 82*c* and the contact part 82*d* and is on the downstream of the contact part 82*d* in the rotational direction A5.

Subsequently, the controller 5 executes a wiping process similar to S37 (S44). With this, the black ink adhered to the ejection surface 41*b* is wiped. Thereafter, the record head 41 is moved from the image recording region G1 to the maintenance position and the wiper member 62 is moved from the wiping position to the separation position.

Subsequently, the controller 5 executes a cleaning process similar to S38 (S45). The wiper 75 contacts with the cleaning member 63 during the movement of the wiper member 62 from the first position to the second position, with the result that the ink adhered to and remaining on the upper side surface 75*a*1 of the wiper 75 is removed. In this way, the flow of the purging operation is finished.

Now, an exhaust operation will be described with reference to FIG. 41. Upon receiving an exhaust signal for executing the exhaust operation (F1: YES), the controller 5 executes a capping process similar to S32. In other words, the suction cap 71 and the exhaust cap 77 are moved from the separated position to the abutting position. When the exhaust signal is not received (F1: NO), the controller 5 repeats F1.

Subsequently, the controller 5 drives the drive motor 69M forward to rotate the rotational cam 82 and the switching member 67*a* in the rotational direction A5 from predetermined original positions. Based on a signal from the cam sensor 86 detecting the detection target 82*f*, the controller 5 executes a third communication process in which the switching mechanism 67 becomes in the third state (F3). In other words, the controller 5 stops the drive motor 69M when the rotary encoder 69M1 detects a third predetermined rotation amount after the cam sensor 86 detects the detection target 82*f*. The third predetermined rotation amount is a rotation amount smaller than the rotation amount that the rotary encoder 69M1 detects during a period from the detection of the detection target 82*f* by the cam sensor 86 to the detection of the detection target 82*e* by the cam sensor 86 and is larger than the second predetermined rotation amount. As such, as shown in FIG. 40F, the rotational cam 82 is stopped at a position where the detection target 82*f* has passed the cam sensor 86 whereas the detection target 82*e* has not passed the cam sensor 86. At this stage, the switching member 67*a* is stopped at a position shown in FIG. 34C. In other words, the third state in which the exhaust cap 77 communicates with the suction pump 66 is established.

Subsequently, the controller 5 drives the solenoid 79 to move the four open/close members 78*a* to 78*d* from the valve closed position to the valve open position. Thereafter, the controller 5 drives the pump motor 66M to drive the suction pump 66 for a predetermined time. With this, the pressure in the closed space K3 is decreased and bubbles in the bubble storage chambers 46*b* of the four sub-tanks 43 are discharged from the exhaust port 152*a* to the recess 77*a*. At the same time, the ink in each sub-tank 43 is discharged to the recess 77*a* (F4: exhaust process). The ink discharge amount in this case is smaller than the ink discharge amounts in the first and second suction purge processes, because bubbles are mainly discharged from each sub-tank 43. Thereafter, the controller 5 drives the solenoid 79 to move the four open/close members 78*a* to 78*d* from the valve open position to the valve closed position.

Subsequently, the controller 5 drives the drive motor 69M backward to move the suction cap 71 and the exhaust cap 77 from the abutting position to the separated position (F5: uncapping process). The controller 5 then drives the pump motor 66M to drive the suction pump 66 for a predetermined time. With this, the ink remaining in the recess 77*a* is discharged to the waste liquid tank 68 (F6: idle suction process).

Subsequently, the controller 5 drives the drive motor 69M forward to rotate the rotational cam 82 from the position where the third state is established, until the cam sensor 86 detects the detection target 82*e*. At this stage, the controller 5 determines whether the rotation amount detected by the rotary encoder 69M1 is equal to the fourth predetermined rotation amount (F7: determination process). The fourth predetermined rotation amount is a regular rotation amount that the rotary encoder 69M1 detects from a time at which movement from a position where a normal third state in which the exhaust operation is normally executable to a time at which the cam sensor 86 detects the detection target 82*e*.

In F7, when the rotation amount of the rotary encoder 69M1 is not equal to the fourth predetermined rotation amount (F7: NO), the controller 5 determines that the switching groove 67*g*2 and the exhaust port 67*b*4 are positionally displaced and the exhaust operation is not normally executed, and the process returns to F2. In other words, the exhaust process is executed again. In the meanwhile, when the rotation amount of the rotary encoder 69M1 is equal to the fourth predetermined rotation amount (F7: YES), the controller 5 determines that the exhaust operation is normally executed, and ends the flow of the exhaust operation.

As described above, according to the present embodiment, because the specific intermediate region R11 which the lower end 76*c* passes during the movement from the first position to the first position via the second position which is farther from the rotation shaft D than the detection targets 82*e* and 82*f* are from the rotation shaft D is greater than the width of the lower end 76*c*, the lower end 76*c* does not contact with the detection targets 82*e* and 82*f*. Furthermore, even if the size of the cam main body 82*x* in the radial direction is relatively small, the lower end 76*c* of the wiper member 62 which is moved by the contact part 82*d* and contacts with the cleaning member 63 does not contact with the detection targets 82*e* and 82*f* during the movement from the first position to the first position via the second position which is farther from the rotation shaft D than the detection targets 82*e* and 82*f* are from the rotation shaft D. On this account, the interference between the wiper member 62 and the detection targets 82*e* and 82*f* is prevented without arranging the radius of the cam to be greater than the length from the center of the rotational cam 82 to the second position in the radial direction, and hence the cleaning of the wiper member 62 is achieved without requiring the increase in the size of the rotational cam 82.

The contact part 82*d* is provided at a position on the rotational cam 82, which corresponds to the specific intermediate region R11 which is longer than the intermediate region R12 in the rotational direction A5, among the two intermediate regions R11 and R12. Across the one end to the other end, the contact part 82*d* in the rotational direction A5 is provided at a position corresponding to the specific intermediate region R11. This makes it easy to provide the contact part 82*d* in the specific intermediate region R11 as compared to cases where the contact part 82*d* is partially provided in the specific intermediate region R11.

The rotational cam 82 includes the detection targets 82*e* and 82*f* and the contact part 82*d* for performing the cleaning operation in which the wiper member 62 is made contact with the cleaning member 63, and the controller 5 switches the switching mechanism 67 to the first state based on a signal output when the cam sensor 86 detects the detection target 82*e*, and switches the switching mechanism 67 to the second state based on a signal output when the detection target 82*f* is detected. With this, the cleaning operation for the wiper member 62 and the switching operation between the first and second states are executed by rotating the rotational cam 82. As such, different operations can be done by simple control.

The controller 5 stops the drive motor 69M to switch the switching mechanism 67 to the third state when the rotary encoder 69M1 detects the third predetermined rotation amount after the cam sensor 86 detects the detection target 82*f*. On this account, it becomes unnecessary to provide another detection target for establishing the third state at a position which is between the two detection targets 82*e* and 82*f* and corresponds to the specific intermediate region R11. This further makes it easy to provide the contact part 82*d*.

Relative to the rotational direction A5, the width of the switching groove 67*g*2 is greater than the width of the switching groove 67*g*1. This facilitates the communication between the exhaust port 67*b*4 and the switching groove 67*g*1, and allows the switching mechanism 67 to be easily switched to the third state.

Because the controller 5 executes the determination process in F7, whether the switching mechanism 67 is in the third state is determinable, and hence the reliability of the exhaust operation is improved.

While in Third Embodiment two detection targets 82*e* and 82*f* are provided on the rotational cam 82, the number of the detection targets may be three or more. In such cases, among a plurality of intermediate regions formed along the rotational direction A5 (circumferential direction) of the rotational cam 82 and between two detection targets neighboring each other in the rotational direction A5, the region wider than the width of the lower end 76*c* in the rotational direction A5 is the specific intermediate region. The contact part 82*d* is provided at a position corresponding to this specific intermediate region, and the lower end 76*c* passes the specific intermediate region when moving between the first position and the second position. Effects similar to those in the embodiment above are achieved by this arrangement, too. When three or more detection targets are provided on the rotational cam 82, two detection targets constituting the specific intermediate region are first and second detection targets, and hence the first and second detection targets are not required to be the detection targets 82*e* and 82*f*. Furthermore, a dedicated detection target for establishing the third state may be provided.

While in Third Embodiment the contact target is in contact with the contact part 82*d* and is the lower end 76*c* of the wiper member 62, any part of the wiper member 62 in contact with the contact part 82*d* may be chosen as a contact target except the wiping section for wiping the ejection surface 41*b* of the wiper member 62 (i.e., the wiper 75, more specifically, the leading end part 75*c* of the wiper 75).

The width (distance) of the specific intermediate region R11 along the rotational direction A5 may be equal to or less than that of the intermediate region R12. Furthermore, in the rotational direction A5, the contact part 82*d* may not be partially positioned to correspond to the specific intermediate region R11. In other words, a part of the contact part 82*d* may be provided to oppose at least one of the detection targets 82*e* and 82*f* along the radial direction of the rotational cam 82.

In the axial direction (up-down direction A1) of the rotation shaft D, the contact part 82*d* may be separated from the upper surface 82*a*1 on condition that the contact part 82*d* is provided on the opposing surface (i.e., the upper surface 82*a*1) of the cam main body 82*x* opposing the wiper member 62. In such a case, the contact part 82*d* is formed on the side peripheral surface of the column 82*b*.

The controller 5 may control a driven mechanism which is different from the switching mechanism 67 and is driven in accordance with the rotation of the rotational cam 82, based on detection of the detection targets 82*e* and 82*f*.

The bubble storage chamber 46*b*, the communication path 161, the exhaust cap 77 or the like for executing the exhaust operation may not be provided.

The switching grooves 67*g*1 and 67*g*2 may be identical in width in the rotational direction A5, or the switching groove 67*g*1 may be wider than the switching groove 67*g*2. The number of the switching grooves may be three or more. The controller 5 may not execute the determination process in F7.

While in Third Embodiment the cap 171*a* for covering the ejection openings 41*a* ejecting color ink and the cap 171*b* for covering the ejection openings 41*a* ejecting black ink are provided, caps may be provided for the respective ejection openings 41*a* ejecting the inks of the respective colors. When ejection opening groups ejecting ink of the same color are formed to sandwich an ejection opening group ejecting ink of a different color, a cap may be provided for each ejection opening group. In summary, the caps are required to cover different ejection openings 41*a*, and three or more caps may be provided.

While in First to third Embodiments the protruding part 82*c* is provided on the rotational cam 82 as a part different from the contact part 82*d*, the protruding part 82*c* may not be provided. In such a case, the rotational cam 82 is not divided into the first region R1 and the second region R2. Also in this case, the wiper member 62 is selectively cleaned by rotating the rotational cam 82 for the first rotational angle θ1 or the second rotational angle θ2 from the original position as described above. That is to say, when the cleaning of the wiper member 62 is not performed, the wiper member 62 is not cleaned even if the rotational cam 82 is rotated for the second rotational angle θ2 from the original position and then the rotational cam 82 is rotated for more or less 180 degrees to drive the switching mechanism 67. In the meanwhile, when the cleaning of the wiper member 62 is performed, after the rotational cam 82 is rotated for the first rotational angle θ1 from the original position, the wiper 75 contacts with the cleaning member 63 and the cleaning is performed when the rotational cam 82 is further rotated for more or less 180 degrees.

In the cleaning process, the wiper member 62 may be slid instead of being swung, in order to move the wiper member to the first position and the second position. Furthermore, while the spring 81 is employed as an urger, an elastic member such as rubber may be employed as the urger.

The multifunction machine 1 may include a locker (not illustrated) which temporarily fixes the carriage 51 not to move, when a recording operation is not performed and a recording command from the PC is waited for. The locker is arranged to be movable in sync with the rotational cam 82, and is switched between a state of fixing the carriage 51 and a state of not fixing the carriage 51 in accordance with the rotation of the rotational cam 82. When the recording command is input to the multifunction machine 1 from the PC, the rotational cam 82 is rotated to unfix the carriage 51. When a predetermined time passes from the end of the recording operation by the multifunction machine 1, the rotational cam 82 is moved to cause the locker to fix the carriage 51. When the recording command is input to the multifunction machine 1 from the PC after a while, the rotational cam 82 is rotated again to unfix the carriage 51. As such, the rotational cam 82 may be rotated with no relation to the cleaning of the wiper 75, and the wiper 75 may unnecessarily contact with the cleaning member 63 in such a case. According to the variation, even if the rotational cam 82 is rotated to operate the locker, unnecessary contact of the wiper member 62 with the cleaning member 63 is prevented because the rotational cam 82 can be rotated after the wiper member 62 is moved to the wiping position.

While in the transmission mechanisms of First to third Embodiments power is transmitted to the rotational cam 82 when the controller 5 drives the ASF motor 20M forward and power is transmitted to the cap elevation mechanism 73 when the controller drives the ASF motor 20M backward, power may be transmitted to the cap elevation mechanism 73 when the ASF motor 20M is driven forward and power is transmitted to the rotational cam 82 when the ASF motor 20M is driven backward.

While the descriptions above deal with cases where the present invention is employed in a printer which is configured to perform recording by ejecting ink through the ejection openings 41*a*, the present invention is not limited to this application. The present invention may be employed in a liquid ejection apparatus which is not a printer and is configured to eject liquid other than ink through ejection openings 41*a*. The present invention is applicable to both line-type printers and serial-type apparatuses.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a liquid ejection head including an ejection surface in which a plurality of nozzles are formed;

a wiper member including a wiper configured to wipe the ejection surface and a wiper holder supporting the wiper;

a wiper moving mechanism configured to:

move the wiper member relative to the liquid ejection head in a wiping direction which is parallel to the ejection surface; and move the wiper member by a predetermined distance in an intersecting direction orthogonal to the ejection surface, between a wiping position where the wiper is in contact with the ejection surface and a separation position where the wiper is positioned to be separated from the ejection surface;

a cleaning member configured to remove liquid adhered to the wiper in a state that the cleaning member is in contact with the wiper;

a cam configured to be rotatable about a rotation shaft, the cam including a contact part, the contact part configured to cause the wiper to make contact with the cleaning member when contacting the wiper holder;

a driven member configured to be driven in accordance with the rotation of the cam; and a rotation mechanism configured to rotate the cam about the rotation shaft in one rotational direction, wherein, the contact part is configured to be distant from the wiper holder in the intersecting direction when the wiper member is positioned at the wiping position and to be overlapped with a moving range of the wiper holder in the intersecting direction by moving the wiper member by the predetermined distance in the intersecting direction, and the contact part has a length which is shorter than the moving range in the intersecting direction.

2. The liquid ejection apparatus according to claim 1, wherein, the wiper includes a leading end which is on an ejection surface side and the wiper holder includes a proximal end which is on a side opposite to the leading end in the intersecting direction, the rotation shaft of the cam is in parallel to the intersecting direction, and the contact part is shaped to be farther in the intersecting direction from the leading end of the wiper than from the proximal end of the wiper holder when the wiper member is positioned at the wiping position and shaped such that the contact part makes contact with the wiper holder when the wiper member is positioned at the separation position.

3. The liquid ejection apparatus according to claim 2, further comprising an engagement maintenance part configured to be engaged with the wiper holder when the wiper member is positioned at the wiping position to retain the wiper member at the wiping position, in order to prevent contact between the wiper holder and the contact part when the cam rotates, wherein, the rotation shaft of the cam extends in a direction including a vertical direction component which is vertical to the ejection surface, the wiper member is provided between the cam and the ejection surface, the wiper moving mechanism includes a protruding part protruding toward the ejection surface from a surface of the cam opposing the wiper holder, the protruding part being side by side with the contact part in the rotational direction of the cam and moving the wiper member at the separation position to the wiping position by contacting the wiper holder in accordance with the rotation of the cam, the cam includes a first region and a second region separated from each other relative to the rotational direction by the contact part and the protruding part, and the protruding part, the second region, the contact part, and the first region are moved one by one to a position corresponding to the wiper holder in this order, in accordance with the rotation of the cam, when the wiper member is positioned at the separation position, the wiper holder corresponding to the first region contacts the protruding part in accordance with the rotation of the cam, and when the wiper member is positioned at the separation position, the wiper holder corresponding to the second region contacts the contact part in accordance with the rotation of the cam.

4. The liquid ejection apparatus according to claim 3, further comprising a frame configured to support the wiper holder to be swingable about a swing shaft orthogonal to the rotation shaft, wherein, the contact part includes a slope which extends along an axial direction of the rotation shaft and is inclined to arrange a separation distance from the rotation shaft to decrease in the rotational direction, and in accordance with the rotation of the cam, the slope contacts with a part of the wiper holder which part is farther from the ejection surface in the axial direction than the swing shaft is from the ejection surface.

5. The liquid ejection apparatus according to claim 3, further comprising a controller configured to control the rotation mechanism and the wiper moving mechanism, wherein, the controller is configured to execute:

a returning process of controlling the wiper moving mechanism to return the wiper member from the wiping position to the separation position; and when the wiper member is at the wiping position, a first rotation process of controlling the rotation mechanism to provide the wiper holder of the wiper member which is to be returned to the separation position in the returning process at a position corresponding to the second region, or a second rotation process of controlling the rotation mechanism to provide the wiper member which is to be returned to the separation position in the returning process at a position corresponding to the first region.

6. The liquid ejection apparatus according to claim 5, further comprising another driven member which is different from the driven member, wherein, the rotation mechanism includes:

a drive motor; and a transmission mechanism configured to transmit power to the cam to rotate the cam when the drive motor rotates in a first direction and to transmit power to the other driven member when the drive motor rotates in a second direction which is opposite to the first direction.

7. The liquid ejection apparatus according to claim 6, wherein, the wiper moving mechanism includes:

a head-moving mechanism configured to reciprocate the liquid ejection head in a direction parallel to the wiping direction ; and an urger configured to bias the wiper member from the wiping position toward the separation position, and in the returning process, the controller moves the liquid ejection head in a direction in which a moving direction of the wiper relative to the ejection surface is opposite to the wiping direction to cause the wiper of the wiper member at the wiping position to make contact with the liquid ejection head, in order to cancel the engagement and retainment by the engagement maintenance part.

8. The liquid ejection apparatus according to claim 7, wherein, the rotation mechanism includes a switching mechanism configured to be switched between a transmission state in which the power of the drive motor is transmittable to the transmission mechanism and a non-transmission state in which the power of the drive motor is non-transmittable to the transmission mechanism, in sync with movement of the liquid ejection head, and the switching mechanism being switched to the transmission state when the liquid ejection head is provided at a downstream position downstream of the wiper relative to the wiping direction or being switched to the non-transmission state when the liquid ejection head is provided at a position different from the downstream position.

9. The liquid ejection apparatus according to claim 8, wherein, the controller executes the first rotation process or the second rotation process when the liquid ejection head is at the downstream position.

10. The liquid ejection apparatus according to claim 1, further comprising a controller configured to control the rotation mechanism and the wiper moving mechanism, wherein, the controller is configured to execute:

a returning process of controlling the wiper moving mechanism to return the wiper member from the wiping position to the separation position; and a first rotation process of rotating the cam from an original position for a first rotational angle which is smaller than 360 degrees when the wiper member is at the wiping position or a second rotation process of rotating the cam from the original position for a second rotational angle which is smaller than 360 degrees and larger than the first rotational angle, wherein, relative to the rotational direction, the contact part of the cam rotated in the first rotation process being positioned upstream of the wiper holder of the wiper member returned to the separation position in the returning process, and relative to the rotational direction, the contact part of the cam rotated in the second rotation process being positioned downstream of the wiper holder of the wiper member returned to the separation position in the returning process.

11. A liquid ejection apparatus comprising:

a liquid ejection head including an ejection surface in which a plurality of nozzles are formed;

a wiper including a leading end part where a wiping surface which is in contact with the ejection surface to wipe the ejection surface and a supporting part which supports the leading end part, the supporting part includes an opposing surface, the wiping surface and the opposing surface being provided on a downstream side in a wiping direction which is parallel to the ejection surface;

a wiper holder supporting the wiper, the wiper holder including a contact part provided to oppose the opposing surface of the wiper;

a cleaning member configured to remove liquid adhered to the wiper;

a first moving mechanism configured to relatively move the wiper holder and the liquid ejection head between a wiping position where the leading end part of the wiper is in contact with the ejection surface and a separation position where the wiper is separated from the ejection surface;

a second moving mechanism configured to reciprocate, between a first position and a second position different from the first position, the wiper holder in a first moving direction intersecting with the wiping surface;

a third moving mechanism configured to move the wiper relative to the liquid ejection head in the wiping direction;

a fourth moving mechanism configured to move at least one of the wiper holder and the cleaning member in a second moving direction which is orthogonal to the ejection surface and is other than the first moving direction; and a controller configured to control the first moving mechanism, the second moving mechanism, the third moving mechanism, and the fourth moving mechanism, wherein, the controller is configured to execute:

a wiping process of controlling the first moving mechanism and the third moving mechanism to cause the wiping surface of the wiper to wipe the ejection surface;

a cleaning process of controlling the second moving mechanism to move the wiper holder from the first position to the second position along to the first moving direction to perform a cleaning operation for causing the wiping surface of the wiper to be in contact with the cleaning member to remove liquid adhered to the wiping surface;

after the cleaning process, a returning process of controlling the second moving mechanism to move the wiper holder from the second position to the first position along the first moving direction; and after the cleaning process and before the returning process, an avoiding process of controlling the fourth moving mechanism to move at least one of the wiper holder and the cleaning member in the second moving direction such that a contact area between the wiper and the cleaning member is reduced as compared to the contact area in the cleaning process.

12. The liquid ejection apparatus according to claim 11, wherein, in the avoiding process, the controller causes the wiper and the cleaning member to be separated from each other in order to prevent the wiper and the cleaning member from making contact with each other in the returning process.

13. The liquid ejection apparatus according to claim 11, further comprising a frame configured to support the wiper holder to be swingable, wherein, the wiper is supported at a first part which is closer to the ejection surface than a swing fulcrum of the wiper holder is to the ejection surface, the second moving mechanism includes:

an urger provided between the first part and the frame to bias the wiper holder toward the first position from the second position; and a contact part configured to swing the wiper holder against a biasing force of the urger by making contact with a second part which is farther from the ejection surface than the swing fulcrum of the wiper holder is from the ejection surface, and the controller causes the contact part to make contact with the second part to swing the wiper holder from the first position to the second position in the cleaning process, and causes the contact part to be separated from the second part to swing the wiper holder from the second position to the first position in the returning process.

14. The liquid ejection apparatus according to claim 13, wherein, the urger biases the wiper holder toward the separation position from the wiping position, the first moving mechanism includes another contact part configured to make contact with the second part to move the wiper holder to the wiping position against the biasing force of the urger, an engagement maintenance member configured to cause the wiper holder to be engaged with and retained by the frame when the wiper holder is provided at the wiping position by the other contact part is further provided, and the controller is configured to further execute:

a wiping position process of controlling the first moving mechanism to cause the other contact part to position the wiper holder at the wiping position;

after the wiping position process, a wiping process of controlling the third moving mechanism to cause the wiper at the wiping position to wipe the ejection surface by moving the liquid ejection head in a direction opposite to the wiping direction; and after the wiping process and before the cleaning process, a cancellation process of controlling the third moving mechanism to cancel the engagement and retainment by the engagement maintenance member and position the wiper holder at the separation position by moving the liquid ejection head to the wiping direction and causing the wiper at the wiping position to make contact with the liquid ejection head.

15. A liquid ejection apparatus comprising:

a liquid ejection head including an ejection surface in which a plurality of nozzles are formed;

a wiper member including a wiping section configured to wipe the ejection surface, the wiper member including a contact target;

a cleaning member configured to be in contact with the wiping section of the wiper member to remove liquid adhered to the wiping section of the wiper member;

a cam configured to be rotatable about a rotation shaft, the cam including:

a contact part provided around the rotation shaft along a circumferential direction to be in contact with the contact target of the wiper member in accordance with rotation about the rotation shaft; and a plurality of detection targets which are provided at parts farther in a radial direction from the rotation shaft than the contact part is from the rotation shaft to be separated from one another along the circumferential direction; and a plurality of intermediate regions, which are formed in an interval along the circumferential direction between two neighboring ones of the detection targets, the plurality of intermediate regions including a specific intermediate region which is longer in the circumferential direction than a width in the circumferential direction of the contact target of the wiper member;

a cam sensor configured to detect the detection targets; and a rotation mechanism configured to rotate the cam about the rotation shaft, wherein, when the contact part is in contact with the contact target of the wiper member, the contact part causes the contact target of the wiper member to move from a first position to a second position in accordance with the rotation of the cam, the first position being a position between the detection targets and the rotation shaft in the radial direction, the second position being farther in the radial direction from the rotation shaft than the first position and the detection targets are from the rotation shaft, the wiping section of the wiper member is in contact with the cleaning member while the contact target is moving from the first position to the second position, and at least a part of the contact part is provided at a position corresponding to the specific intermediate region in the circumferential direction.

16. The liquid ejection apparatus according to claim 15, wherein, the specific intermediate region is the longest among the intermediate regions in the circumferential direction, and across one end to the other end in the circumferential direction, the contact part is provided at a position corresponding to the specific intermediate region.

17. The liquid ejection apparatus according to claim 15, further comprising:

a plurality of head caps configured to cover respective nozzle groups constituted by the plurality of nozzles;

a pump;

a passage configured to connect the head caps with the pump;

a switching mechanism provided at an intermediate part of the passage to selectively switch a communication state of the head caps with the pump between a first state and a second state different from the first state, in accordance with the rotation of the cam; and a controller configured to control the rotation mechanism, wherein, the detection targets including a first detection target and a second detection target forming the specific intermediate region, and the controller is configured to execute:

a first communication process of establishing the first state based on a signal from the cam sensor detecting the first detection target; and a second communication process of establishing the second state based on a signal from the cam sensor detecting the second detection target.

18. The liquid ejection apparatus according to claim 17, wherein, the rotation mechanism includes a drive motor, a motor sensor configured to detect a rotation amount of the drive motor, and a transmission mechanism configured to transmit power of the drive motor to rotate the cam only in one direction, among a plurality of separation distances along the circumferential direction each between two of the detection targets neighboring each other in the circumferential direction, a separation distance between the first detection target and the second detection target, which is equivalent to a width of the specific intermediate region in the circumferential direction, is the longest, when the cam is rotated in the one direction, the cam sensor is positioned to correspond to the second detection target, the specific intermediate region, and the first detection target one by one in this order, the switching mechanism is switchable to a third state which is different from the first and second states, and the controller is configured to further execute a third communication process of stopping the drive motor and establishing the third state when the motor sensor detects a predetermined rotation amount which is smaller than a rotation amount during a period from the detection of the second detection target by the cam sensor to the detection of the first detection target by the cam sensor, after the cam sensor detects the second detection target.

19. The liquid ejection apparatus according to claim 18, further comprising:

a liquid supply passage configured to supply liquid to the liquid ejection head;

a bubble storage configured to store bubbles in the liquid supply passage;

a communication path configured to communicate with the bubble storage; and an exhaust cap configured to cover an outlet of the communication path, wherein, the switching mechanism causes the exhaust cap to communicate with the pump when the switching mechanism is in the third state, the controller is configured to further execute an exhaust process of ejecting the bubbles from the bubble storage through the communication path by controlling the pump after the third communication process, the switching mechanism includes a pump hole communicating with the cam, a case in which a plurality of cap holes communicating with the head caps and the exhaust cap, respectively, and a rotational body provided in the case and rotating together with the cam, in the rotational body, a plurality of passage grooves communicating with the pump hole are formed, the passage grooves causing the switching mechanism to selectively take one of the first to third states by connecting the cap holes with the pump hole in accordance with the rotation of the rotational body, and a width in a circumferential direction of a passage groove by which the third state is established is greater than widths in a circumferential direction of the other passage grooves.

20. The liquid ejection apparatus according to claim 18, wherein, the controller is configured to:

further execute, after the third communication process, a determination process of determining whether a rotation amount of the drive motor until the cam sensor detects the first detection target is equal to a predetermined amount; and execute the third communication process again when it is determined that the rotation amount of the drive motor is not equal to the predetermined amount in the determination process.

* * * * *